US006028570A

United States Patent [19]

Gilger et al.

[11] Patent Number: 6,028,570

[45] Date of Patent: Feb. 22, 2000

[54] FOLDING PERIMETER TRUSS REFLECTOR

[75] Inventors: L. Dwight Gilger, Rancho Palos Verdes; A. Dale Parker, Rolling Hills Estates, both of Calif.

[73] Assignee: TRW Inc., Redondo Beach, Calif.

[21] Appl. No.: 09/080,767

[22] Filed: May 18, 1998

[51] Int. Cl.[7] ..... H01Q 15/20

[52] U.S. Cl. ..... 343/915; 52/111; 343/882; 343/912; 343/880

[58] Field of Search ..... 343/915, 881, 343/912, DIG. 2, 880, 882, 840; 52/111

[56] References Cited

U.S. PATENT DOCUMENTS 4,475,323 10/1984 Schwartzberg et al. ..... 52/111
4,587,777 5/1986 Vasques et al. ..... 52/108
4,780,726 10/1988 Archer et al. ..... 343/881
5,680,145 10/1997 Thomson et al. ..... 343/915
5,864,324 1/1999 Acker et al. ..... 343/915

*Primary Examiner*—Don Wong
*Assistant Examiner*—James Clinger
*Attorney, Agent, or Firm*—Michael S. Yatsko; Ronald M. Goldman

[57] ABSTRACT

A deployable perimeter truss reflector is capable of achieving a hitherto unobtainable thirty to one ratio in size between its size in the deployed condition and the stowed condition. The improved truss reflector structure is characterized by deployable spars that are attached to and extend from a basic frame structure to the truss. When deployed the spars are positioned outwardly and away from the basic frame of the truss, carrying the catenaries, and, the latter carrying the reflective surface into position at an end of the truss cylindrical truss. New catenary systems, deployment mechanisms, basic truss structures and cable management systems are also described.

40 Claims, 27 Drawing Sheets

FOLDING PERIMETER TRUSS REFLECTOR

FIELD OF THE INVENTION

This invention relates to deployable reflectors and, more particularly, to new collapsible support structures, fold-up perimeter trusses, principally for deployable high frequency parabolic antennas used in spacecraft.

BACKGROUND

Communications and radar systems have long employed the parabolic antenna for transmission and reception of high frequency RF high frequency electromagnetic energy in the microwave and higher frequency ranges. That antenna at a minimum contains two principal elements: An RF feed, through which the antenna is electromagnetically coupled to associated transmitting and/or receiving apparatus; and a reflector, a surface of parabolic shape, formed of a material that reflects RF, spaced from that feed. More complicated antennas are known that contain additional elements, including additional reflectors.

Since RF energy in the microwave spectrum and higher frequencies propagates, like light, in a straight line, the parabolic surface reflects RF that travels coaxially with the reflector's axis and is incident anywhere on the reflector's parabolic surface, converging that RF to the parabola's focal point, where the RF feed is positioned. Thus, RF energy that may travel in separate parallel paths to the reflector is concentrated at the feed, producing a stronger more intense RF signal.

More modern antennas of that type, referred to as an off-set parabolic antenna, differ slightly from that structure. Instead of employing an entire paraboloid as a reflector, only an offset section of the paraboloid is used. That section of paraboloid may be visualized as the intersection of a right cylinder extending axially, but off-set from the parabolic axis, and the paraboloid's surface. The intersection of the cylinder and the paraboloid forms an ellipse lying on a plane. That ellipse appears circular in outline as viewed from the axis of the imaginary right cylinder. That section of the paraboloid physically resembles a small concave shaped saucer, hence the given reference as a "dish".

Retaining the reflective characteristic of the parabolic surface, the dish reflects incident RF energy propagating parallel to the parabolic axis from any location on the surface to the RF feed at the focal point, the latter of which is physically off-set from the dish. Because the feed is offset, there is no blockage of the reflective surface, as could induce side lobes in the RF signal. Since extraneous RF signals could be introduced to the antenna system through side lobes and create electronic noise in the associated receiving apparatus, minimization or elimination of side lobes is desirable.

A principal application for parabolic antennas of either type is in conjunction with communications and/or radar systems on board spacecraft, where weight and storage space are at a premium. Accordingly, antennas for spacecraft application must be as light in weight as technology and materials science permits, which minimizes the direct and indirect propellant fuel requirements and costs to launch and carry the antenna into outer space.

The antennas must also be strong enough to meet structural design requirements, particularly as to stiffness and strength. They must also collapse or, as variously termed, fold up for storage and then, essentially, on command, unfold to a substantially larger size when deployed. The capability to fold up minimizes the volume of space occupied by the antenna in the spacecraft during its transport, a structural characteristic that is referred to as deployable. It should be understood that when an element is referred to herein as deployable, the intended meaning is that the element folds up into a smaller size, its undeployed or stowed size, and unfolds to a larger size, its deployed size.

To achieve deployability, collapsible or foldable reflectors, as variously termed, were developed and applied in the past to spacecraft as a component of the spacecraft's antenna system. Once such prior mechanism is an umbrella-like reflector structure, which, like a household umbrella, unfolds radially outwardly extending spokes of curved geometry that support a pliant reflective surface, typically a metal mesh, that stretches into the required curved shape.

Another is a perimeter truss reflector, such as is found in U.S. Pat. No. 5,680,145 granted Oct. 21, 1997 to Thomson et al, assigned to Astro Aerospace Corp, hereafter sometimes referred to as the "Thomson" reflector, to which patent the reader may refer for additional background. The principal elements of the Thompson reflector are the perimeter truss, the reflective material and the geodesic structure, including a shaping system, that supports the reflective material and shapes the reflective material into a concave parabolic shape. The reflectors described herein are also of the latter type.

As deployed, in appearance, the perimeter truss forms a large diameter short hollow cylinder. Its cylindrical wall is pervious and comprises a skeletal frame of tubular members in a closed loop, that in many respects is reminiscent of the frame of a steel skyscraper, but with the top end of the skyscraper's frame wrapped around into a circle and joined to its bottom end.

The reflective surface supported on the truss is either a pliant metal gauze, mesh, cloth-like material or a thin metalized membrane, or of any other form as well, all of which may collectively be referred to as pliant reflective material. Where a mesh material is selected, at the higher RF frequencies the mesh material is formed of very fine gold plated filaments joined in a fine mesh that resembles women's nylon stockings and is almost invisible to the eye. At the lower RF frequencies the mesh is more coarse in nature and resembles chicken coop wire in appearance. Such pliant reflective material is well known in the deployable antenna art.

To mold and shape as well as to hold the reflective surface in place on the truss, typically, the front and rear ends of the truss contains a geodesic backup structure or a series of tension lines, termed catenaries, that structurally define the parabolic surface in a skeletal or wire form. The catenaries extend across the end of the truss and are supported at the trusses end edges.

The catenaries located on the trusses front end overlie and are aligned with like catenaries supported on the trusses rear end. By tying or otherwise connecting various points along a single catenary to like points on the underlying catenary with ties that judiciously differ in length, each catenary may be shaped to approximate a portion of a parabolic curve. By judiciously shaping each catenary in the series to an appropriate portion of a parabolic curve, a entire parabolic surface is skeletally defined. That skeletal surface serves as the wall, seat or bed, however characterized, on which the reflective surface is placed, somewhat like a bed sheet laid upon a bed or a tissue blown against a window screen.

The reflective material contains some means to permit attachment or coupling to an underlying catenary. Suitably that material is attached or coupled to downwardly extending pliant drop lines or ties, which tie the reflective material to the underlying catenary member. Thus, the pliant material in these perimeter truss antennas is stretched taut to achieve the desired concave shape with an acceptable smoothness in surface defined by the shaping system when the deployable rigid frame members supporting the shaping system are extended to their deployed position. Like one's umbrella, the reflective material should drape and be collected together by moving the deployable rigid frame members to a stowed position.

For spacecraft operation, the perimeter truss is also required to be sufficiently stiff so that, as deployed, any natural modal frequencies which might be excited in the reflector as a consequence of spacecraft maneuvering or other on-orbit disturbances, as might disrupt the spacecraft's mission, are quickly damped out. Also, low frequency oscillations of the truss could adversely affect the spacecraft's orientation control apparatus.

The prior truss reflector described in the cited '145 Thomson et al patent employs, on both the front and rear of the truss, tension members or lines, which are essentially pliant, are arranged in a geodesic or crisscrossing pattern, creating multiple facets, and that pattern is pre-configured into the desired concave shape. Each geodesic pattern is tensioned with soft metal springs that connect at each intersection of the crisscrossing tape or lines. The size and number of facets in that geodesic system is governed by the highest frequency of RF that the antenna is designed to handle. The higher the frequency, the greater the number of facets required, and, hence, the greater the number of such metal springs required.

The present invention recognizes that the foregoing produces a heavier antenna structure than desired. As an advantage, the new perimeter truss reflectors described herein provides a weight saving compared to the foregoing structure, for one, by eliminating the crisscrossing lengths of catenaries, and metal springs.

Further, when deployed, the Thomson reflector forms a flat circular band. Such a geometry is inherently unstable in the out-of-plane bending direction. In other words, the circular band possesses little resistance, should external forces try to bend or twist the band into a potato chip like shape. To achieve on-orbit frequency requirements, the Thomson truss is stabilized by the geodesic system that supports the reflective mesh.

In contrast, perimeter trusses described in this specification are inherently stable to such bending or twisting forces. Its frame is sufficiently stiff to meet on-orbit frequency requirements on its own and, unlike the Thomson reflector, does not depend on the reflective material's support system to achieve out-of-plane stiffness. An ancillary consequence of that new found independence and as a further advantage to the invention is that trusses made in accordance with the invention may use a simple light weight catenary system to support the reflective mesh material to the truss, thereby further reducing the reflector's weight.

The means by which the Thomson et al reflector folds-up to attain its stowed condition dictates its stowed height, that is, the height of the package when the reflector is in the non-deployed or stowed configuration. As realized, the greater the space taken to stow the reflector, the less space remains available on-board the spacecraft for other equipment, or, conversely, given the requirement for other on-board equipment and only a pre-alloted space available for the antenna, the size of the reflector that may be stored in that space is limited.

As an additional advantage, the present invention reduces stowed package size for a given size reflector in comparison to the prior designs. As becomes apparent from the description of the preferred embodiments, which follows in this specification, for a given size antenna, the present invention stows more compactly than a Thomson reflector of the same size.

Accordingly, an object of the invention is to provide a new folding perimeter truss structure suitable for deployment in outer space.

A further object of the invention is to provide a folding perimeter truss structure that, for a given diameter, is of lighter weight than perimeter truss structures previously known.

A still further object of the invention is to provide a perimeter truss structure that has a size expansion ratio, the change in size from the undeployed to the deployed configuration, that is greater than previously attainable from prior perimeter truss reflectors.

An additional object of the invention is to provide a folding perimeter truss whose stiffness characteristic and/or rigidity is independent of the reflective mesh material's support system, and does not rely upon the latter element to attain sufficient stiffness.

A still additional object of the invention is to provide a folding perimeter truss structure that i s useful for supporting traditional symmetric parabolic reflectors as well as for offset parabolic reflectors.

SUMMARY OF THE INVENTION

In accordance with the foregoing objects, a folding perimeter truss structure for a lightweight deployable antenna reflector is characterized by a basic frame and a plurality of deployable spars that, on deployment, extend outwardly from that basic frame. The spars are pivotally supported on each of the front and rear ends of the deployable truss frame, a hollow three dimensional figure forming a closed loop, formed of deployable frame truss sections. The spars move to an outwardly extended position when the truss is deployed and define the end edges for the perimeter truss. When stowed, the spars are positioned alongside the truss's basic frame members.

Reflector support catenaries are supported from the outer ends of the deployable spars on the truss's front end. A reflective surface formed of pliant reflective material is tied to the support catenaries which forms the reflective surface to the desired parabolic shape. Guy lines anchored to the basic truss frame connect to and hold the spars to a predetermined position offsetting or balancing the pull exerted on the spars by of the support catenaries. As an additional feature each upper spar end is connected by a guy line to the spar end of an underlying lower spar to further offset the pull of the catenaries.

Tension lines connect the distal ends of the deployable spars on the front end and form a hoop circumscribing the truss and defining a single front edge to the truss. Other tension lines connect the distal ends of the rear end deployable spars and form another hoop line circumscribing the truss on the opposite end of the truss. The foldable perimeter truss reflector, including the spars, collapses or folds into a barrel-like structure for stowage.

In a preferred embodiment the reflector is of a circular aperture and the hollow three dimensional figure formed by the framework is of a circular ring shape. In other embodiments, the reflector may be of an elliptical aperture and the three dimensional figure formed by the framework and/or outer ends of the deployable spars may be of a circular ring shape or of an elliptical shape.

As an advantage, the foregoing spars and tension lines perform the function and replace outer sections of the framework of the prior deployable perimeter truss reflector designs. The latter structure, inherently, employs a greater quantity of structural material and folds-up to a stowed shape and size that is greater than that of the present invention. Hence, for a given reflector size, reflectors constructed in accordance with the prior design occupy a greater volume of valuable storage space than that required by the present invention, and is of greater weight. Trusses formed with deployable spars thus achieve significant storage space and/or weight savings.

Additional features to the invention are found in a variety of alternative designs for the framework structure, also disclosed herein, that supports and incorporates the foregoing spars as an essential element. In the alternative truss embodiments presented herein, the deployable framework incorporates one or more fold-up diagonal members, triangles, pyramids or boxes and define additional inventions. Those diagonals, triangles, pyramids and boxes serve to brace the framework and enhance the framework's rigidity and, hence, the effectiveness of the reflector.

As those skilled in the art appreciate, in achieving the foregoing perimeter truss reflector system, many other inventions of a subsidiary nature, yet capable of independent application, are also disclosed herein and claimed. Those inventions are desirably incorporated within the preferred embodiment as ancillary features, including, but not limited to, a structure for a light-weight catenary system, a deployment mechanism to assist deployment of the reflector, and various fittings.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

BRIEF DESCRIPTION OF THE DRAWINGS

In the drawings:

FIGS. 35A, 35B, 35C and 36D are diagrams of the embodiment of FIG. 34 showing the structure in various stages of folding;

DETAILED DESCRIPTION OF THE PREFERRED EMBODIMENTS

Figure 1:
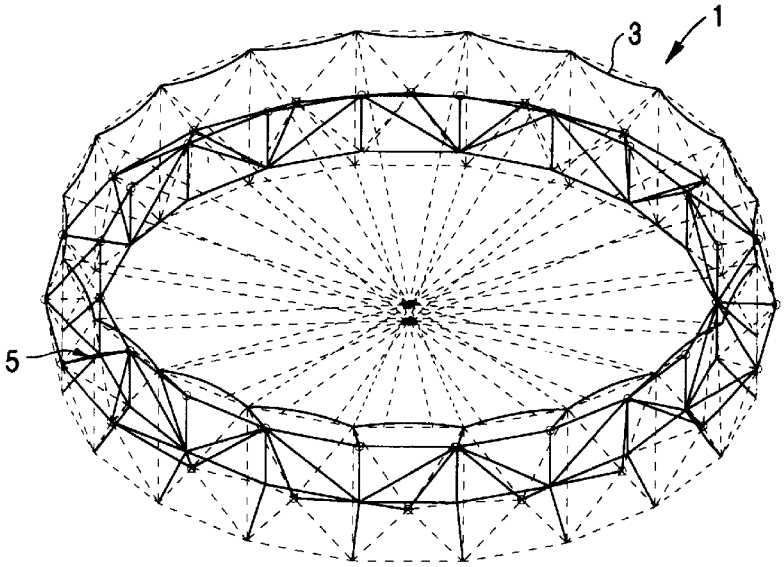
FIG. 1 illustrates an embodiment of the deployable truss for the reflector as deployed in an isometric view.

An embodiment of the new perimeter truss reflector 1 is illustrated in the deployed condition in the isometric view of FIG. 1. The reflector contains a pliable reflective material 3, particularly a mesh material, which defines a reflective surface, that is in place on the reflector support structure or, as variously termed, the truss 5.

Reflective mesh material 3 mesh is of conventional structure. The means for attaching that material to truss 5, called the catenary system, is illustrated and described later herein in greater detail. The mesh is shown as being opaque in this figure for purposes of illustration. It should be understood, however, that the material is normally highly translucent, which allows the underlying truss elements to be viewed as in the isometric view of FIG. 2 to which reference is made.

Figure 2:
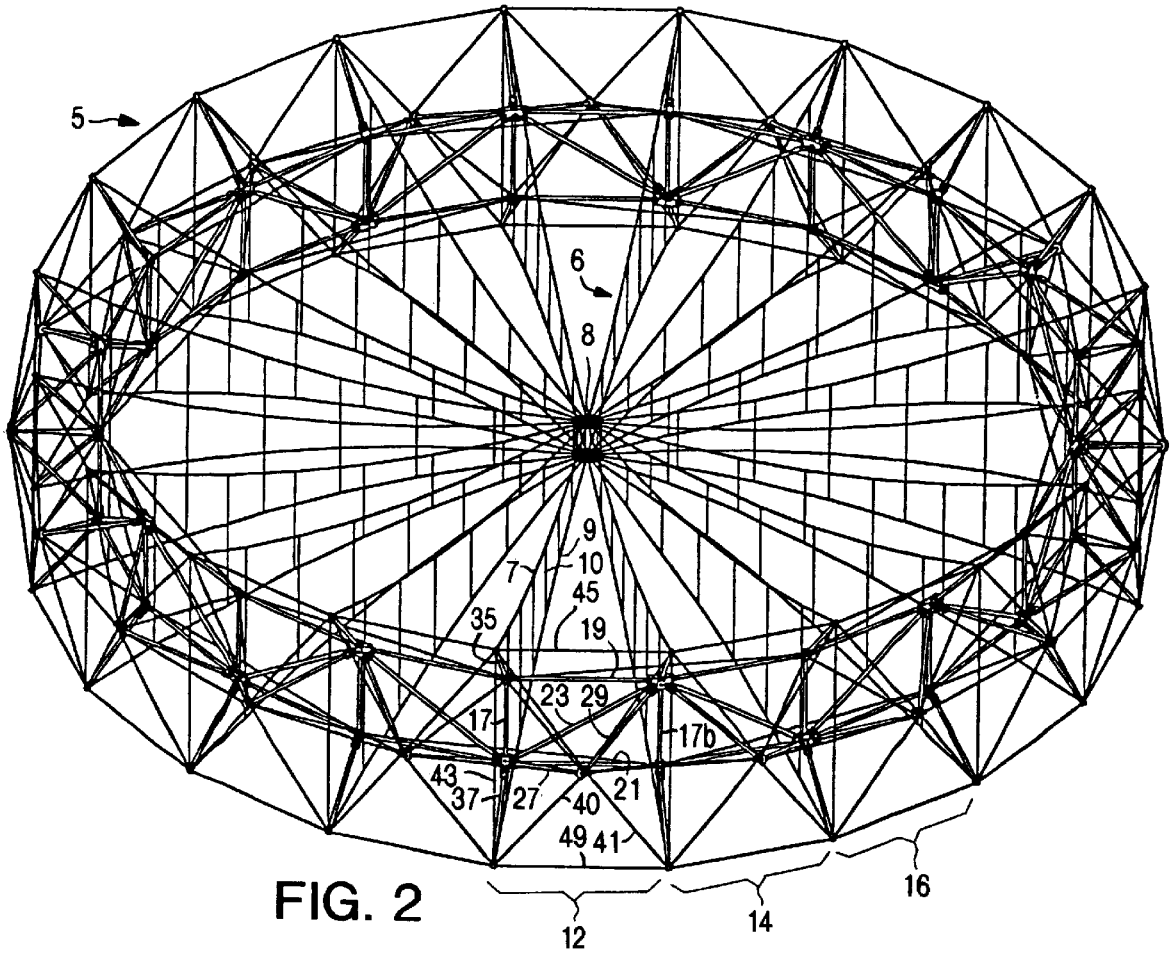
FIG. 2 is the same view as FIG. 1 with the reflective surface removed to better illustrate the truss and catenary system.

FIG. 2 also illustrates truss 5 to a slightly larger scale and view as in FIG. 1. For clarity of illustration, the pliable reflective material 3 is highly transparent, almost invisible, or may be regarded as omitted in order to better illustrate the underlying elements in a somewhat complex framework structure.

Figure 3:
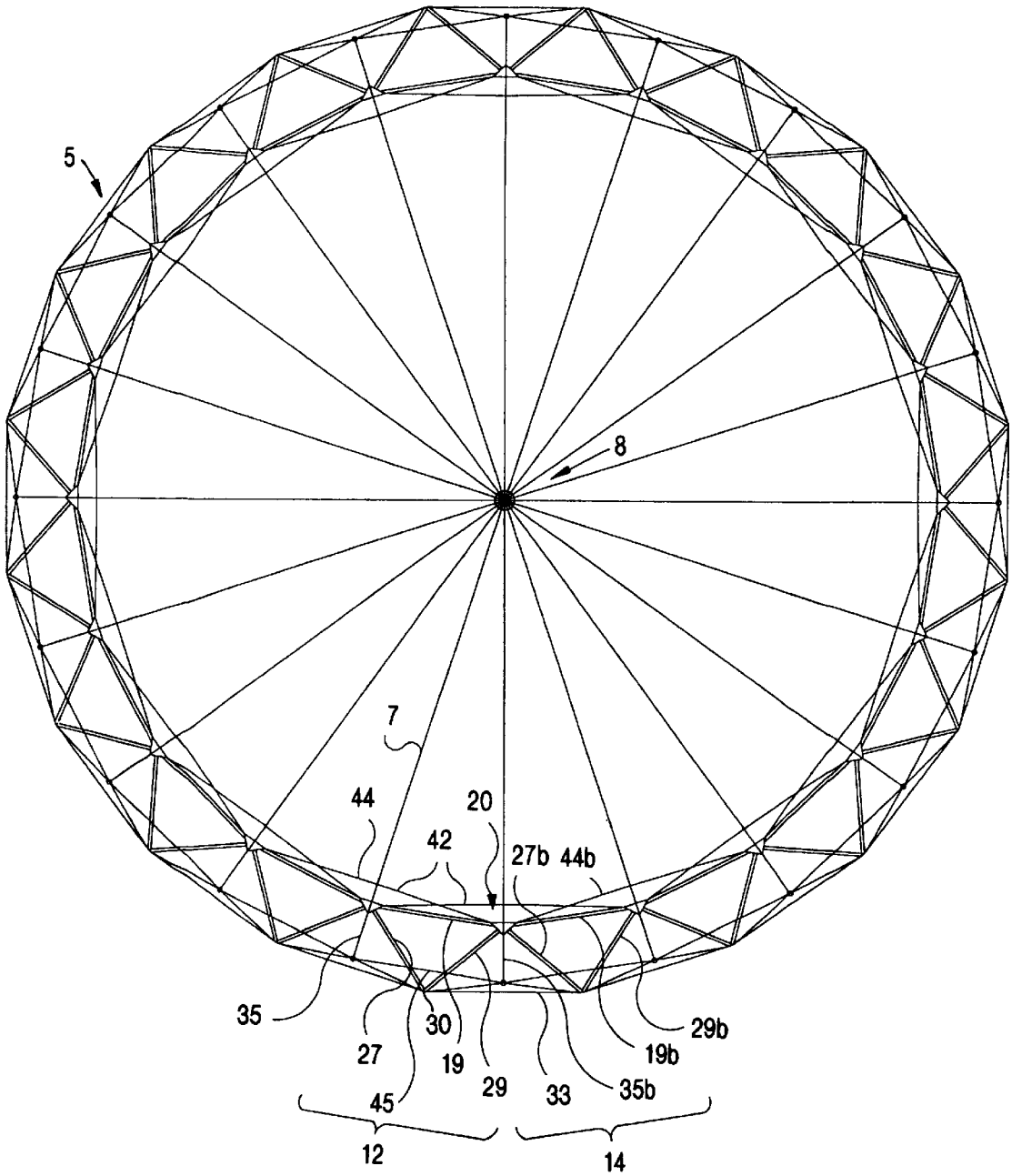
FIG. 3 illustrates the embodiment of FIG. 2 in a top plan view.
Figure 4:
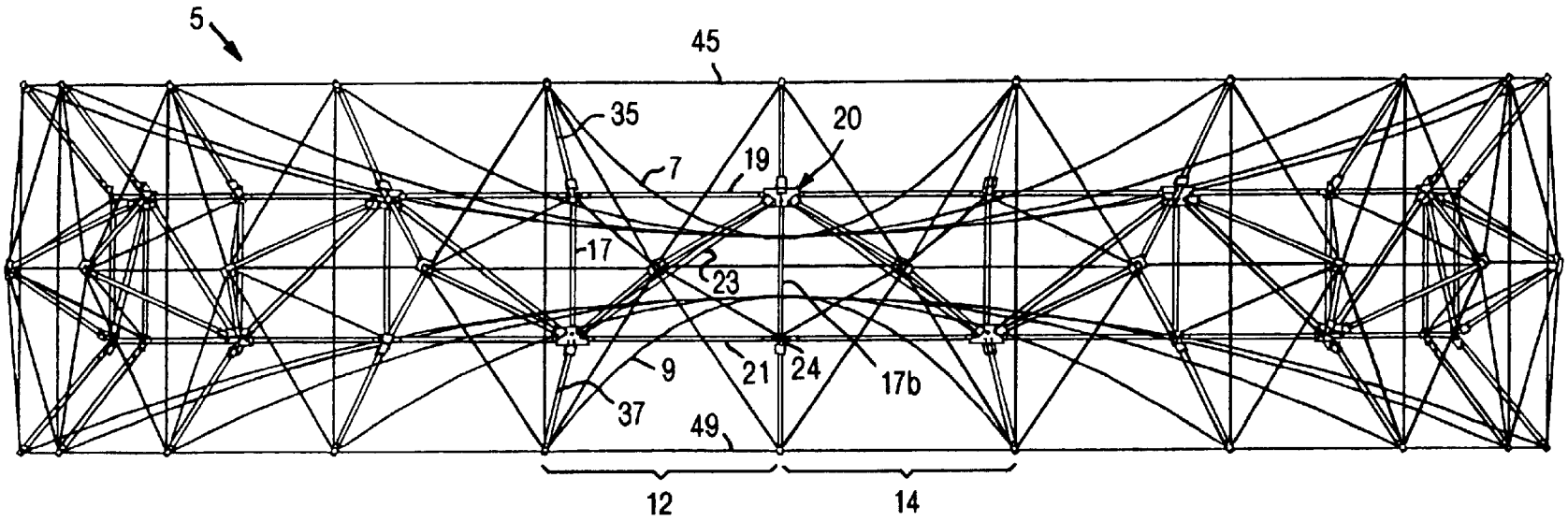
FIG. 4 illustrates the truss of FIG. 2 in a side view.

To aid in visualization, FIG. 3 illustrates the truss of FIG. 2 in a top plan view, and FIG. 4 illustrates that truss in a side elevation. In the side view of FIG. 4 the skeletal structure or framework forming the foldable truss is formed of various struts, longerons, spars and guy lines. As illustrated in the top view of FIG. 3, in this embodiment truss 5 defines a circular periphery. Other shapes are possible as herein later discussed.

The foregoing framework appears as a short hollow cylinder whose cylindrical wall is a skeletal framework of various frame and brace members arranged in a regular pattern that repeats about the periphery of the short cylinder. The front and rear ends of the truss is defined by a single edge. Each subdivision of the truss is referred to as a bay, such as bays 12, 14, and 16 identified in FIG. 2. Twenty such bays are used in the illustrated embodiment.

The truss carries a support system for reflective material 3, referred to as a catenary system 6 formed of support lines, called caternaries, 7 and 9, only two of which lines are numbered, located on the front and rear ends of the truss. The catenaries are inextensible tension members that extend across the front and rear ends of the truss. In the novel catenary system illustrated in this embodiment, the catenaries extend from a central location or center in the truss and radially extend outward to truss members at peripheral locations on the truss as illustrated. The front catenary 7 serves as a holding device or seat for the reflective metal mesh 3, the reflective surface; and the rear catenary works in conjunction with the front catenary to provide an appropriate curved profile.

As is better illustrated and later described in the additional figures in this application, such as FIG. 14, each catenary in the system is shaped by drop ties 10 into a curve that approximates the parabolic surface of the reflective dish. The greater the number and the closer the spacing between those ties, the more closely the formed curve approximates a true parabola, and, thus, the higher the RF frequency which will be reflected without significant signal loss. Additional details of the catenaries in this new catenary system and their orientation in the truss structure are described later herein in connection with FIG. 14.

A number of additional elements in FIGS. 1–4 are identified by number, including an upper deployable spar 35 and a lower deployable spar 37 associated with bay 12. The description of such frame elements is deferred to the description of an enlarged portion of the truss illustrated in FIG. 7. After considering the subsequent description, the reader should be better prepared to return to these figures, locate the elements, including those identified by number, and further study the overall framework structure presented in the foregoing figures.

Figure 7:
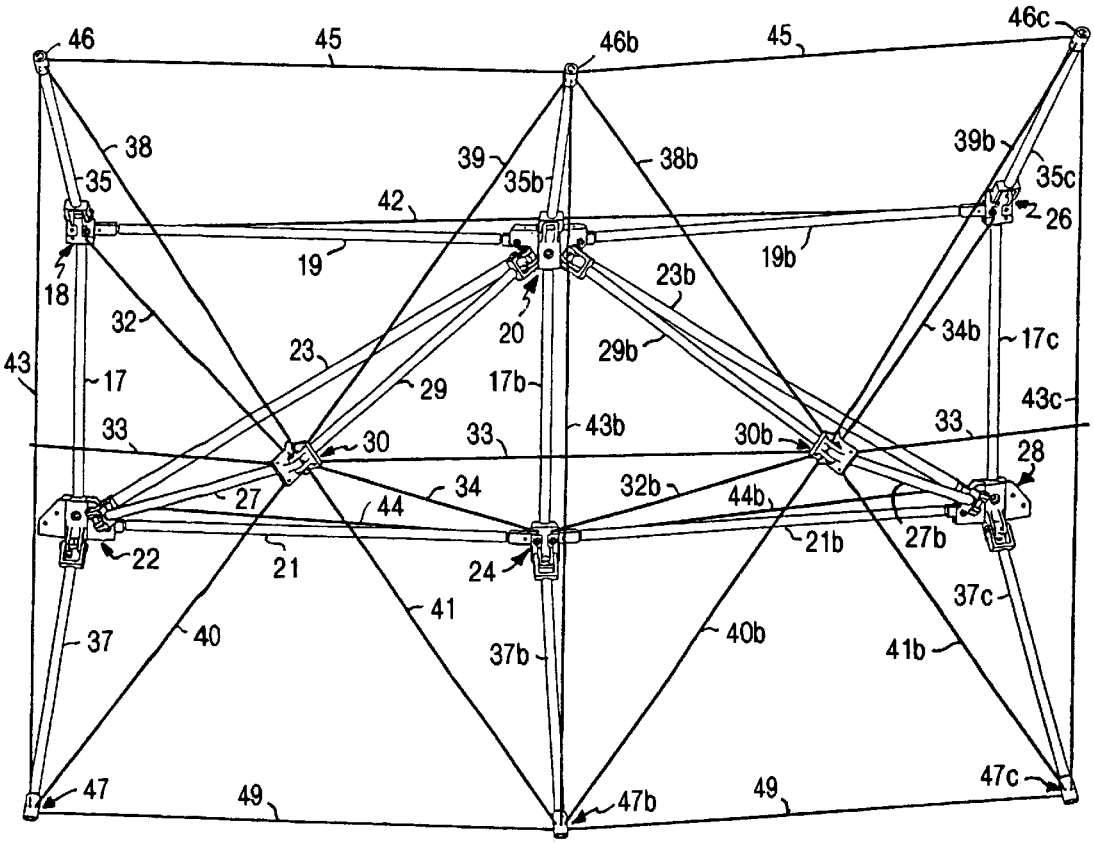
FIG. 7 illustrates a portion of the truss as viewed from the side in FIG. 4, enlarged to show greater detail.

However, one might first note in FIG. 2 that structural members 17, 19, 21, and 17*b* form a four sided polygonal figure that is repeated through out the truss forming a basic framework that extends in a closed loop of a particular diameter. That loop is visible in the top view of FIG. 3, including structural member 19, forming essentially a circle. Returning to FIG. 2, it is seen that ends of spars 35 and 37, extend outwardly and away from that basic framework, and define a closed loop of even greater diameter. This greater diameter loop is viewed in FIG. 3 by viewing tension line 45, that connects the ends of adjacent spars 35. As shown in the side view of FIG. 4, the ends of the spars 35 and connecting line 45 define the front edge to the perimeter truss; the ends of spars 37 and lines 49, define the rear end. As shown in FIG. 7, triangle struts 27 and 29, discussed in detail below, join at an even greater distance from the inner circle. Connecting line 33 connects to struts 27 and 29 at the two member fitting 30. These lines 33 form the outer circle, as shown in FIG. 3.

Figure 5:
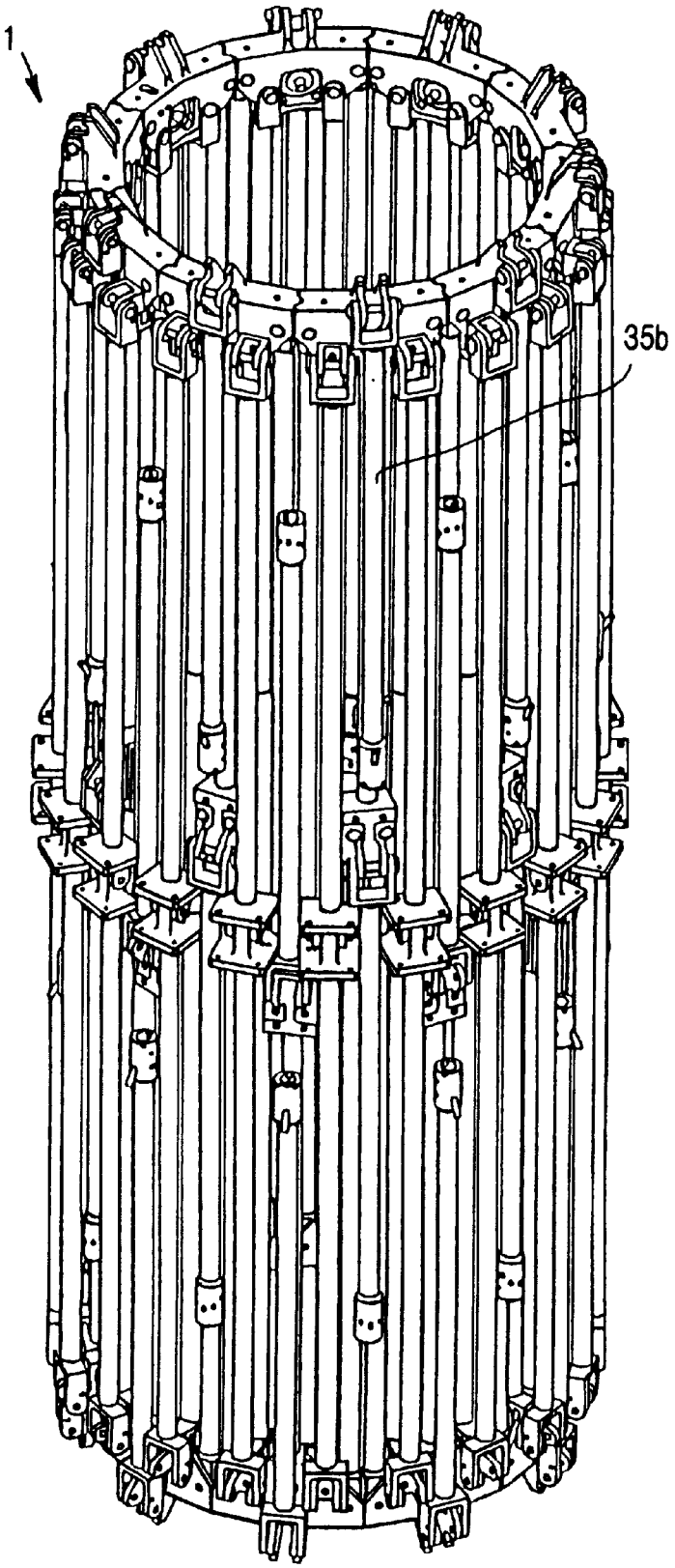
FIG. 5 is a perspective view of the foregoing reflector and foldable perimeter truss of FIGS. 1 and 2, as folded up and stowed.

When the perimeter truss reflector 1 of FIG. 2 is in the stowed condition, it appears as a small diameter closed bundle as illustrated in FIG. 5 to which reference is made. It is noted that the illustration is drawn to a substantially larger scale than used for FIGS. 1–4 in order to permit individual elements to be visibly distinguishable. As illustrated, truss 5, catenary system and reflective surface fold up neatly and form a cylindrical structure, referred to as a barrel, that is substantially smaller in size than when deployed. As example in a practical embodiment a deployed diameter of 15 meters was achieved with a truss height of 2.8 meters. When stowed the package was 0.5 meters in diameter and 1.9 meters tall. This attains a packing ratio of 30 between the diameter as deployed and the diameter as stowed. The reflector weighs about eighty pounds.

Figure 6:
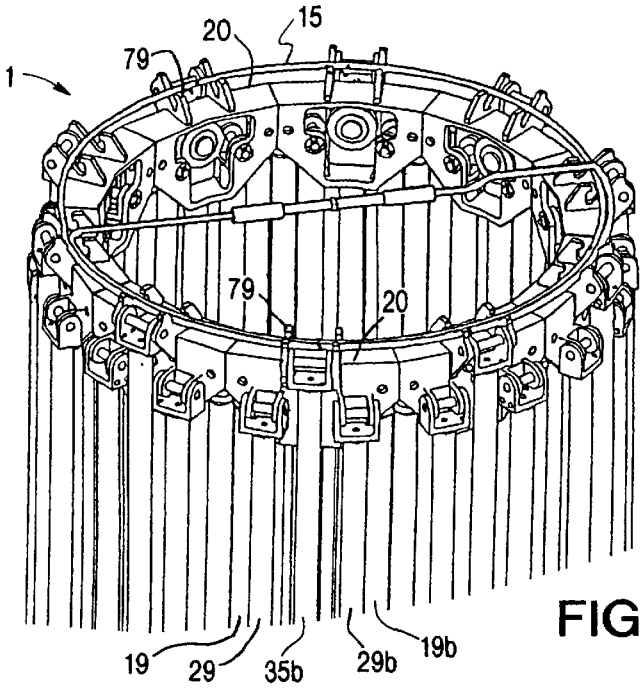
FIG. 6 is a perspective view of one end of the stowed truss of FIG. 5, drawn in a larger scale.

An enlarged view of an end of the foregoing stowed truss of FIG. 5 is illustrated in FIG. 6. For clarity, the various catenary lines and reflective mesh, which are normally conveniently packed within the central region of the barrel, are omitted from this figure. As shown, the truss members fit together compactly and are held together in the bundle by a looped cable 15 that serves the hook shaped members 79 formed on each of the eight member fittings, later herein described, such as fitting 20, as part of a latching or tying arrangement. This is described in greater detail later herein with respect to FIG. 11 and FIGS. 18 and 19.

To permit a better understanding of the invention, its physical characteristics and operation, the two adjacent bays 12 and 14 in the truss of FIG. 2 are illustrated in larger scale in deployed condition in side view in FIG. 7 to which reference is made. It should be noted that the connecting devices or, as variously termed, fittings, connecting the various structural members and tension elements together are illustrated in greater scale and described later in this specification, and, accordingly, need be given only brief reference at this stage of the description.

As shown in FIG. 7, each bay is formed from a basic framework of structural members, such as members 17 and 17*b* and 19 and 21, that are connected together into a frame by appropriate fittings. As later herein described, the basic framework in this embodiment is novel and may also be used as a deployable reflector truss, although one that cannot achieve the high packaging ratio achieved with the preferred embodiment.

Member 17 is referred to as a vertical strut. There are two additional vertically oriented vertical struts 17*b* and 17*c* shown in the figure. Horizontal members 19 and 21 are called hoop longerons. The upper longeron 19 essentially spans the upper ends of two adjacent vertical struts 17 and 17*b* in bay 12 in the figure. Separate pairs of horizontal longerons are included in each of the other bays, such as 19*b* and 21*b* shown for the other bay 14 in the figure.

The longerons and vertical struts are each connected to fittings which joins them to a particular location and allows relative pivotal movement. Thus, the upper end of vertical strut 17 and the left end of longeron 19 are connected to fitting 18, referred to as a four member fitting. Four member fitting 18 is illustrated in a larger scale in FIG. 8, later herein discussed.

The upper end of vertical strut 17*b* and the right end of longeron 19 are connected to fitting 20, referred to as an eight member fitting. Eight member fitting 20 is illustrated in larger scale and in multiple views in FIGS. 9, 10 and 11, later herein discussed. The lower end of vertical strut 17 and the left end of lower hoop longeron 21 are connected to another eight member fitting 22; and the right end of hoop longeron 21 and the lower end of vertical strut 17*b* are connected to four member fitting 24.

At the right end of the other bay 14 illustrated in FIG. 7, the right end of upper longeron 19*b* and the upper end of a vertical strut 17*c* are connected to another four member fitting 26. The lower end of strut 17*c* and the right end of longeron 21*b* are connected to another eight member fitting 28. The latter fittings also connect to additional elements in the figure and to corresponding elements in the next adjacent bay to the right, not illustrated. Likewise fittings 18 and 22 serve as a connection point for additional elements in the immediate adjacent bay to the left of bay 12, not illustrated in the figure.

Together the vertical struts and hoop longerons in a bay, as fitted together, define a rectangular frame. The right and left side of each bay, such as bay 12, is essentially defined by an adjacent spaced pair of such vertical struts, defining the height of that frame; and each such vertical strut is common to two adjacent bays. The lower hoop longeron 21, oriented in parallel with hoop longeron 19, essentially spans the bottom ends of those same two vertical struts and essentially define the width of the rectangular frame. In this embodiment, the vertical struts are evenly spaced from each other and the bays of the truss embodiment, therefore, are of equal size. As is apparent as one proceeds about the truss along both the upper and lower hoop lines, 45 and 49, one finds each eight member fitting, such as 20, is separated from another such fitting by a four member fitting, such as 18 and 26; and each bay contains two eight member fittings located at diagonally opposite corners of the rectangular frame.

Member 23 is a telescoping diagonal. The diagonal extends upwardly to the right diagonally across the rectangular basic frame to the bay. The left end of telescoping diagonal 23 is connected to a clevis, which allows pivotal movement, forming a part of eight member fitting 22, and the right end of the diagonal is connected to a clevis on another eight member fitting 20.

In the adjacent bay 14 to the right, a like telescoping diagonal 23*b*, extends diagonally downward from left to right across the bay's basic frame, and is connected between eight member fitting 20 to the upper left and eight member fitting 28 to the lower right, suitably by devises. As shown in FIG. 2 to which brief reference may be made, the next telescoping diagonal in the next adjacent bay to the right is oriented in the same direction as telescoping diagonal 23 located in bay 12. Those diagonals alternate in direction from bay to bay, creating a zig-zag effect.

Telescoping diagonal 23 is a telescoping tube arrangement, similar to that found in a collapsible umbrella, wherein one hollow tube fits within a larger hollow tube and may be slid in or out to respectively adjust the length of the member. Without a latching system, such a member cannot resist compressive force applied between its ends. The telescoping diagonals in this embodiment, however, contain an internal latch. As becomes apparent from the discussion of the operation later in this specification, the telescoping diagonal is at its extended length when the truss is stowed. The diagonal latches up when it attains a foreshortened length when the truss is fully deployed. That is, when the truss is deployed as illustrated in FIG. 7, the telescoping diagonal member latches and holds to its shortened length. The latch allows the member to carry compressive loads. It stiffens the structure by adding the telescoping diagonals into the load path.

Figure 28C:
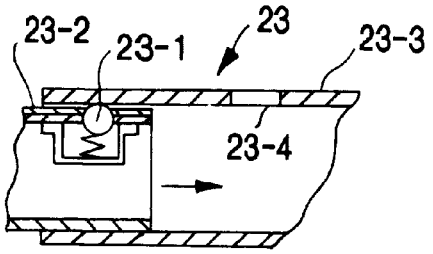
FIGS. 28*a* and 28*b* are pictorial illustrations of cable management system components used in the embodiment of FIG. 27.

A conventional cantilever latch or ball and socket latch appear suitable for this application, is pictorially illustrated in FIG. 28*c*, partially in section. A spring loaded ball 23-1 is seated within one of the tubes 23-2 of the member. That tube fits within the larger diameter tube 23-3 containing an opening 23-4 in the tube wall. When tube 23-2 is pushed far enough into tube 23-3, the ball 23-1 eventually reaches and is forced by the spring to protrude into that opening. Effectively the ball prevents the tubes from withdrawing from that position. To do so the ball must be pressed back inside the tube and the tube then move off the latch. This is entirely conventional. To fold up the truss for stowage following assembly, the technician must of course release all the latches in order to the telescoped tubes to slide out of one another and lengthen that diagonal member.

Continuing with FIG. 7, structural members 27 and 29, located in bay 12, are referred to as triangle struts. The two struts are pivotally joined together at one end to a fitting 30, referred to as a two member fitting, to form the apex of a triangle. The two member fitting is illustrated in larger scale in FIG. 12, later herein described in greater detail. The remaining end of strut 27, to the lower left, is pivotally connected to eight member fitting 22 and the remaining end of triangle strut 29 is pivotally connected to the eight member fitting 20, shown at the upper end of vertical strut 17*b*. As deployed, struts, 27 and 29, overlie telescoping diagonal 23 and form a triangle with telescoping diagonal 23 serving as the triangle's base. Hence, the basis for the denomination of those struts as triangle, which is not a reference to the strut's individual geometry and is a reference to the members place in a geometrical structure.

The triangle struts are structural tubular members. As used herein the term structural is intended to mean that the member is useful for carrying compressive and/or bending loads, and may possess a degree of compliance. The foregoing subsumes the term rigid, which implies extreme stiffness and no compliance at all, which is the outer limit to the meaning of structural.

Adjacent bay 14 also contains triangle struts 27*b* and 27*b*. The right end of strut 29*b* and left end of strut 27*b* are each connected to another two member fitting 30*b*. The left end of triangle member 27*b* is connected to a clevis on fitting 20 on the upper left of bay 14; and the right end of strut 29*b* connects to a clevis at eight member joint 28. These struts are positioned overlying an associated telescoping diagonal 23*b* and together geometrically form another triangle figure.

Elements 32 and 34 in bay 12 are guy wires, more particularly, triangle support guy lines to distinguish them from other guy lines in the embodiment. The guy lines are tension members, such as wires or cords, which are substantially inextensible and flexible.

As used in this specification, unless otherwise indicated, flexible means pliant, or, as variously termed, essentially incapable of retaining any given shape when not subjected to tensile forces. Inextensible is intended to mean the member referred to will not significantly lengthen or stretch under load and is substantially temperature invariant. A common example of such a tension member is a string. In more technical terminology, the guy line is a high modulus near zero creep low coefficient of expansion material, such as graphite multi-filament cords. The remaining guy lines to the truss and the hoop lines, later herein identified, are also formed of the latter material.

Triangle support guy lines 32 and 34 extend taut from two member fitting 30, connecting the two triangle struts, to the diagonally opposite corners of the bay's basic frame not occupied by either the ends of triangle struts 27 and 29 or telescoping diagonal 23. Thus, triangle guy line 32 extends taut from four member fitting 18 to two member fitting 30 at the apex of the formed triangle figure, and triangle guy line 34 extends from the latter fitting to eight member fitting 24 at the lower end of vertical strut 17*b*. Corresponding triangle support guy lines 32*b* and 34*b* are included in adjacent bay 14. Guy line 32*b* extends taut from four member fitting 24 to which it is connected upwardly to the right and connects to the two member fitting 30*b* at the apex of the formed triangle figure. Guy line 34*b* extends from two member fitting 30*b* to four member fitting 26 in the upper right corner of the basic frame.

Similar in purpose to the guy lines used to hold a tent pole upright, the triangle guy lines are placed in tension when the truss is deployed and hold the formed triangle's apex 30 in place, resisting any lateral forces applied to the triangle formed by the associated triangle struts 27 and 29, earlier described. The guy lines function in pairs, preventing movement of the triangle's apex in one diagonal direction or the opposite direction, hence their denomination as triangle support guy lines.

An additional guy wire 33, is connected taut between two member fittings 30 and 30*b*. Like guy wires, which may also be referred to by the number 33, are connected between each adjacent pair of corresponding two member fittings found at the apex of the triangle members. Collectively guy lines 33 define a center hoop line, located mid-way between the front and rear ends of the truss, that extends about the side of truss 5. The center hoop line is formed of a plurality of individual tension connected essentially end to end between each adjacent formed triangle in each bay. The lines forming the hoop line are basically inextensible tension members.

The hoop line serves to stiffen the structure by increasing the area moment of inertia of the hoop. This increased area moment of inertia increases resistance of the structure to "ovaling", in which the sides move toward the center and the top and bottom move away to create an oval shape.

Additional guy lines 42 connect between adjacent four member fittings, such as fittings 18 and 26, on the front end of the basic frame; and guy lines 44 and 44*b* connect between those four member fittings on the rear end of the basic frame, only one of which is shown in rear end in the figure, fitting 24. Partially concealed behind members 21 and 21*b* in the figure, guy line 44 extends to the next adjacent four member fitting, not illustrated, to the left rear in the truss; and guy line 44*b* extends to the next adjacent four member fitting to the right, bypassing the intermediate eight member fittings 22 and 28.

The connection of those lines is better viewed in the top view of FIG. 3 to which reference is again briefly made. As shown, like guy lines 42 connect between adjacent four member fittings throughout the truss. Returning to FIG. 7, like guy lines are connected between adjacent four member fittings throughout the truss's basic frame on the rear or lower end of the truss's basic frame, such as guy lines 44 and 44*b* connected to fitting 24 and other like fittings not visible in the figure. Guy lines 44 and 44*b* are also visible in the top view of FIG. 3. It is recalled that the four member fittings on the front of the truss are angularly staggered with those like fittings on the truss rear. Hence, the pattern of cris-crossing lines 42 and 44 obtains. The foregoing guy lines also add structural stability to the truss. It is appreciated that, as an alternative, guy lines 42 and 44 may instead be connected or anchored between adjacent eight member fittings.

The foregoing describes the basic frame structure to the perimeter truss structure. Each bay in that basic frame structure is a mirror image of the adjacent bay to the left or the right. This pattern is found throughout the foregoing truss structure. Consequently, the number of bays defining the truss is an even number, twenty in the illustrated embodiment. Considered apart from the other elements of the embodiment, the basic frame structure is seen to be of novel structure. The preferred embodiment of the invention builds upon that basic frame structure by incorporating the deployable spars 35 and 37 and related tension elements next described.

Continuing with FIG. 7, structural member 35, extending upwardly and outwardly, and member 37, extending downwardly and outwardly, are referred to, respectively, as an upper extension or deployable spar and a lower extension or deployable spar. An end of each spar is pivotally attached to a respective fitting 18 and 22 at the respective upper and lower end of an associated vertical strut 17, such as by a clevis joint or hinge at the fitting, later herein more fully described and illustrated in connection with the enlarged views of those fittings in FIGS. 8–12, some or all of which may be spring loaded.

The pivotal connection permits the spars to be stowed in a position, either up or down, alongside the vertical strut.

The tip or distal end of spar 35 contains a fitting 46, and the distal end of lower spar 37 contains a fitting 47. The spar end fittings connect to the guy lines and hoop lines, such as 38, 43 and 45, and 40 and 49, later herein more fully described.

A like pair of such deployable spars, 35*b* and 37*b*, and 35*c* and 37*c* are associated with each of the remaining vertical struts 17*b* and 17*c* in FIG. 6, and those spars contain respective end fittings 46*b* and 47*c*, and 46*c* and 47*c*. Six such deployable spars are illustrated in total bordering the two bays illustrated.

Support elements 38, 39, 40 and 41 are additional guy lines, inextensible tension members, and are shown in the left bay 12. Members 38*b*, 39*b*, 40*b*, and 41*b* are like guy lines, included in the center bay 14 in the figure. Each of those guy lines is attached at one end to the outer end of a deployable spar, 35 and 37, respectively, as example in the left bay, and to the two member fitting 30, located at the apex of the formed triangle, formed by triangle spars 27 and 29. Guy lines 39 and 41 extend respectively from the ends of the deployable spars 35*b* and 37*b*, respectively, which are in common to bays 12 and 14, to two member fitting 30 to the left; and guy wires 38*b* and 40*b*, extend from those same respective deployable spars to two member fitting 30*b* located in bay 14. These guy lines provide lateral stability of the outer end of the associated deployable spar.

For example, guy lines 39 and 38*b* stabilize spar 35*b*, common to the bays 12 and 14, in the lateral direction. A force at the end of spar 35*b*, applied perpendicular to the plane of the paper, such as by a catenary line 7, not illustrated in the figure, is resisted by guy lines 39 and 38*b* and the two formed triangles, members 23, 27 and 29 forming one, and members 23*b*, 27*b*, and 29*b* forming the other, to which the latter guy lines are connected. Considering next the lower deployable spar 37*b* that is also common to bays 12 and 14. A force at the end of spar 37*b*, applied perpendicular to the plane of the paper, such as by a lower catenary 9, not illustrated in the figure, is resisted by guy lines 41 and 40*b* and the associated formed triangles to which those two guy lines are connected.

All deployable spars ultimately attain the same angular orientation in the truss when deployed. During deployment, the guy lines extending from fitting 30, such as guy lines 41 and 40*b*, pull the spars, such as spar 37*b*, out of the deployed position and ultimately position the spar. When the spar rotates, it creates a pull on those hoop lines, assisting to pull the other elements from the stowed position.

As brief reference to FIG. 2 generally illustrates, other guy lines, corresponding to guy lines 39 and 41, attach to spars 35 and 37, extending to the left in the immediately adjacent bay to the left of bay 12. Likewise other guy lines corresponding to lines 38*b* and 40*b* connect, respectively to the outer ends of spars 35*c* and 37*c* and extend to the right in the immediately adjacent bay to the right of bay 14.

Structural element 45 is referred to as the upper hoop line. It is formed of a series of short inextensible tensile members arranged end to end, extending taut, similar to the center hoop line, about the upper end of the truss joined to the distal ends, more particularly the spar end fitting 46, of the deployable spar. The upper hoop member essentially ties or unites the ends of the spars and thereby restrains growth, dimensional instability, in the radial direction. As later herein discussed, this element works in conjunction with a guy line 43 to positively locate the outer end of the upper spars. For convenience in this description all like members of that upper hoop line are designated by the number 45.

Structural element 49 is a corresponding lower hoop line. This element is also formed of a series of short inextensible tensile members arranged end to end about the lower end of the truss joined to the end fitting 47 of the lower deployable spar. Like the upper hoop member, the lower hoop member essentially ties or unites the ends of the spars and thereby restrains growth, dimensional instability, in the radial direction, and aids in positively locating the outer ends of the lower spars. For convenience in this description all like members of that line are designated by the number 49.

Structural element 43 in FIG. 7 is also a guy line that attaches to the outer or distal end of the upper deployable spar 35 at end fitting 46 and extends taut and attaches to the outer or distal end fitting 47 of the lower deployable spar 37. Guy line 43 acts in opposition to perimeter cord 25, provides positive positioning of the outer end of spar 35. Tension forces from the catenaries exerted on the ends of the deployable spars is reacted by the tensile force transferred through the guy line 43 and through compression at spars 35 and 37 and compression of vertical strut 17. The other members provide stability and increase the stiffness of the structure. A like guy line 43*b* extends between fittings 46*b* and 47*b* at the ends of spars 35*b* and 37*b*, which is directly positioned in front of the spars in the view of FIG. 6. Another such guy line 43*c* is shown to the right. As reference to the side view of FIG. 4, such a guy line extends between the ends of all of the deployable spars.

One skilled in the art will appreciate that there exists other combinations of guy lines that will provide stability and react loads. The aforementioned arrangement is the current best mode embodiment.

Stowage Retention.

Reference is again made to the enlarged end view of the stowed perimeter truss in FIG. 6. The stowed barrel configuration is held together at each end by a tying device. That tying device is formed by hook shaped members formed on an eight member fitting, such as fitting 20, and a relatively stiff wire loop or cable 15, which connects into those hook shape members and serves as the tie. Cable 15 loops about the periphery and then across the cylindrical opening. Its ends are crimped together over the end. The ties are released by cutting as later herein discussed in connection with the deployment of the truss.

The fittings.

As earlier generally described the ends of tubular frame members are coupled together by fittings, connecting devices, whose function in the foldable structure was briefly described. The fitting incorporates within its structure any necessary joint structure, such as pivots for selected truss members. The four types of fittings used in the preferred embodiment were referred to as a four member fitting, an eight member fitting, a two member fitting and a spar end fitting.

In assigning names to those fittings the convention chosen is to refer to the number of tubular structural members that were coupled connected to the fitting and ignore any guy lines that were also coupled or otherwise attached to the respective fitting. An examination of those fittings may assist in understanding the deployment operation, later herein described. Illustrations of those fittings are presented in FIGS. 8 through 13.

Four Member Fitting. Consider first the four member fitting 24 illustrated in the deployed condition in FIG. 8 to which reference is made. As earlier noted this fitting is the same structure as fittings 18 and 26 identified in the truss side view of FIG. 4, but is inverted in relative position. In this figure, fitting 24 is viewed from the opposite side illustrated in FIG. 4. The figure also includes partial illustrations of the truss members attached to that fitting, identified by the same numerical designations earlier given the respective members in FIG. 4, including a portion of a vertical strut 17*b*, lower horizontal longerons 21 and 21*b*, and lower deployable spar 37*b*, all of which are hollow tubular members.

The fitting contains a J-shaped bracket 50 that is attached to the end of vertical strut 17*b*. Spar 37*b* attaches to a spring biased pivot joint or clevis in the fitting. The pivot joint is of a conventional structure. It includes U-shaped pivot arm 51 and pivot pin 52 arrangement attached to a pair of spaced extending arms 53 formed in bracket 50. A torsion spring 54 biases spar 37*b* to swing away from the stowed position. Spring 54 assists in ensuring appropriate actuation of the deployment mechanism, later herein discussed in greater detail. The ends of the deployable spars, such as spar 37*b* are connected to various guy line and hoop lines, as was illustrated in FIG. 4.

Horizontal longerons 21 and 21*b* are each connected to the fitting by respective pivot joints formed in the U-shaped region of bracket 50 with rectangular blocks 54 and 54*b*, and respective pins 55 and 55*b*. An end of horizontal longeron 21 connects to block 54 and pivots therewith, and an end of horizontal longeron 21*b* connects to the other block 54*b* and pivots therewith. As shown, the horizontal longerons pivot along an axis that is orthogonal to the axis of pivot of deployable spar 37*b*.

Moreover, as an additional feature to the invention, synchronizing gears 56 and 56*b* are attached, respectively, to the end of blocks 54 and 54*b* for pivotal movement therewith. The gears mesh together, linking the two pivot joints. When stowed, longerons 21 and 21*b* are folded up alongside strut 17*b*. They rotate from that stowed position upon deployment to the position illustrated. The synchronizing gears ensure that both longerons 21 and 21*b* rotate the same angular distance from the stowed position and make that movement in synchronism with one another, a feature which ensures correct deployment. Truss stabilizing guy wires 44 and 44*b* are anchored or otherwise secured to blocks 54 and 54*b*.

Figure 9:
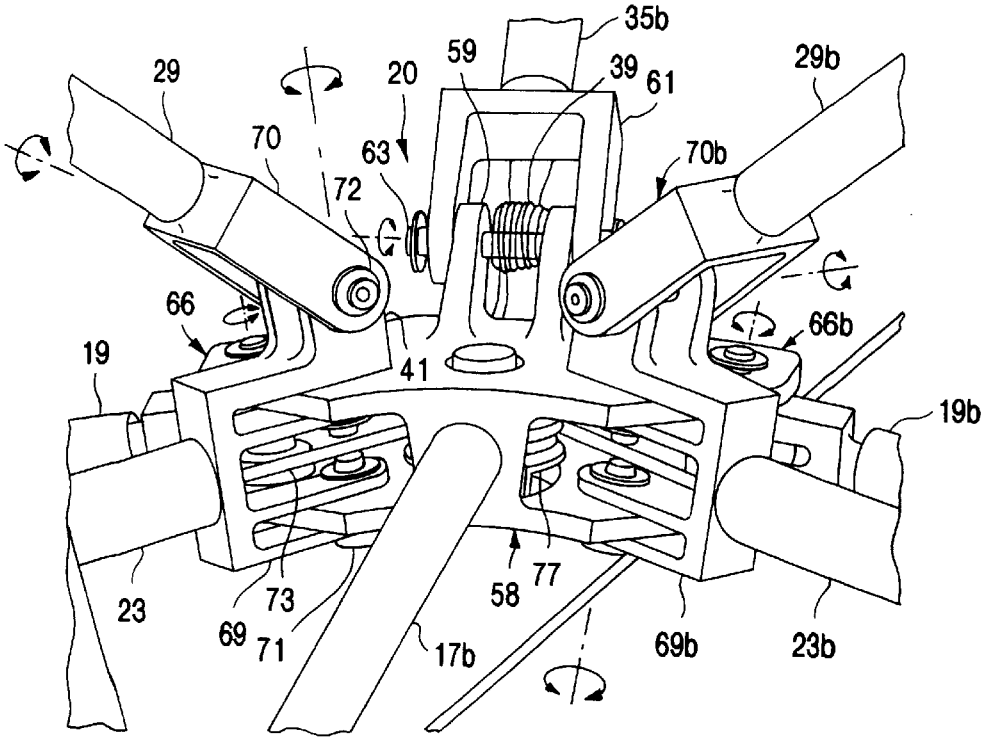
FIG. 9 is a perspective view of one of an eight member fitting used in the truss of FIGS. 1–4.

Eight Member Fitting. The eight member fitting 20 is presented in three different perspective views, a front perspective in FIG. 9, a bottom perspective in FIG. 10, inverting the view of FIG. 9, and a rear view in FIG. 11. It is recalled that fitting 20 is common to both bays 12 and 14 and connects to structural members in both those bays. Portions of the structural members connected to that fitting are also illustrated in the following figures, identified by the same numerical designations earlier given the respective members in FIG. 4. Referring first to FIG. 9, each of the hollow tubular truss members, vertical strut 17*b*, hoop longerons 19 and 19*b*, telescoping diagonals 23 and 23*b*, upper deployable spar 35*b*, and triangle members 29 and 29*b* are shown to converge at fitting 20. Preferably, the axes of all such tubular members ideally converge to a single point or apex in the fitting 20 or a common location beyond that fitting.

The fitting contains a central member or base 58 containing a number of pivot joints. A spring biased pivot joint or clevis is formed from a pair of spaced pivot arms 59 extending from the base, a complementary U-shaped member 61 and a pivot pin 63 that extends through the two members connecting the U-shaped member to the arms for pivotal movement. The pivot joint is also spring biased by torsion spring 39, which urges the spar to rotate from its stowed position. The proximal end of deployable spar 35*b* is attached to the bottom of the U-shaped member 61. A torsion spring 62 is located on the pivot pin. As with the four member fitting 17*b* earlier described, the spring 62 biases the associated deployable spar for movement from the stowed position and also enhances truss deployment as later herein described in connection with the deployment procedure.

The pivotal movement of the deployable spars on these fittings, such as spar 35*b*, may also be limited as a precaution from moving too far beyond the desired set position. Reference is made to the view of the fitting in FIG. 11. A pin 64 carried on the side of U-member 61 projects internally, not visible in this view, joint and pivots along with spar 35*b*. At the fully deployed position of the spar, pin 64 engages a stop, not illustrated, formed in the central member 58, overlying the hook shaped members 79, thereby limiting the degree of angular movement to a predetermined angle. However, the foregoing stop is optional and is less preferred as it could create mechanical moments. Instead, the angle to which the spars are set is determined by the tension lines that balance the spars against the force of the connected catenary line.

Returning to FIG. 9 two additional pivot joints 66 and 66*b* of substantially identical structure are partially visible on the rear left and right sides, associated respectively with horizontal longerons 19 and 17*b*. The structure of the latter joints is more fully illustrated in FIG. 11, to which reference is again made. Pivot joint 66 is formed of a U-shaped portion within the hollow of central member 58. The joint contains a pivotal member 68 that contains a pin passage. Pivot pin 69 extends through the U shaped walls and the passage in pivotal member 68, anchoring the pivotal member in the joint and permits pivotal movement of that member. Horizontal longeron 19 is attached to pivotal member 68 and pivots therewith. The companion pivot joint 66*b*, not fully visible in FIGS. 9–11, associated with longeron 19*b* is of like structure and need not be further described. The latter pivot joints permit pivotal movement in a direction orthogonal to that permitted by pivot joint 61.

Continuing with FIG. 9, telescoping diagonals 23 and 23*b* connect to respective pivot joints 69 and 69*b* on the fitting, respectively, located to the right and left sides of vertical spar 17*b*. Each such pivot is formed by two pair of U-shaped arms on one pivot member 69, somewhat resembling a pitchfork blade. Each pair of such extending arms fits over a respective one of a pair of flange portions of the fitting's central member and separate pivot pins 71, only one of which is labeled, pivotally attach each pair of the joint's arms to the associated upper or lower flange portion. The pivot pins are coaxially aligned. Pivot 69*b* is identical in structure and need not be further described. The pivots permit relative swivelling movement of the respective structural members 23 and 23*b*. The dual arm and dual pin structure of pivot joints 69 and 69*b* permits the central region of the pivot to remain unobstructed, permitting cord 73, later herein described, to extend through that interior region.

Each pivot joint 69 and 69*b* supports another pivot joint, pivots 70 and 70*b*, respectively, of identical structure. Each of these pivot joints is also a familiar clevis type. Each is formed of a U-shaped member 70, mounted to a pair of pivot support arms protruding from supporting pivot member 69 with a pivot pin 72. The latter joints pivotally connect to the ends of triangle struts 29 and 29*b*, respectively. Thus although the triangle struts 29 and/or 29*b* may pivot, they also pivot the pivot joints 69 and 69*b*, respectively, to the same extent. The joint structure ensures that those struts are always aligned with the associated telescoping diagonal 23 and 23*b*, respectively, the latter of which serves as the base of a formed triangle as earlier described in connection with FIGS. 4.

Figure 11:
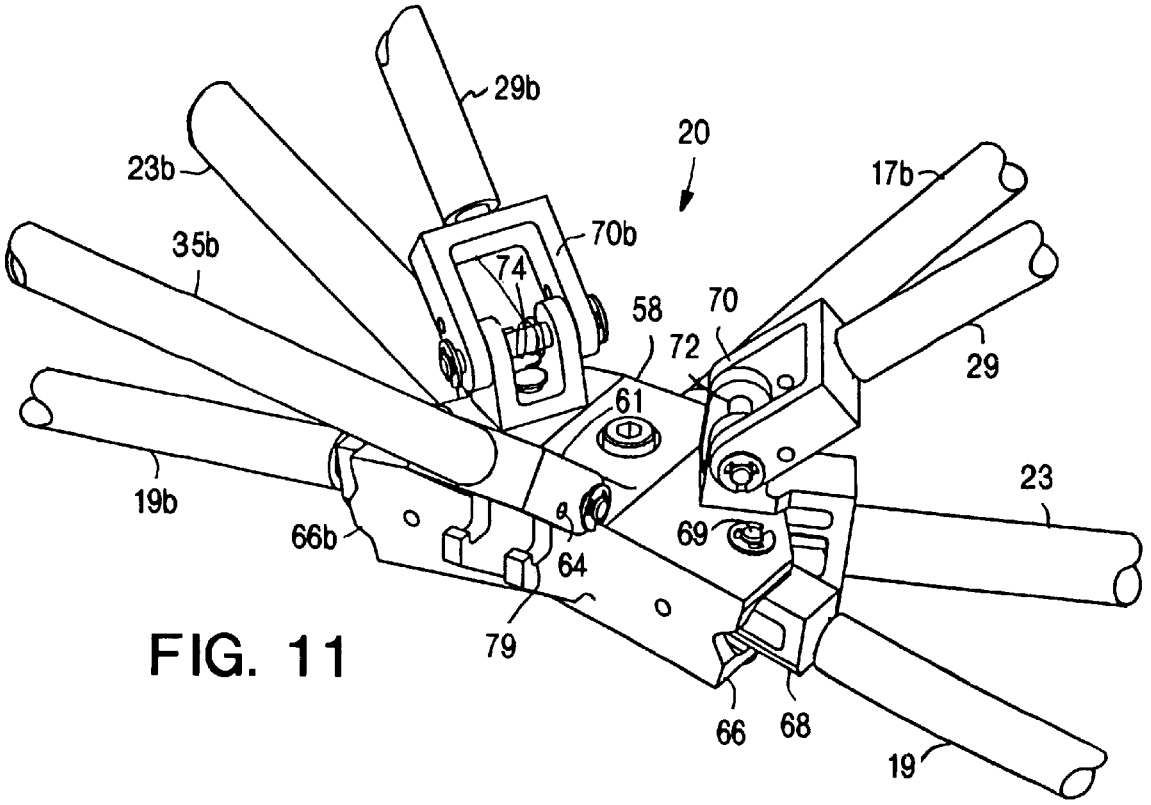

Pivot joints 70 and 70*b* are also spring biased by a torsion spring, not visible in this view, one of which, 74, is visible in FIG. 11. Those springs, which are optional, like those earlier described for the deployable spars provide a bias that aids in unfolding the truss from the stowed condition.

Figure 10:
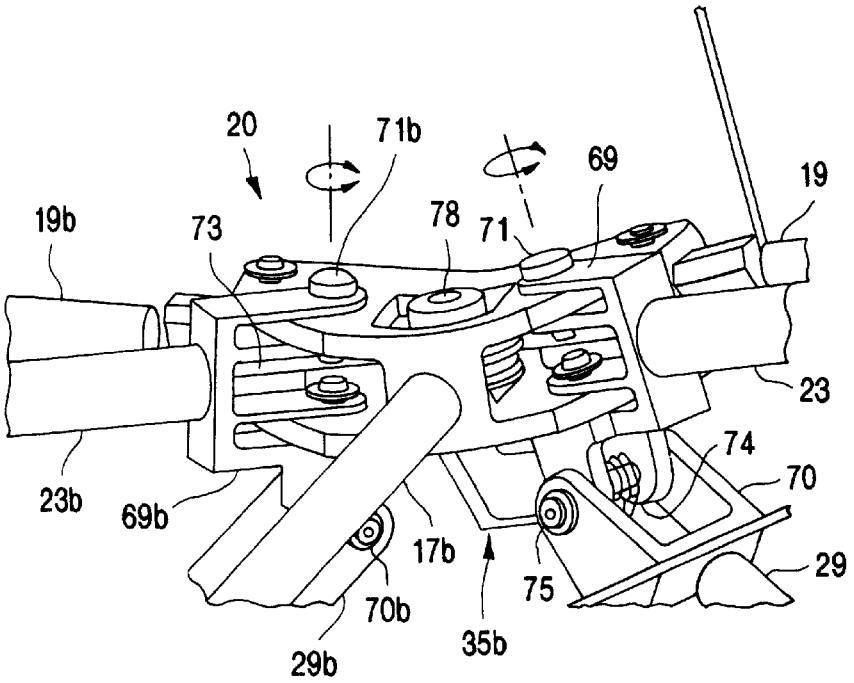
FIGS. 10 and 11 are additional perspective views of the fitting of FIG. 8, as viewed from different angles.

The eight member fitting contains additional components to serve other functions than holding the structural members. Brief reference was earlier made to cord 73. As best shown in FIGS. 9 and 10, fitting 20 includes an internal region that internally houses a pulley 77. The pulley is mounted by a pin 78 for rotation about an axis orthogonal to the axis of vertical spar 17*b*. Cord 73 extends through the hollow tubular telescoping diagonal 23, wraps around pulley 77, and extends through telescoping diagonal 23*b*. The cord and pulley form a portion of the deployment mechanism, which is described in greater detail later herein in connection with FIGS. 18 and 19. It is noted that cord 73 extends through all of the telescoping diagonals in the truss and through each of the like eight member fittings, engaging the pulley in each such fitting. The cord is inserted through and enters the truss and also exits the truss through a selected one of the eight member fittings.

Fitting 20 also includes a pair of integrally formed hooks 79 that serves as a part of the tying device that holds the perimeter truss in the stowed condition. Its purpose was earlier described in connection with FIG. 6, and need not be repeated.

Figure 12:
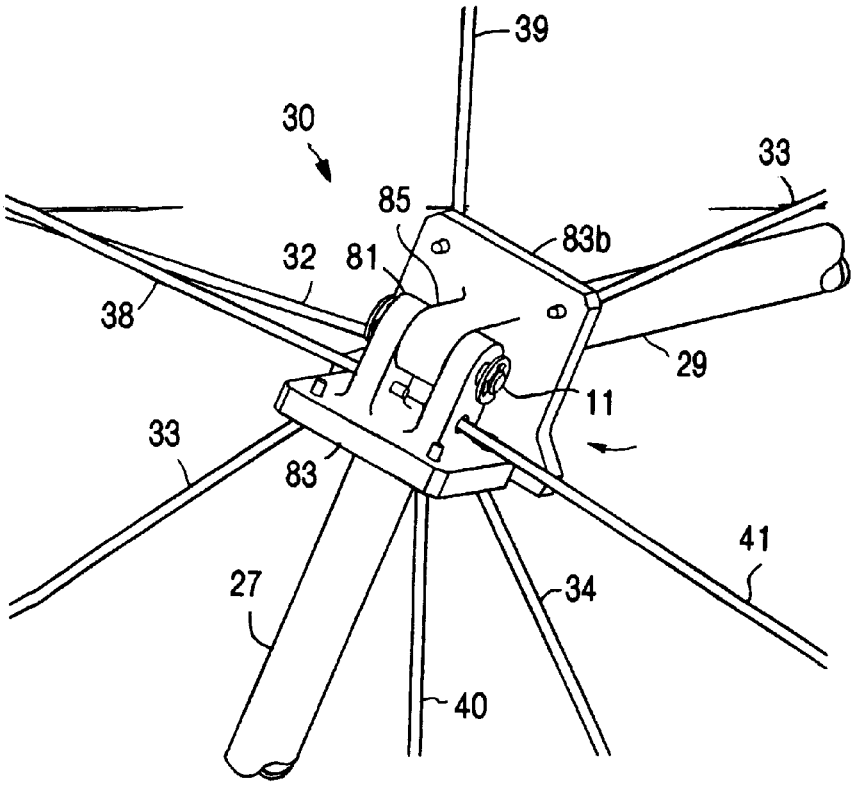
FIG. 12 is a perspective view of a two member fitting used in the truss of FIGS. 1–4.

Two Member Fitting. Reference is made to FIG. 12, illustrating two member fitting 30 in perspective as deployed. The fitting forms the apex, earlier referred to, of triangle members, such as triangle members 27 and 29. The figure also includes portions of the truss structural members and elements earlier identified that are connected to that fitting, designated by the same numbers given in FIG. 4. These include, rigid hollow tubular triangle members 27 and 29, the mid hoop lines 33, triangle support guy wires 32 and 34 and guy wires 38, 39, 40 and 41.

Fitting 30 includes a pivot joint, formed of a pair of arms 81 protruding from a base or flange 83. The arms engage therebetween a finger 85 protruding from the complementary pivot member. And a pivot pin 87 extends through passages in both the arms and fingers, and is clipped in place, to complete the pivot joint. This type of joint is also called a clevis fitting, which consists of a single extension from half of the fitting which is held between two similar extensions on the other half, connected together with a pin, thereby permitting rotation. Each portion of the joint is attached to an end of a respective triangle member 27 and 29.

The pivot joint includes a built in limit formed between the far edge of flange portion 83 and the flat surface of flange portion 83*b*, which may be used to limit relative rotation between the two triangle arms 27 and 29 to a fixed amount in the preferred embodiment, rotation is governed by the final length at the telescoping tube which forms the base of the triangle. An end of guy lines 33, 34, 38, 40 and 41 are secured to flange 83 and an end of guy lines 32, and 39 and the extension of hoop line 33 are secured to the other flange 83*b*.

Figure 13:
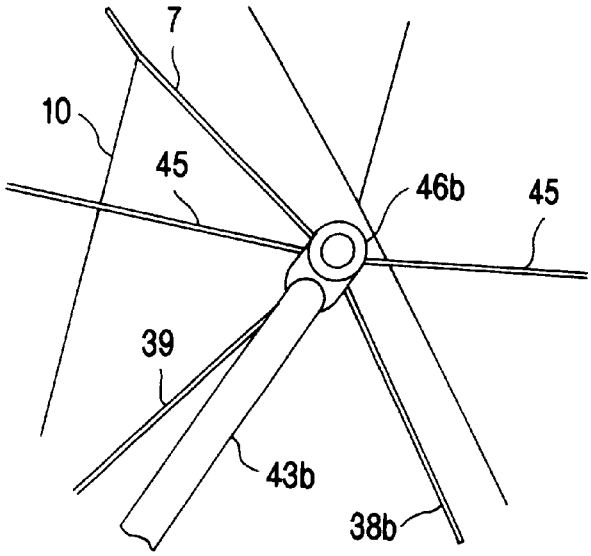
FIG. 13 is a perspective view of a spar end fitting used in the truss of FIGS. 1–4.

Spar End Fitting. Reference is next made to FIG. 13, which illustrates in isometric one of the spar end fittings 46*b* that is attached to the end of the deployable spars. As with the prior fitting illustrations, portions of the guy wires and catenary lines are included. As illustrated, the fitting is a short hollow tubular cylinder located at the outer end of deployable spar 43*b*, and is welded, friction fit, glued, screwed, bolted or otherwise attached by any conventional means appropriate for outer space application to the deployable spar. The various guy lines are attached to the fitting by any conventional means. In this embodiment the guy lines extend through passages in the cylindrical wall of the fitting and are clamped thereto or bonded. The upper hoop lines 45 extend through the fitting and are secured, and the end of catenary 7 is secured to the spar by an appropriate fastening device, such as one of the aforementioned kinds.

With the description of the fittings completed, it should be appreciated that the described fittings are representative of all of the other like fittings used in the truss. The other fittings are identical with a corresponding one of the forgoing four fittings. The orientation may change depending upon the fittings position in the truss. It is appreciated that the number of structural members and/or tension elements connected to a fitting, depends on the number of structural elements found within a particular truss structure, as becomes apparent from the discussion of the different truss structures illustrated and described later in this specification.

With the understanding of the perimeter truss's structural elements, members and fittings, gleaned from the foregoing description one may again re-visit and review the illustrations of the truss overall in FIGS. 2, 3 and 4 with greater perspective, prior to continuing with the description of the catenary system, the deployment mechanism, and the deployment, the unfolding the truss reflector from the stowed barrel configuration of FIG. 5 to the fully deployed condition of FIG. 1, which follow in this specification.

A distinguishing physical characteristic unique to the embodiment of FIG. 2 is that each bay in configuration is a mirror image of the adjacent bays. As seen in FIG. 7 to which reference is again made, the telescoping diagonals 23 in the left bay 12 extends from the lower left corner upwardly to the right, while in the next adjacent bay 14, the telescoping diagonal 23*b* extends from the upper left corner of the frame downwardly to the right, the mirror image.

The Catenary System.

Returning to FIG. 2, in this embodiment, all of the catenary lines 7 and 9 radiate radially outward from the center of the truss to its peripheral edge and essentially form a pair of suspension systems at the trusses front and rear ends. As illustrated, the upper catenaries, including catenary line 7, only one of which is numbered, extend from a ring-shaped juncture or hub 8 at the center of the truss to the outer end of an upper deployable spar, such as spar 35. The lower catenaries, which are radially aligned with the upper catenaries, including the lower catenary 9 associated with catenary 7, also extend from that center juncture to the outer end of an associated lower deployable spar, such as the end of spar 37 to which lower catenary 9 connects. It is appreciated that the number of front catenaries in the truss, thus, is equal to the number of bays in the truss.

Figure 14:
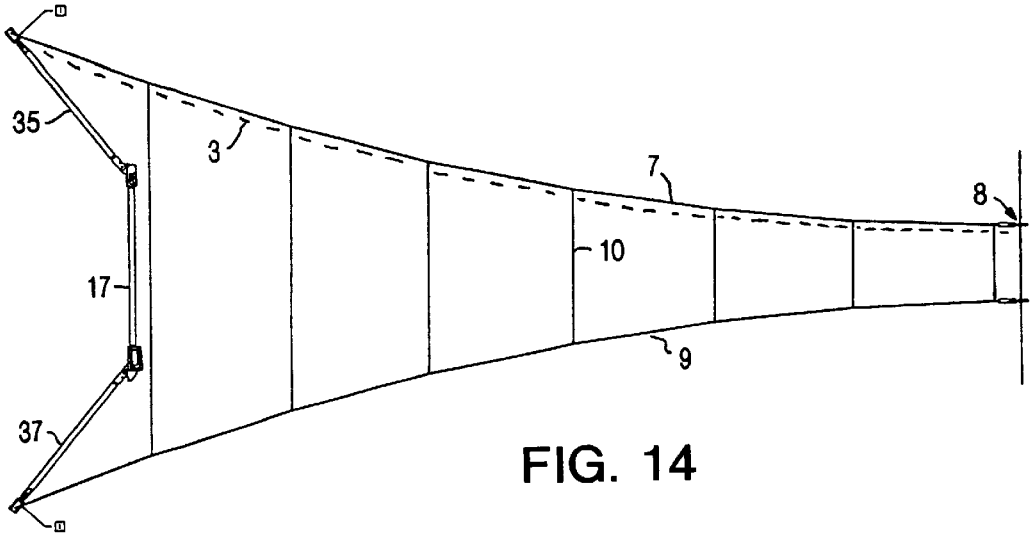
FIG. 14 is a side view of a portion of the novel catenary system used in the embodiment of FIGS. 1 and 2.

The catenary system is considered further in connection with FIG. 14 to which reference is made. The figure illustrates a side view of one pair 7 and 9 of the many pairs of catenary lines that are angularly spaced about the central hub 8, and the drop ties 10 associated with the pair of catenarys. As one recognizes, the number of pairs is equal to the number of deployable spars on the truss's front end. The figure also illustrates the position of reflective mesh 3, illustrated by dash lines, and the manner in which that mesh is shaped and supported.

As shown in the figure, each catenary line 7 and 9 extends from central hub 8 to the outer end of a respective deployable spar 35 and 37 at the respective front peripheral edge and rear peripheral edge of the truss. The connection to the spar may be made with a conventional tensioner, such as a threaded bolt and nut, not illustrated, to make it easier to pull the catenaries somewhat taut and/or tension all catenaries to the same degree. To shape the catenary 7 into an approximate curve, drop ties, such as 10, only one of which is numbered, of various predetermined lengths join various positions, radially spaced from hub 8, along the individual front catenaries 7 to like positions on the underlying lower catenaries 9. Those ties are fastened to the catenaries by any conventional fastening means, such as by a threaded fitting, not illustrated, attached to the end of the drop ties or bonding.

In alternative embodiments, the lower catenaries 9 may attached to a physically separate hub or ring, separate from hub 8. Such an arrangement is useful, as example, to maintain some space between the upper and lower surfaces at the center.

In the illustrated embodiment, seven drop ties are located between catenary 7 and catenary 9, essentially equally spaced from one another and hub 8. The same number of drop ties is used in each of the other such pairs of catenary lines in the truss. Since the opposing catenary lines are identical tension lines, each drop tie pulls the two tension lines toward one another with equal force. The shorter the length of the drop tie, the closer together the opposite catenaries are pulled. The greater the distance from the center of hub 8 to a particular drop tie, the greater the respective drop tie's length.

The lengths of the individual ties and their location along the respective catenary relative to the center or hub 8 is selected so that the pair of catenaries each approximate a parabolic curve. Knowing the size of the truss and the location at which to apply a tie, the length of the tie required to define the desired parabolic curve may be determined mathematically. Once the ties are completed on all of the catenaries, the resultant parabolic surface may be checked optically and any distortions in the surface can be adjusted by adjusting the appropriate tie or ties.

The number of ties used in a reflector is a compromise. It is appreciated that by increasing the number of ties, the curved surface formed with the catenaries can be made more smooth and, thus, more finely approximate a desired parabolic shape. However, increasing the number of ties also increases the overall reflector weight and requires greater labor, hence, expense, to manufacture. Since artistic purity is not the goal, the number of ties selected for inclusion is the minimum number necessary to achieve the requisite RF gain in the completed reflector.

Figure 15:
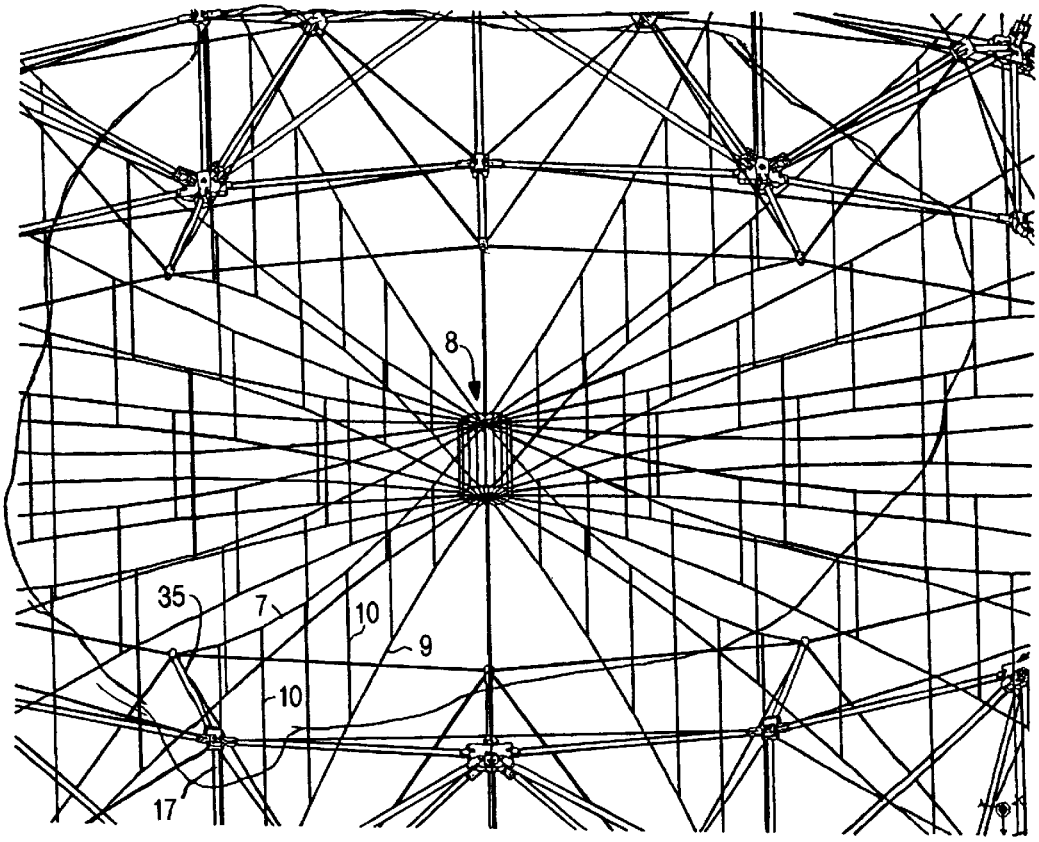
FIG. 15 is partial view of the central portion of the catenary system used in FIGS. 1 and 2.

Reference may be made to FIG. 15, which is an enlarged partial view of the catenary system presented in FIG. 1. This view again illustrates the angular spacing of the individual pairs of catenary lines about hub 8 and the general cylindrical configuration of that hub. It is appreciated that hub 8 is essentially suspended and held in place by the catenary lines within the interior of the truss essentially and is oriented essentially coaxial with the truss's principal axis. There is no other support for the hub.

One should appreciates that the catenary system shown in FIG. 15 does not require inclusion of any circumferentially extending catenary lines joined to and crossing over or under the radially extending catenary lines, reminiscent of the prior known catenary system crisscross lacing structure. By avoiding use of any circumferentially extending lines, the weight of the truss is minimized. Although use of such circumferential support lines is permissible, if not required, they are best not used. As those skilled in the art appreciate, the number of catenaries and, accordingly, their weight, is less than the catenaries employed in the crisscross lacing structure of the prior art, which is an advantage to the invention.

Figure 16:
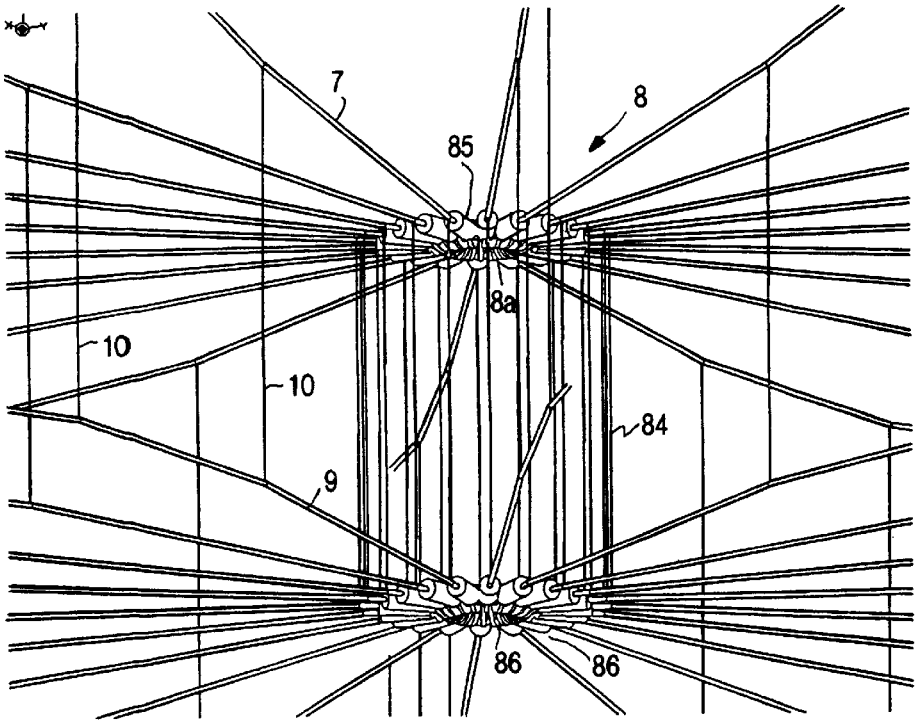
FIG. 16 is an enlarged isometric view of the central ring illustrated in FIG. 15.
Figure 17:
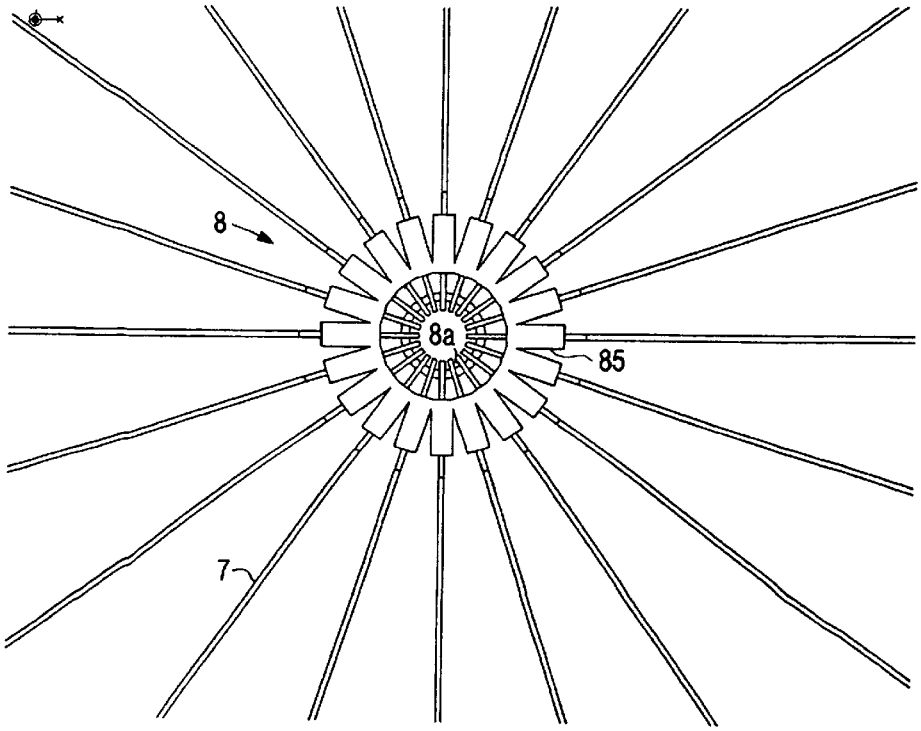
FIG. 17 is a top view of the central ring of FIG. 16.

FIG. 16 provides an even closer view of hub 8. The hub is formed of upper and lower rigid rings 8*a* and 8*b*, associated, respectively with the upper and lower catenary lines, 7 and 9, a strain relief member 85 and 86 for the respective catenary lines, and, defining the cylindrical side to the hub, tie lines 84, only one of which is numbered. Each of the tie lines is attached to a respective upper catenary line and the underlying lower catenary line associated therewith at the side of the respective strain relief members for the catenary lines. Each of the catenaries 7 extends through a passage in the spider-like strain relief member 85 and has an end portion wrapped about and bonded to ring 8*a*. An identical structure is used form the lower catenary 9 in the pair. A better view of the spider like strain relief member 85 is illustrated in the top view of hub 8 presented in FIG. 17. Other known forms of connecting to the ring or, indeed, other techniques for joining the ends of the catenaries at a central location as illustrated may be found which may serve as a satisfactory substitute in the combination without departing from the spirit or scope of the present invention.

Returning to FIG. 14, the catenary may be fabricated such that catenary tension line 9 is a mirror image of the front catenary tension line 7, each of which approximates a parabola in profile. In the preferred embodiment the catenary tension line 9 may be fabricated with a more shallow curve than the front catenary line 7. It should be appreciated that such an arrangement results in a shorter overall distance between the distal ends of deployable spars 35 and 37, thereby producing a more shallow frame than otherwise. The more shallow frame results in a shorter height for the perimeter truss reflector when in the stowed condition, such as earlier illustrated in FIG. 5.

To minimize distortion due to temperature variation, the preferred approach is to use near zero coefficient of temperature (CTE) materials for the catenary lines, drop ties and guy lines to minimize distortions in the catenary system and in the truss. Additionally, the symmetric geometry of truss and catenary assures uniform distribution of whatever small load changes that do occur.

Continuing with FIG. 14, the reflecting surface for the reflector is completed by covering the catenary bed with the reflective metal mesh surface 3. In this embodiment the mesh, illustrated in dash lines 3 in the figure, is located on the underside of the catenary bed formed by catenary lines 7 is covered. The preferred mounting is to place the mesh under the front catenaries and allow the mesh to press against those catenaries when the truss is deployed in outer space, the catenarys serving as a retaining barrier. This minimizes the need for additional attaching members, minimizing reflector weight, another advantage.

To mount the mesh in the foregoing way, the pliant reflective mesh 3 is spread out under the front catenaries 7, and the drop ties 10, earlier described, are threaded through the reflective mesh, prior to attachment to the opposite catenaries 9. The backside of the mesh naturally drapes and is pulled against the backside of front catenary lines 7, and is captured in place by the drop ties. The mesh is thus shaped by the front catenary into the parabolic shape.

Deployment mechanism.

When the reflector is to be deployed, the first step is to release the launch restraint system, earlier briefly described and illustrated in FIG. 6, and also briefly referenced in connection with fitting 20 in FIG. 11. Many launch restraint systems are known, including bolt cutters, cable cutters and separation nuts. The preferred launch restraint system for the foregoing embodiment is the cable cutter, that cuts the cable 15 in FIG. 6 constraining the top and bottom of the stowed barrel.

Figure 18:
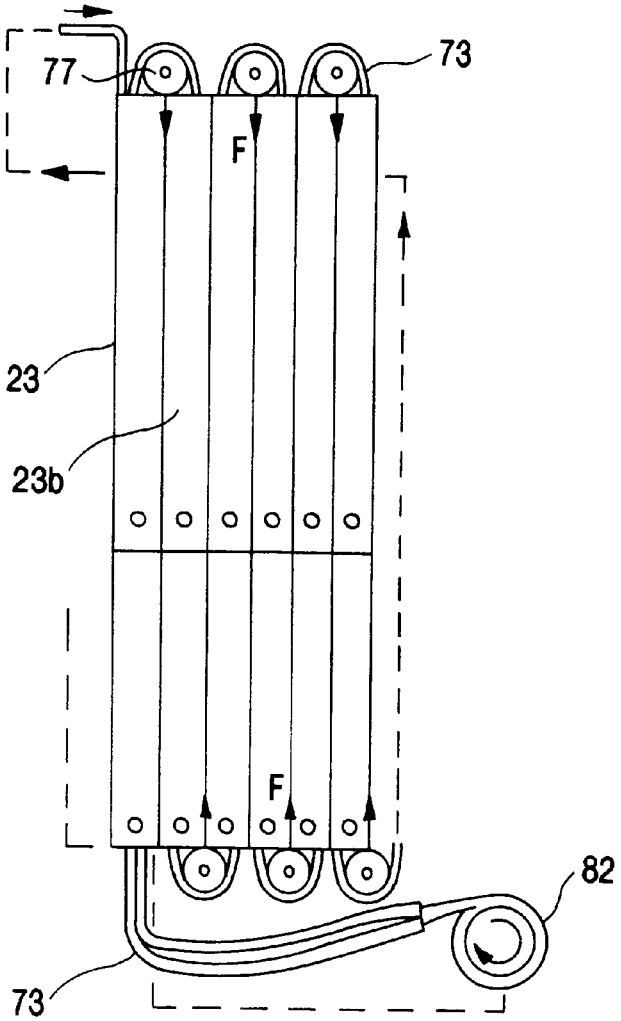
FIGS. 18 and 19 are pictorial illustrations of the deployment mechanism, partially illustrated in the earlier figures, showing its operation.
Figure 19:
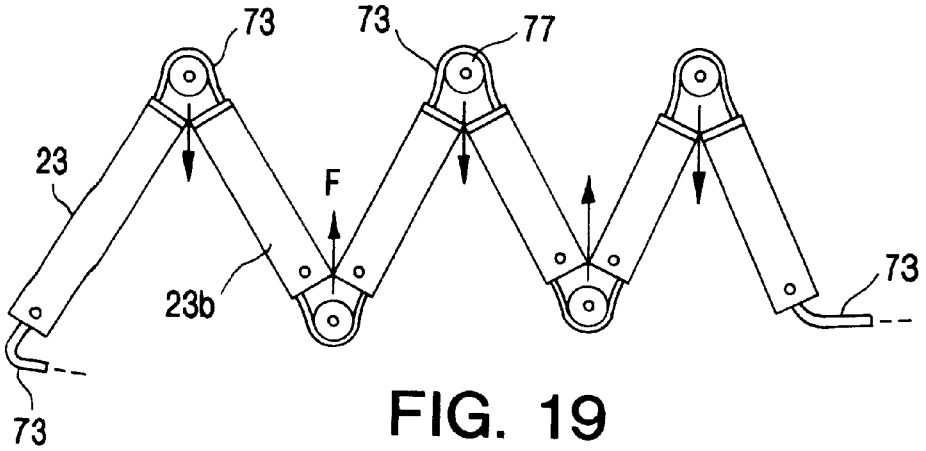

If small in diameter, theoretically the described truss may be carefully unfolded manually by hand in outer space, a very difficult procedure even on Earth. However, for large diameter trusses, unfolding by hand becomes impractical. As preferred, the foregoing embodiment contains a deployment mechanism, consisting of cords and pulleys and synchronizing gears, earlier briefly noted, that are built into the truss for automating the unfolding operation. Reference is made to FIGS. 18 and 19, which is a diagram of a cord and pulley arrangement incorporated into the truss.

Deployment is achieved with a cable deployment system. A single cable 73 is threaded through all of the telescoping diagonal members 23, 23*b*, and so on, in the truss and over the pulleys located in the associated eight member fittings, such as pulley 77, pictorially illustrated in FIG. 18. A more exact representation of the cable and pulley within a joint was earlier illustrated in FIGS. 9 and 10 to which brief reference may be made, which shows those elements in the eight member fitting 20.

Returning to FIG. 18, the two ends of the cable exit the reflector at a selected one of those eight member joints. When the cable is shortened, such as by pulling on either end or pulling on both ends simultaneously, a mechanical advantage is produced at each eight member joint 20, which biases or encourages the structural members 23' and 25' at each joint to straighten out.

This motion is pictorially illustrated in FIGS. 18 and 19. As shown the telescoping diagonals are at their greatest length in the stowed condition and accordingly, the length of cable through the members is greatest in this condition. When the cable is tightening and shortening, as represented in FIG. 19, it exerts force on the axle of the pulleys 77 in the eight member fittings. The force is in one direction on the fittings on the front of the truss, and in the opposite direction on the fittings on the rear end of the truss, the latter of which are staggered in position in relation to the former. The essentially squeezes the ends of the truss, forcing adjacent telescoping diagonals to spread apart centered at the fitting, pivoting relative to one another and forming into a zig-zag configuration about the periphery of the truss structure. As the length of the cord is shortened, it also pushes the ends of those telescoping diagonals toward one another, shortening those diagonals, ultimately shortening same to the desired length, whereupon the telescoping diagonal latches to the designed length. The cable 73 is tightened until the reflector is fully deployed and pre-tensioned as was illustrated in FIG. 1.

One preferred apparatus for taking up (and/or releasing) the deployment cable 73 is a motor drive, not illustrated, containing a reel for taking up (or paying out) the deployment cable. That apparatus is attached to the one of the eight member fittings from which the two ends of the deployment cable are selected to exit the truss and meet.

Figure 8:
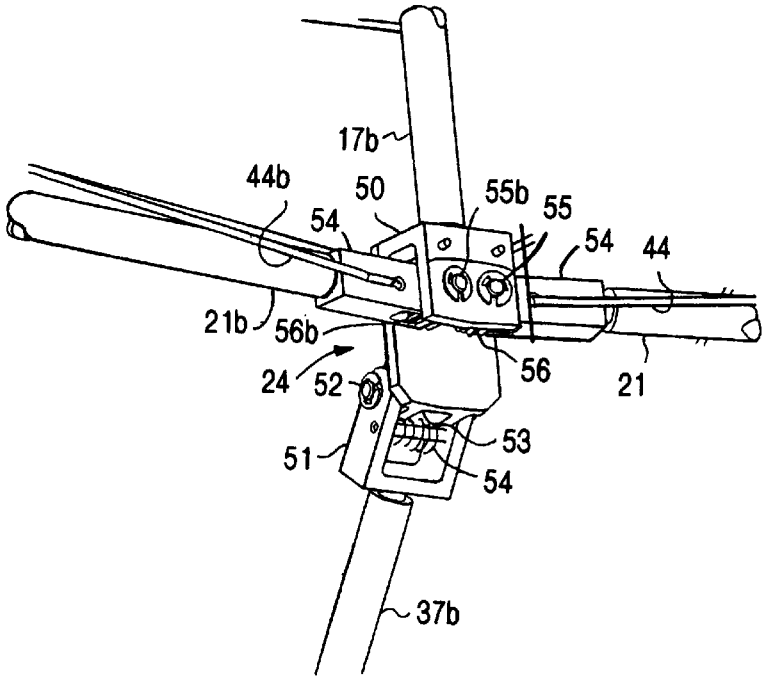
FIG. 8 is a perspective view of a four member fitting used in the truss of FIGS. 1–4.

As a preferred part of the foregoing deployment mechanism, gears or other like devices located in the eight member fitting, such as gears 56 and 56*b* in fitting 24 illustrated in FIG. 8, synchronize the movement of adjacent bays, ensuring that the entire truss deploys uniformly at the same rate. The engaged gears ensure that the longerons 21 and 21*b* deploy at the same angular rate and to the same angular extent.

Additionally, the deployment mechanism may include "kick off" springs to assist in moving the horizontal members off top dead center, which tightening of the deployment cable alone might be unable to do. Springs located in the clevis joints on the deploying spars, such as spring 74 in the joint 70*b* of FIGS. 9–11, and in the clevis joints for the horizontal members 19 and 19*b* bias the frame members for movement away from the stowed position. Springs may be added to additional pivot joints, as needed or as found desirable. When the launch system restraint is released, the horizontal members and spars accordingly move in response to the bias force. The mechanical advantage of the deployment cable system, earlier described, is lowest when the members are in the stowed condition. That mechanical advantage increases significantly as the reflector deploys. Thus, the springs aid deployment when the mechanical advantage of the deployment cable system is weakest.

Deployment.

The deployment of the truss is more easily understood by considering the unfolding of two of the truss bays, which is taken as representative of all the other bays.

Figure 20:
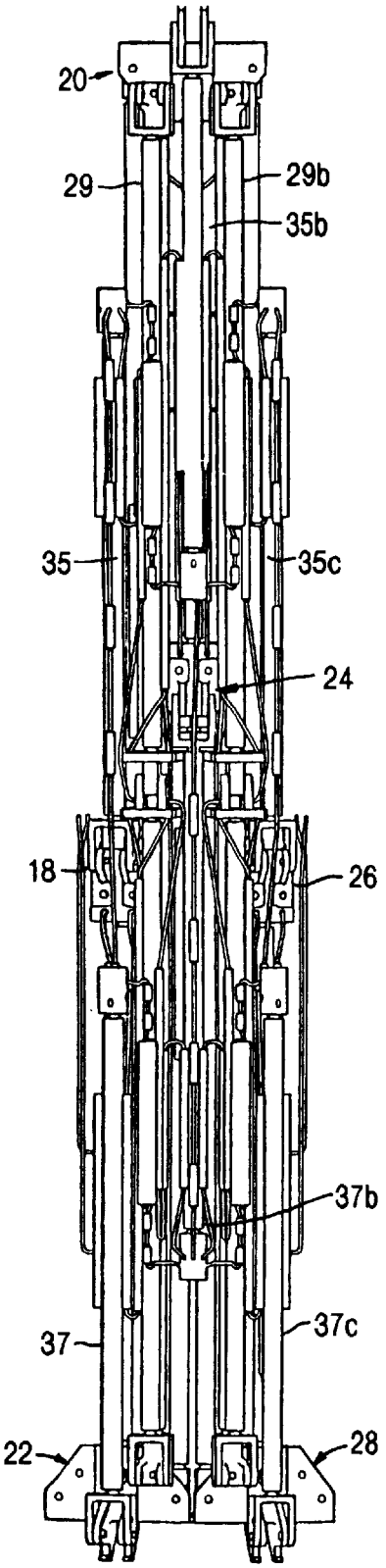
FIG. 20 is a side view of two bays of the truss of FIGS. 1–4 illustrated in the stowed condition and in greater scale than presented in FIG. 5.
Figure 21:
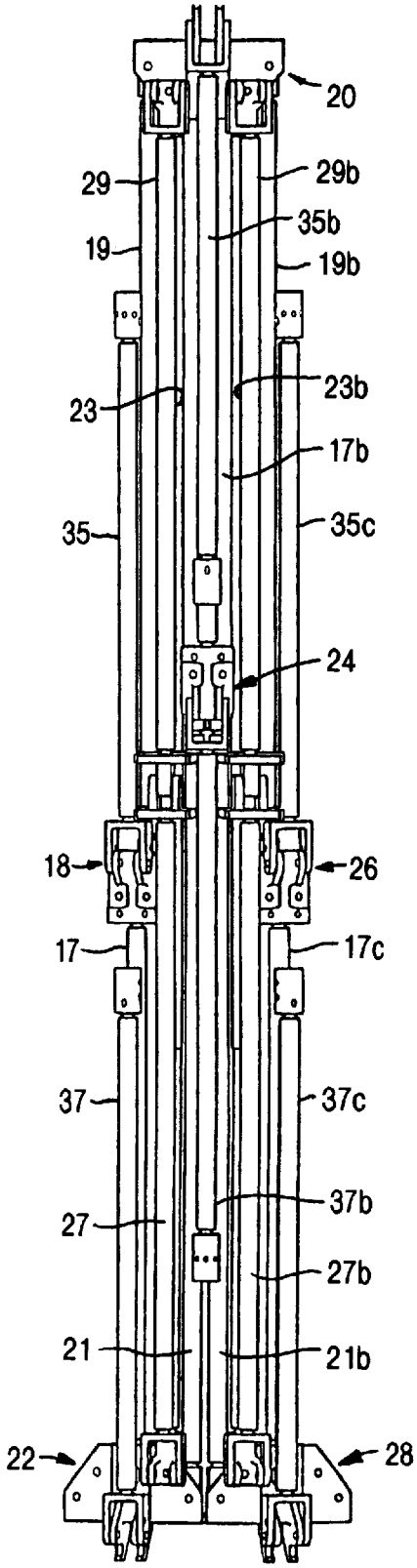
FIG. 21 is a view of the two bays of FIG. 20, illustrated with the guy wires removed to more clearly illustrate the relationship of the structural members.

FIG. 20 is a side view of two bays in the truss of FIG. 2, such as bays 12 and 14, in the stowed condition. FIG. 21 is the same side view as in FIG. 20 in which the hoop lines and the guy lines are omitted to provide a less complicated view of the structural elements unfolding. It is appreciated that those lines are simply dragged along with the motion of the structural members to which they are attached and tautened by them in the deployed condition. To aid in understanding many elements appearing in these and the following figures are assigned the same numbers designated for those elements in the prior figures.

Figure 22:
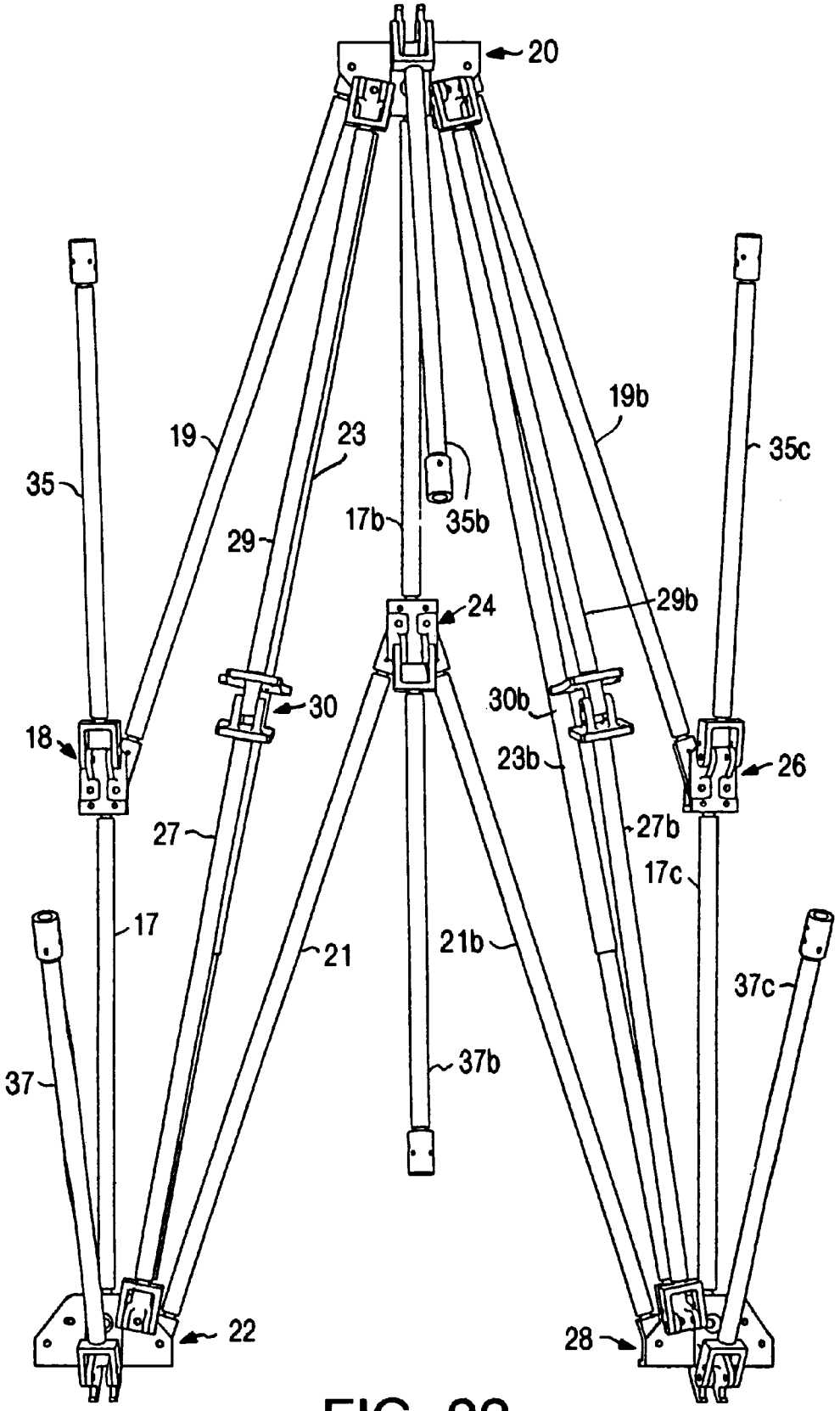
FIGS. 22, 23, 24 and 25 illustrate various stages in the structural movements of the two bay section of FIG. 21 between the undeployed or stowed condition and the deployed, illustrating the change in orientation undergone by the structural elements in unfolding and/or folding up.

FIGS. 22, and in slightly reduced scale, 23, 24, and 25 illustrate various serial stages of unfolding from the stowed position of FIG. 20. It should be recognized that where the same element appears in more than one figure and was previously described, the same numerical designation is used for that element throughout the separate figures.

The telescoping diagonals 23 and 23*b* pivot about eight member fitting 20 away from one another and the other members spread apart from the barrel as well. As shown in the stowed condition the upper and lower deployable spars were folded either upward or downward together, and those bordering the side of one bay, are folded in the opposite direction than those spars bordering the adjacent sides of the bay. Thus upper spars 35 and 35*c*, were folded up, and are being rotated down slightly, pulled by the guy wires, not illustrated, while the respective associated lower spars 37 and 37*c* were also folded up and, in being deployed are rotated down. Whereas the spars positioned intermediate the foregoing, namely spars 35*b* and 37*b*, were stowed pointing down, and are now being rotated upwardly for deployment.

Figure 23:
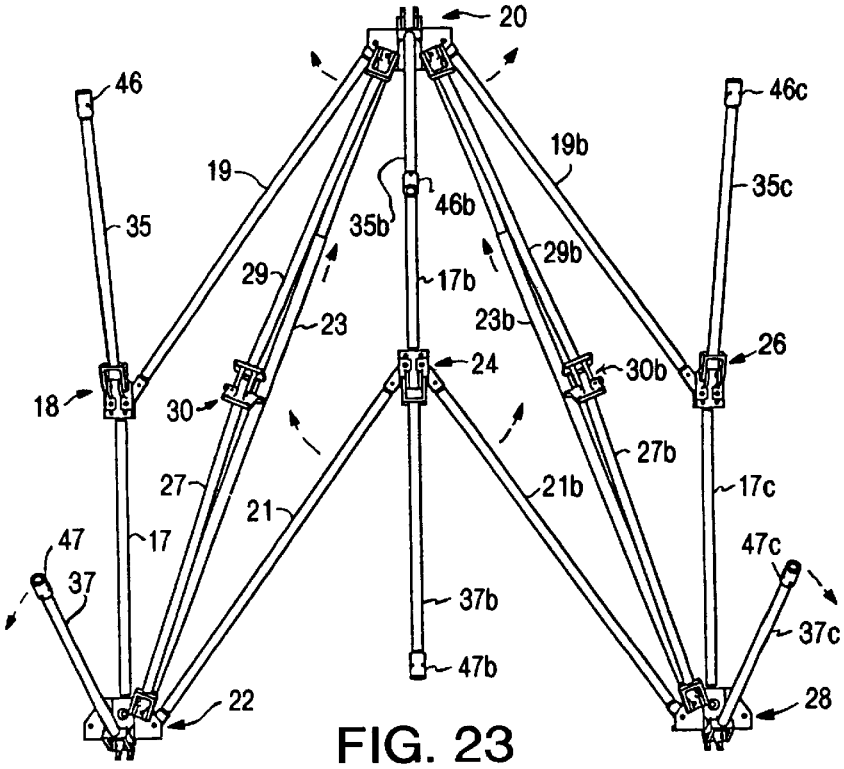
Figure 24:
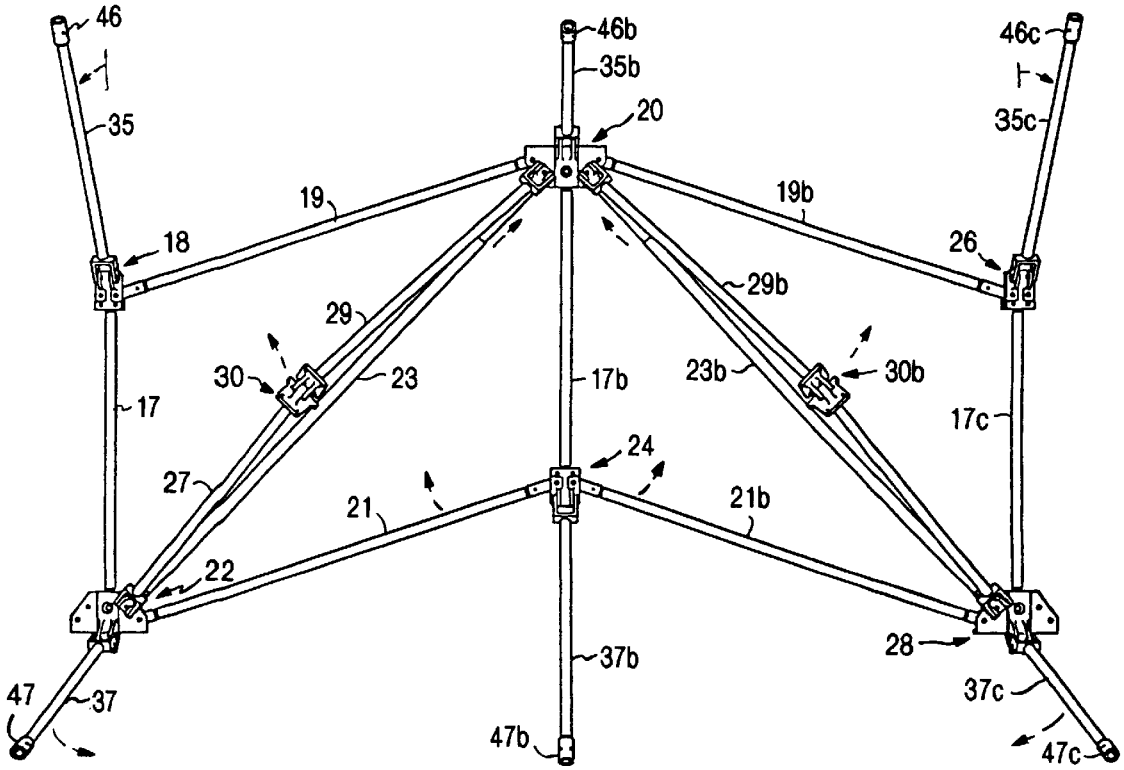
Figure 25:
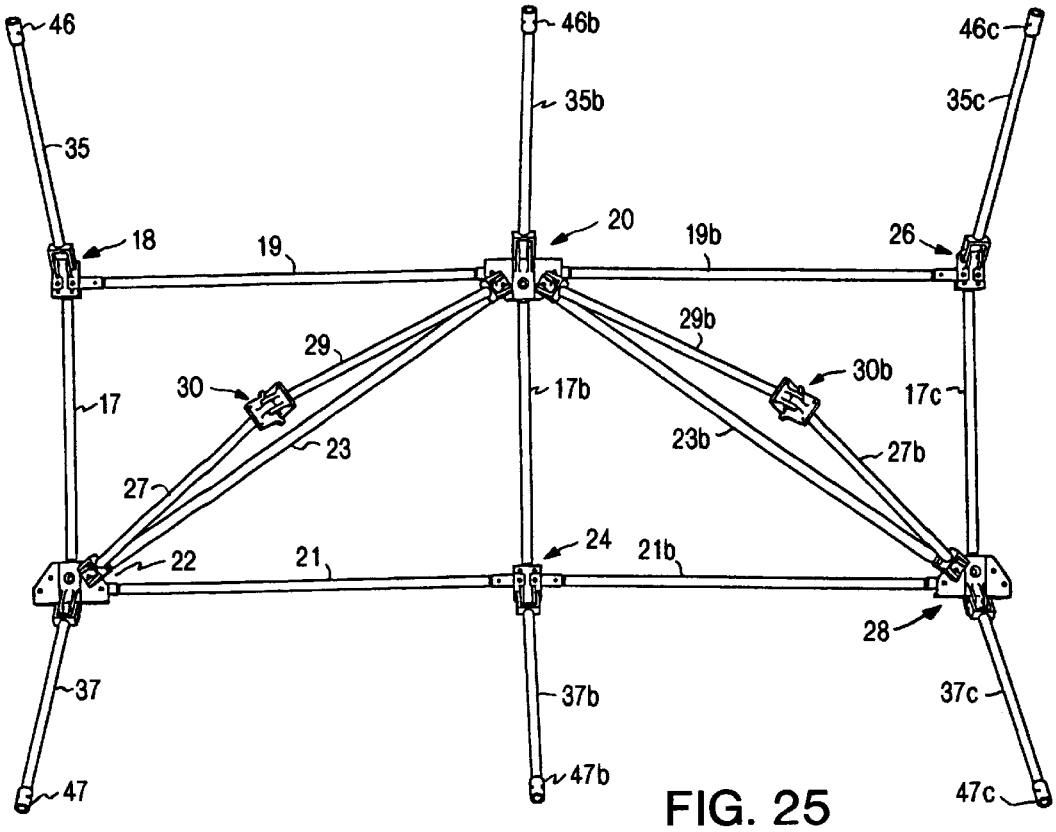

As the telescoping diagonals 23 and 23*b* are shortening as in FIGS. 23 and 24, they pivot longerons 21 and 21*b* outwardly, and force triangle members 27 and 29 to pivot about fitting 30 and move the fitting outwardly, forming the triangle. Longeron 21 and 21*b* are interconnected through the gearing arrangement at fitting 24, which synchronizes their movement. With the movement of fitting 30 to the triangle position, the guy lines, not illustrated, connected between fitting 30 and the deployable spars, pull the spars in one direction, while the catenary line attached to the respective spars pull in another. And the spars and the other members attain the fully deployed position as in FIG. 25.

While the foregoing deployment sequence of the truss elements is easily understood when individual bays are considered, as in the foregoing description, it is appreciated that the foregoing action occurs simultaneously in all of the bays in the truss overall. Thus not only are the widths of the bays expanding, but as a consequence, the circle or other geometry defined by the end of the cylindrical truss is widening. A more macroscopic view of that action appears in the pictorial illustration of the overall truss unfolding in FIG. 26 to which reference is made.

Figure 26:
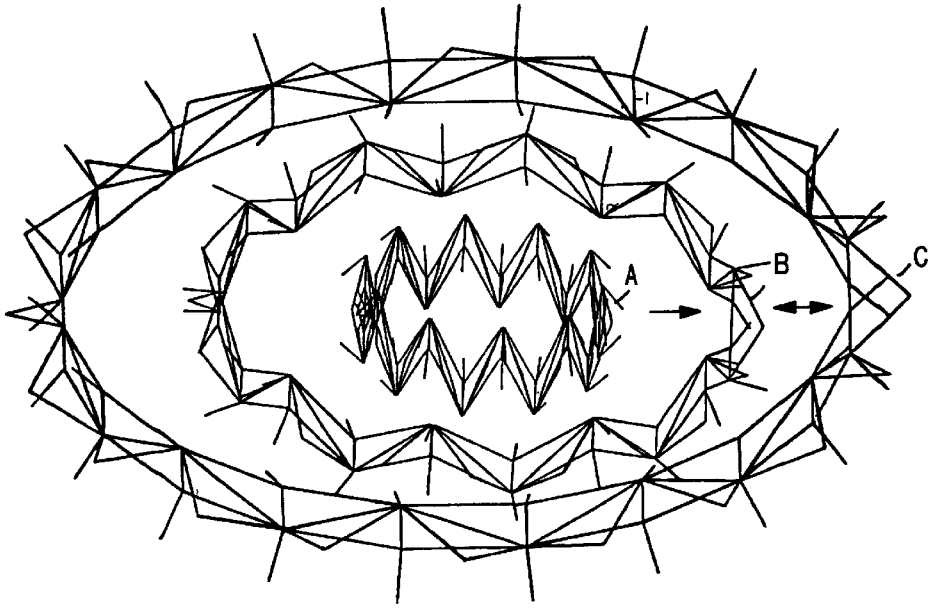
FIG. 26 is a pictorial illustration of the perimeter truss overall as it is being deployed.

For clarity of illustration, all guy lines, hoop lines and catenaries are omitted from FIG. 26. Moreover, the pliable reflective surface, which, in the completed reflector, covers the front end of the truss, is also omitted for clarity of illustration, it being understood that such component also unwraps and is shaped by the catenary system in the truss. As initially unfolded from the barrel configuration, earlier illustrated in FIG. 5, as it initially unfolds, truss 5 assumes a shape as illustrated at A. It then radially outwardly expands further to a degree as represented at B. Continuing to expand further to the fully deployed condition as the deployment mechanism functions, the truss now appears as at C in the figure, or, as was earlier illustrated in more complete detail, as in FIG. 2.

It may be noted that reverse action occurs in folding up the perimeter truss for stowage, but that is accomplished under gravity conditions in a manufacturing plant on the Earth under carefully controlled conditions with the manual assistance of manufacturing personnel.

The mechanical action to fold the foregoing elements is the opposite of that which occurs in unfolding, which need not be repeated. It should be borne in mind that in application in outer space, the truss is unfolded and remains unfolded throughout its operational life and thereafter. It is not intended to be re-stowable on orbit. There is no prospect of refolding the truss into the small package originally formed following manufacture. Thus one need not be concerned with how to transfer the procedure for folding up the truss and its associated reflector in outer space, an impractical prospect.

Cable Management.

It should be appreciated, that the guy lines attached to the structural members, such as spars 35 and 37, may be permitted to simply drape alongside the barrel figure, when the antenna is assembled into the stowed barrel configuration of FIG. 5 at the conclusion of the manufacturing process. Draping of those lines occurs due to the effect of gravity. However, in the low gravity environment of outer space, the lines will essentially float. As one further appreciates from consideration of the complex mechanical action occurring during unfolding of the structural members, illustrated in FIGS. 21 through 26, and which did not illustrate the guy lines, should the slack portions of the guy lines be floating about, there is a possibility that a guy line might catch or snag upon a structural member and prevent its movement into position or possibly result in damage to the member. To prevent that from occurring and as an added feature, the preferred embodiment includes a novel cable management system.

Figure 27:
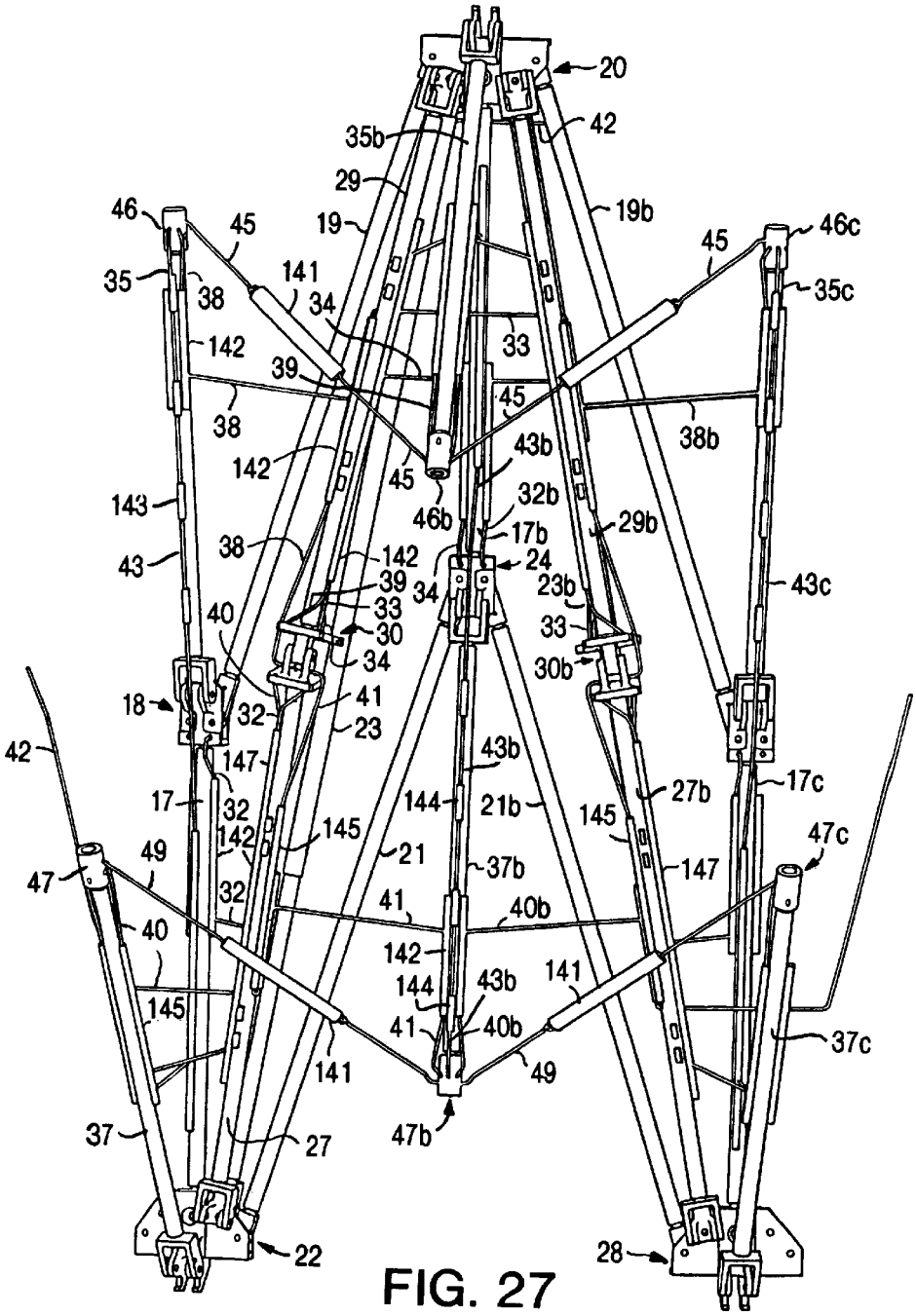
FIG. 27 is a side view of the two bays of the truss showing the two bays in the initial deployment stage earlier illustrated in FIG. 22, but including the guy lines and the novel cable management system.

Reference is made to FIG. 27, which illustrates bays 12 and 14 of the truss containing the guy lines and cable management devices. To assist in understanding the operation of the cable management feature, the two bays are presented in a stage of unfolding that corresponds to that earlier illustrated but without the guy lines in FIG. 22. The structural elements and guy lines having previously been identified in the prior figures, particularly in FIG. 7, are identified with the same number as before. However, in this figure a single guy line may be designated by number at more than one location in the figure to aid in understanding of the line's routing within the structure.

The additional components identified in this figure are cylinders, many of which are attached to a structural member, such as cylinders 142, 145, and 147, and other cylinders 141 that are suspended between member. Those cylinders form the cable management system. As example cylinder 142 is attached by epoxy bonding or other conventional attaching means to the side of deployable spar 35. Cylinder 141 is suspended by hoop line 45 between fitting 46 and fitting 46*b* at the ends of deployable upper spars. Not all of the cylinders included are identified by number, since the identified cylinders will be seen to be representative of all the others.

There is no slack in the guy lines and hoop lines. Those tension lines do not drape in the stowed condition either on land or in outer space. Instead the guy lines extend through and are at least partially packed inside those cylindrical members. They are pulled from the respective cylinders as the structural members move to the deployed position.

Figure 28A:
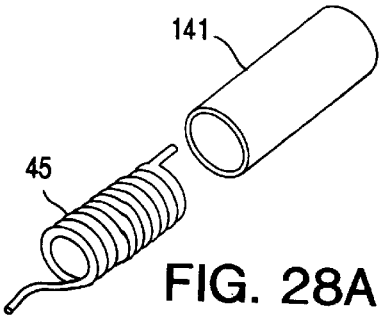

Reference is made to FIG. 28*a* which pictorially illustrates cylinder 141 and the guy wire in an exploded view. As shown the hoop line 45 is wound in a helix configuration and packed internally within the cylinder. The ends of hoop line are attached to the fittings at the ends of deployable spars 35 and 35*b* in FIG. 27. When the deployable spars are being deployed, they pull the ends of the guy line, which remove helical turns from within cylinder 141. Much like the familiar New Year's eve novelty paper streamer, the hoop line is withdrawn from the cylinder with virtually no resistance or restraint. Returning to FIG. 27, it is seen that the foregoing suspended cylinder arrangement is used for the upper hoop line 45 and the lower hoop line 49 that extend between each of the upper deployable spars 35 and lower deployable spars 37, respectively.

Referring again to the cylinder 142 located on the side of deployable spar 35, to the upper left in the figure, it is seen that guy line 38 extends from fitting 46 into and out of cylinder 142, crosses over to another cylinder 142 affixed to one of the triangle members 29 connected to fitting 20, and through the latter cylinder to fitting 30 to which it is attached.

Figure 28B:
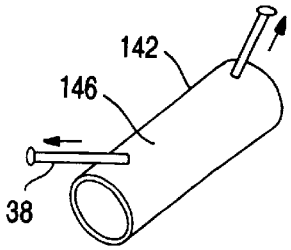

Reference is made to FIG. 28*b*, which pictorially illustrates this type of cylinder structure. As shown, the guy line is formed into a helix and installed within cylinder 142. The cylinder contains a longitudinally extending slit 146 in its cylindrical wall. The ends of the guy line exit the cylinder through that slit. Since the cylinder is constructed of flexible material, such as polyethylene, the edges of the slit apply a slight pressure on the guy line and better holds the guy line in place in the stowed condition. The slit also permits the guy line to be moved linearly along the length of the cylinder as may be required by the path of movement of the structural member. This prevents the guy line from snagging on the end of the cylinder. As the structural member deploys, guy line 38 is pulled from the cylinder.

Returning to FIG. 27, it is seen that slitted cylinders, such as cylinder 142, 145 and 147, appear affixed to many different structural members. They are also constructed in various lengths and diameters as necessitated by the length of cable and available mounting space. Those designated 142, 145 and 147 are of the same construction, but of different length. And more than one such cylinder located on more than one structural member may be used for a single cable or line, such as is the arrangement with guy line 38, earlier described. Another example is guy line 40, attached to fitting 47 at the end of lower spar 37. It extends alongside the spar and into cylinder 145, out of that cylinder and across the gap to cylinder 142 affixed to triangle member 27 and out the end of that cylinder to triangle fitting 30 to which it is connected.

Guy line 41 extends from fitting 30 and into cylinder 145 also affixed to triangle member 27 and out the slit in that cylinder and across the gap into a cylinder 142 on the side of deployable spar 37*b* and out the end of that cylinder to a connection with fitting 47*b* at the end of that spar. Guy line 32 extends from a connection at four member fitting 18, down through a cylinder 142 affixed to vertical strut 17, and out the slit in the cylinder's side and across a gap to cylinder 142 on triangle member 27, through that cylinder to a connection at triangle fitting 30.

Guy line 34 extends from eight member fitting 24, through a cylinder attached to vertical strut 17*b* to a cylinder 142 on the side of triangle member 29 and out that cylinder to a connection at two member triangle fitting 30. Guy line 39 proceeds from that same fitting 30 and cylinder and across the gap to upper spar 35*b* and thence to fitting 46*b* at the end of that spar.

Middle hoop line 33 extends from triangle fitting 30 through a cylinder 142 on the triangle member 29 and across the gap to a cylinder on the side of triangle member 29*b*, and from there to triangle fitting 30*b*. Guy line 43*b*, which extends between the ends of an upper and lower deployable spar, is seen to extend from fitting 47*b* at the end of spar 37*b* and down along the side of the spar, extending through multiple numbers of smaller cylinders 144 on the side of the spar, loops over fitting 24 and continues along the side of vertical strut 17*b* and through a long cylinder located on the strut's side. The guy line continues along the underside of deployable spar 35*b* and through additional cylinders attached thereto, not visible in this figure, but identical to that shown for guy line 43 on spar 35 in the figure, to its connection at fitting 46*b*. A like routing may be traced from each of the other spar end to spar end guy lines 43 and 43*c* in the figure.

The figure also offers a small glimpse of the stabilizer guy line 42 that extends between four member fitting 18 on the left and four member fitting 26 on the right, which appears at the top center of the figure just below eight member fitting 20. By comparing the guy lines as earlier presented in the fully deployed side view of FIG. 7 with the appearance of those same elements in this figure, the cylinders associated with each guy line and hoop line and their respective routing may be traced.

It is appreciated that the routing of the cables or lines and the cylinders chosen and their placement in the truss are made in a way that is seen to avoid any entanglements or restrictions on deployment, a selection which involves some trial and error and familiarity with the deployment movements of the structural members in a particular truss. Thus many different routing arrangements may be found suitable for a particular truss. That illustrated in FIG. 27 is one cylinder selection, mounting and cable routing arrangement found suitable for the embodiment of FIGS. 1 and 2.

With an understanding of the foregoing cable management system, one may make brief reference to FIG. 20, earlier presented in this description, which illustrates the same two bays of FIG. 27 in the stowed condition. The figure shows that using the described cable management system the guy lines are compactly stowed without draping.

Figure 29A:
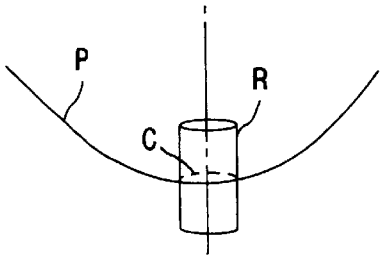
FIGS. 29A, 29B and 29C pictorially illustrate the derivation of circular and elliptical shapes that are replicated in the perimeter truss structure.

In the foregoing embodiment, the truss defines a hollow three dimensional figure of circular, short cylindrical geometry. That was accomplished by using an even number of support members of equal length about the periphery of the truss's frame; and by use of deployable spars of equal length that are positioned, as deployed, at equal angles from the cylinder. That perimeter truss configuration may be used for a center-fed symmetric reflector. Such a reflector is designed by using the center portion C of a paraboloid P, as shown in FIG. 29*a*, defined by the intersection of a right cylinder R coaxial with the paraboloid axis. However, from the foregoing description, those skilled in the art will readily recognize that the basic frame and/or spar structure in any of the foregoing embodiments may be modified to define parabolic reflectors of other geometries, such as one having an elliptical periphery or border. Such alternate configurations are necessary for off-set reflectors.

Figure 29B:
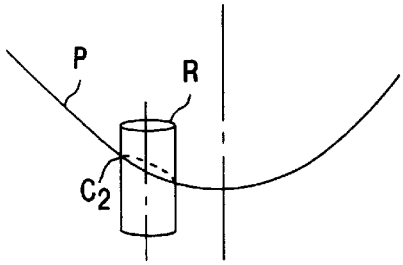

An offset reflector is one in which the section of the paraboloid used to reflect RF waves is not concentric with the axis of the paraboloid. A typical section for an offset reflector is shown in FIG. 29B, where the shape being emulated is the intersection C2 of a cylinder R with a paraboloid P, the cylinder axis being parallel and offset from the paraboloid's axis. The radius of the cylinder is not of importance. In some designs that radius may be large enough to encompass the center of the paraboloid and in other designs not. As those skilled in the art recognize, the intersection of the cylinder with the paraboloid defines an ellipse, in which the edge of the ellipse lies in a plane. Two alternative embodiments of the present invention support that type of surface.

Figure 30A:
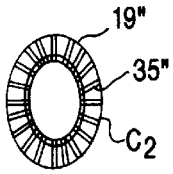
FIGS. 30A, 30B and 30C pictorially represent in top, front and side view one alternative elliptical geometry for the truss, shown in FIG. 29B, useful for an offset type reflector, obtained by modification of the circular cylindrical geometry used in the embodiment of FIGS. 1–4.
Figure 30B:
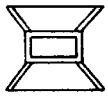
Figure 30C:
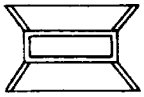

In the first offset embodiment such as represented in FIGS. 30A, 30B and 30C, respectively, in top, front and side view, the angles of the four member and eight member fittings that support the horizontal frame elements are defined such that the frame is the same shape as the ellipse, but is smaller by a predetermined amount. Spars 35" of equal length are set at the same angle from the frame. With that, the distal ends of the spars will match the shape of the elliptical paraboloid reflective surface C2 being supported.

Figure 30D:
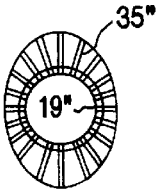
FIGS. 30D, 30E and 30F pictorially represent in top, front and side view a second alternative elliptical geometry for the truss, shown in FIG. 29B, also useful for an offset type reflector, obtained by modification of the circular cylindrical geometry used in the embodiment of FIGS. 1–4.
Figure 30E:
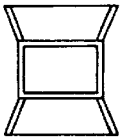
Figure 30F:
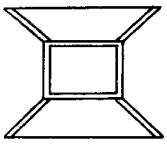

In a second offset embodiment for the parallel cylinder cut, represented in FIGS. 30D, 30E and 30F, respectively, in top, front and side view, the frame 19" is circular, as in the preferred embodiment of FIGS. 1–4. However, the diameter of the frame is designed to be less than or equal the minor axis length of the supported ellipse. And in this alternative, the spars 35" are constructed of different lengths, and are positioned in the deployed truss at different angles so as to connect from the circular basic frame to the peripheral shape of the elliptical paraboloid reflective surface to be supported.

Figure 29C:
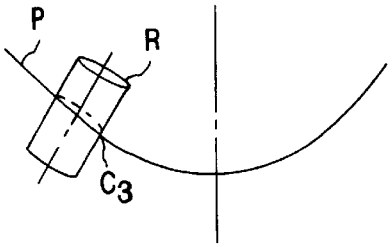
Figure 31A:
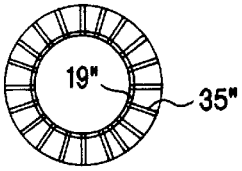
FIGS. 31A, 31B and 31C pictorially represent in top, front and side view one alternative geometry for the truss, shown in FIG. 29C, useful for an offset type reflector, obtained by modification of the circular cylindrical geometry used in the embodiment of FIGS. 1–4.
Figure 31B:
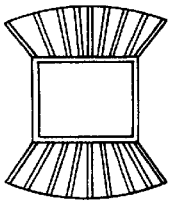
Figure 31C:
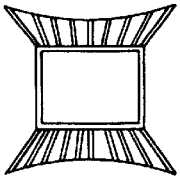

Alternatively, the cylinder R intersecting the paraboloid P may be oriented such that it is not parallel to the axis of the paraboloid, such as shown in FIG. 29C. The intersection of the cylinder and the paraboloid C3 is circular as viewed from the axis of the cylinder; and the intersection does not lie in a plane. In the third offset reflector embodiment, represented in FIGS. 31A, 31B and 31C, respectively, in top, front and side view, the basic frame is circular and smaller in diameter than the intersecting cylinder. The spars 35" are made of different lengths and are set at different angles so as to connect between the frame and the edge of the circular paraboloid section being supported.

The latter configuration may also be achieved by using the same tubular frame members as were used in the construction of the cylindrical frame, but constructing the fittings, which connect those frame members together to form the frame, with very loose or "sloppy" tolerances. The frame is then drawn or squeezed into the elliptical shape, by tying the elliptical shaped reflective mesh material to the trusses spars. The mesh material pulls the truss into the same geometry defined by the border of the mesh material, which is permitted by the sloppy tolerances of the fittings. Since a fitting is inserted between each frame member of adjacent bays and the width of the bay includes the effective length of the fitting, the sloppy tolerances in the fittings of this embodiment permit that distance or bay width to be adjusted. Effectively the sizes of the bays in the truss change, due to being taken up in the looseness of the fittings, permitting the frame to be drawn into the correct elliptical shape.

As becomes apparent to those skilled in the art upon reading this specification, various alternative modifications can be made to the foregoing truss structure to produce alternative embodiments, which, although differing from one another in detail, retain the spirit and scope of the present invention. A number of these alternative embodiments, although less preferred than that previously described, may be next considered.

Bi-Pod Truss.

Figure 32:
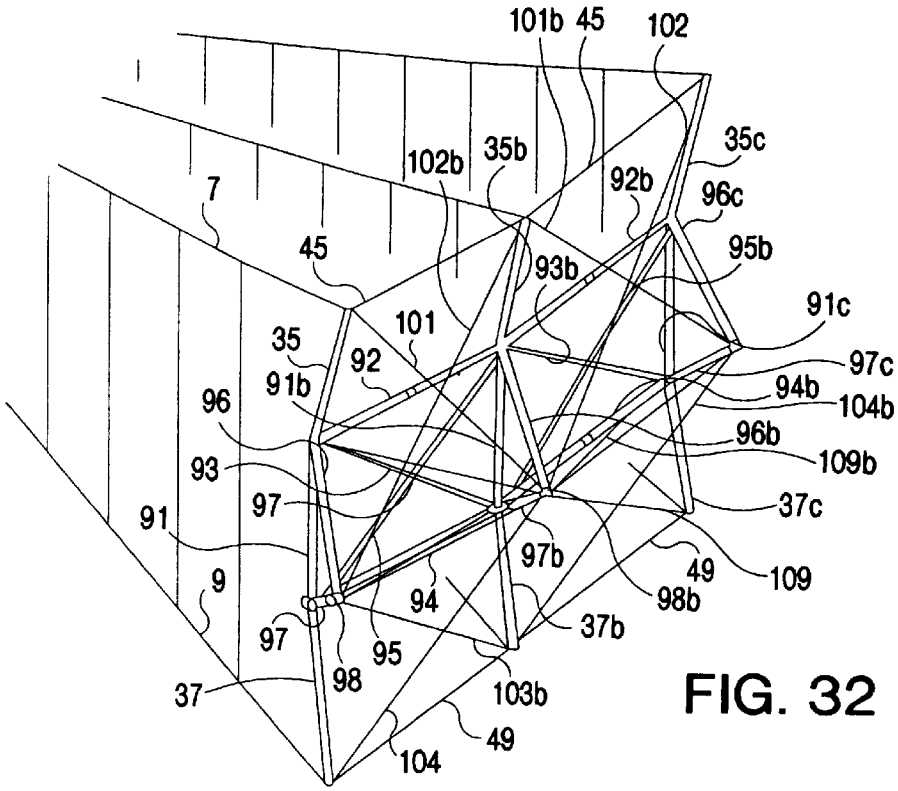
FIG. 32 is a perspective view of a second embodiment of the reflector truss.

A first alternative embodiment is illustrated in FIG. 32, illustrating two bays of the alternative embodiment in perspective view. This embodiment is referred to as a vertical Bi-Pod triangular section. For convenience elements common to the earlier embodiment are designated by the same numerical designation. And as before, where an element in the structure reoccurs in the structure, the element is given the same numerical designation followed by a letter, such as in the case of the upper deployable spars 35, 35*b* and 35*c*.

An upper hoop line 45 extends about the truss and connects to the end of each of the upper deployable spars and a lower hoop line 49 extends about the truss and connects to the ends of each of the lower deployable spars, which is the same as in the preceding embodiment. A vertical telescoping member 91, replaces the vertical strut 17 of the prior embodiment. Hoop longerons 93 and 94 contain a latching pivot joint in the mid-section, which allows the longerons to fold in half. Those longerons extend in parallel and are attached to the ends of vertical telescoping members 91 and 91*b* in the left hand bay illustrated to form a rectangular figure. Diagonal struts 93 and 95 extend between opposite corners of the figure to provide support. The diagonal struts are connected together at the center by a pivot joint 90 to provide a scissors like deployment and synchronization action. A pair of vertical bi-pods 96 and 97 are pivotally attached together at a pivot joint 98 and to the ends of the associated vertical telescoping member 91.

The guy line arrangement is somewhat more complicated. From the apex 98*b* of the bi-pod member formed by members 96*b* and 97*b* on the right hand side of the left bay, guy lines 101, 102, 103 and 104, extend, respectively, to the ends of deployable spars on adjacent vertical members, 35, 35*c*, 37 and 37*c*. Each such apex is connected to four upper and lower deployable spars by the four guy wires. This structure is repeated throughout the bays.

Guy lines 102*b* and 103*b* from the apex 98 of bi-pod members 96 and 97 are connected to the outer ends of deployable spars 35*b* and 37*b*. The remaining two guy wires connected to that apex are not illustrated as they connect to the elements in the immediately preceding bay. Likewise guy wires 101*b* and 104*b* connect to the pivot joint 98*c* of the bi-pod members 96*c* and 97*c* on the right side and the respective outer ends of deployable spars 35*b* and 37*b*. Also, the remaining two guy wires connected to that apex are not illustrated since they connect to the deployable spars in the immediately succeeding bay, not illustrated in the figure. Guy lines 105 and 106 assist to maintain the stability of the structure.

A hoop line 109, a tension line, extends about the periphery and connects to the pivot joint 98 of each bi-pod member, assisting to maintain the dimensional integrity and geometry of the truss as deployed.

Figure 33A:
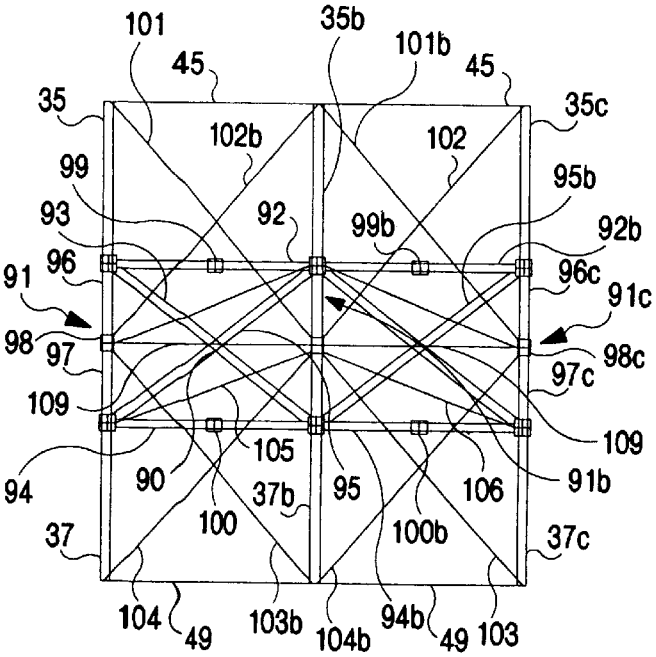
FIGS. 33A, 33B, 33C and 33D are diagrams of the embodiment of FIG. 32 showing the structure in various stages of folding.

Reference is made to the diagrams of FIGS. 33A–33D which illustrates the folding action of the elements. FIG. 33A is a front view of the section of FIG. 32. It should be recognized that, in this side view, the triangular bi-pod members overlie and obscure a view of the vertical telescoping members which they overlie. Thus, bi-pod member 96 and 97 overlie vertical telescoping member 91; bi-pod members 96*b* and 97*b* overlie vertical telescoping member 91*b*; and bi-pod members 96*c* and 97*c* overlie vertical telescoping member 91*c*.

Figure 33B:
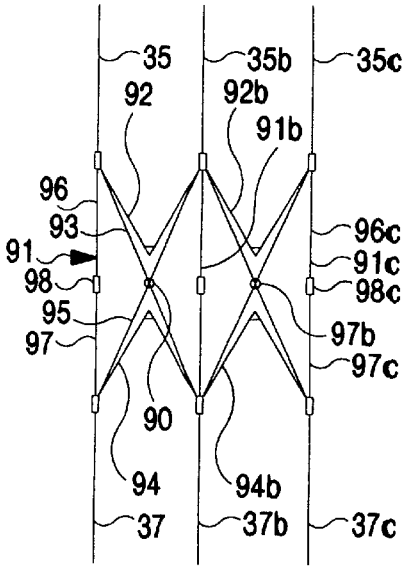
Figure 33C:
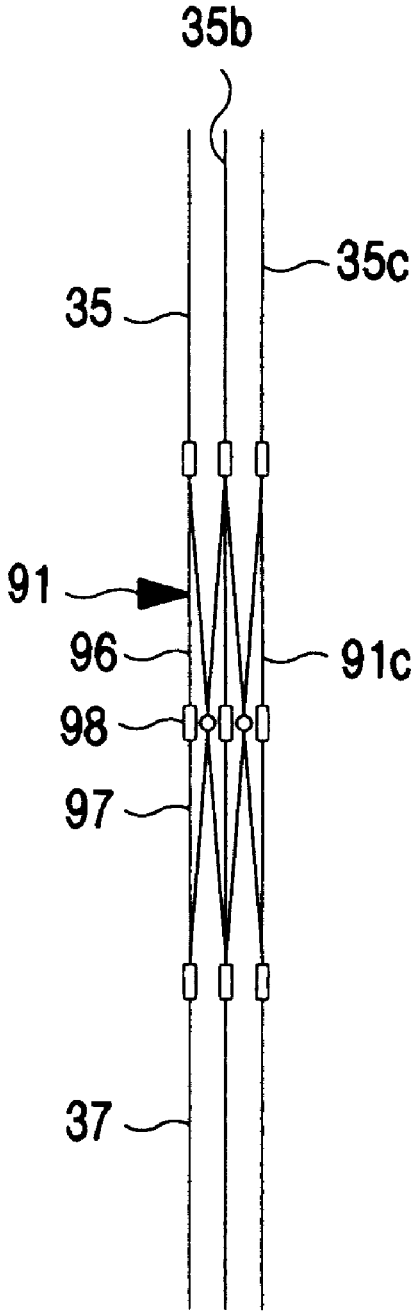
Figure 33D:
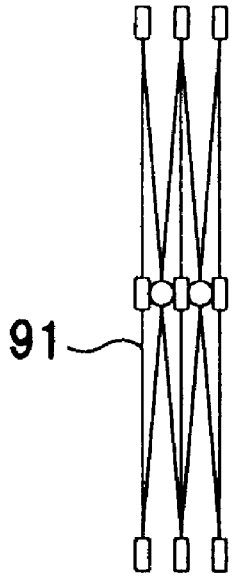

By squeezing the two sides of the bays together, the horizontal members 92 and 94 begin to fold inward at the joints 99 and 100, the bi-pods 96 and 97, 96*b* and 97*b*, and 96*c* and 97*c*, respectively, fold down and flatten, and the vertical telescoping members 91, 91*b* and 91*c*, to which the outer ends of the bi-pods are attached and which underlie the respective bi-pods, increase in length, that is, telescope as illustrated in FIG. 33B. Joints 99 and 100 are latched in the deployed condition to form the rigid truss. Each of the deployable spars 35, 35*b*, 35*c*, 37, 37*b* and 37*c* fold over. The foregoing collapse or fold-up action continues as illustrated in FIG. 33D to form the narrow package illustrated. All tensions lines such as the guy wires, not illustrated in the diagrams of FIG. 33B, 33C and 33D, slacken and drape.

As in the prior embodiment, the deployable spars and associated tension lines represent a minimum physical structure, minimizing both size and weight of the completed truss assembly. Those spars provide a single edge to the front end of the truss assembly.

Deployment force is supplied either by springs or an electric motor.

Quad-Pod Truss.

Figure 34:
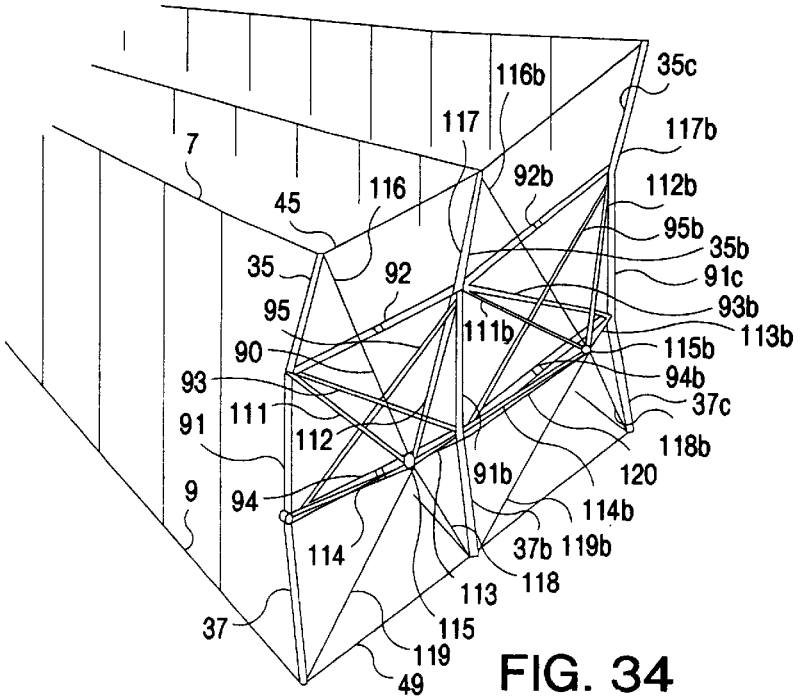
FIG. 34 is a perspective view of a third embodiment of the reflector truss.

A third embodiment of the truss invention is illustrated in the partial view of FIG. 34, which shows two of the bays in perspective. This embodiment is referred to as the diagonal Quad-Pod triangular section. As before, where an element was presented in a prior embodiment, it is identified in this figure by the same number previously used. Thus the embodiment includes upper deployable struts 35, 35*b*, and 35*c*; vertical telescoping members 91, 91*b* and 91*c*, horizontal longerons 92 and 94, and 92*b* and 94*b*, containing a midsection latching hinge joint, scissors connected diagonals 93 and 95 in the left bay, and 93*b* and 95*b* in the right bay. Each pair of vertical telescoping members and horizontal longerons define a rectangular frame with each vertical telescoping member being common to adjacent rectangular frames. In this embodiment, four diagonal struts or quad-pods, as variously termed, 111, 112, 113 and 114 in the left bay and 111*b*, 112*b*, 113*b* and 114*b* in the right one, attach to the defined rectangular frame define a quad-pod or four sided right pyramid, as variously termed, in each bay. That pyramid extends radially outward from the truss structure and its apex overlies and is in alignment with the scissors pivot joint 90 or 90*b* of the underlying diagonal members in the associated bay. The scissor pivot action serves as both a deployment and synchronization of kinematic movement. Deployment is either by spring or motor supplied force.

The pyramid's individual arms 111, 112, 113, and 114 are essentially equal in length. An end of each arm is pivotally connected to a hinge joint 115 at the pyramid's apex. and the opposite end of each arm is pivotally connected to a respective one of the joint fittings at a respective corner of the defined rectangular frame, as example, arm 111 connects to the fitting at the juncture of members 91 and 92. Each of the guy wires 116, 117, 118 and 119 extend from the apex joint 115 and the end of a respective one of the deployable arms 35, 35*b*, 37 and 37*b*. Another guy wire 120 extends between the apex of the two pyramid figures. Like guy wires, not illustrated, extend from the apex of the left side pyramid to apex of the pyramid in the next adjacent bay to the left, not illustrated, and another extends to that location on the next adjacent bay to the right. Essentially, guy wires extends from pyramid apex to apex in all of the bays, forming an outer hoop line. As shown, the two bays are of identical construction, as are all of the other bays in this truss structure.

Figure 35A:
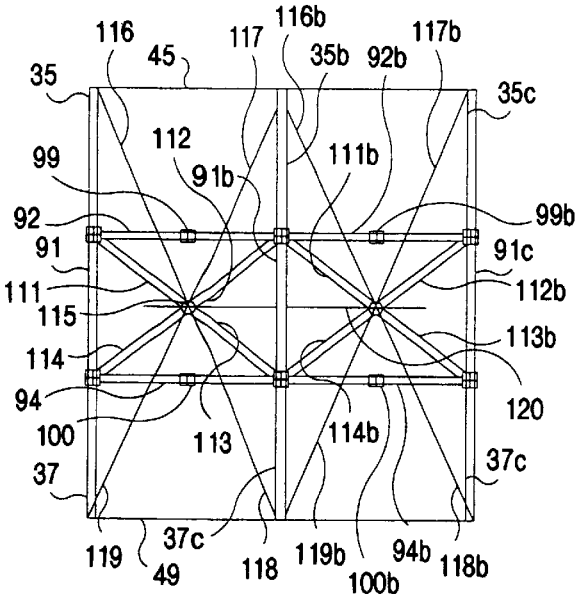

The embodiment of FIG. 34 folds up much like that of the prior embodiment. Reference is made to the diagrams of FIGS. 35A–35D which illustrates the folding action of the elements. FIG. 35A is a front view of the two bays illustrated in FIG. 34. It should be recognized that, in this front view, in each bay, the pyramid bi-pod members, 111, 112, 113 and 114, overlie and obscure a view of the diagonal members 93 and 95, which they overlie.

Figure 35B:
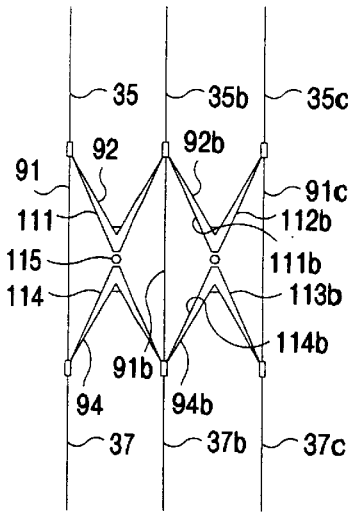
Figure 35C:
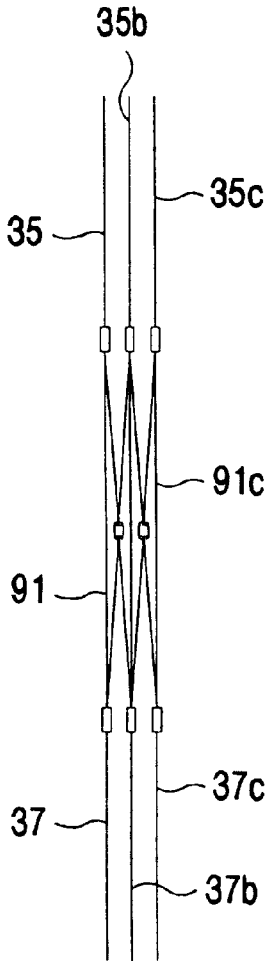
Figure 35D:
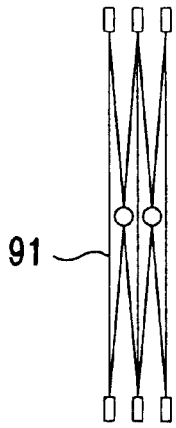

By squeezing the two sides of the bays together, the horizontal longerons 92 and 94 begin to fold inward, toward the center, at the hinge joint, the quad-pods 111, 112, 113 and 114, and 111*b*, 112*b*, 113*b* and 114*b*, respectively, flatten down over the underlying scissors diagonals 93 and 95, the latter of which pivot relative to one another, and the vertical telescoping members 91, 91*b* and 91*c*, to which the outer ends of the quad-pods are attached, increase in length, that is, telescope as illustrated in FIG. 35B. Each of the deployable spars 35, 35*b*, 35*c*, 37, 37*b* and 37*c* fold over. Joints 99 and 100 are latched in the deployed condition to form the rigid truss. The foregoing collapse or fold-up action continues as illustrated in FIG. 35D to form the narrow package illustrated. All tensions lines such as the guy wires, not illustrated in the diagrams of FIG. 35B, 35C and 35D, slacken and drape.

Truss-Band Scissor Truss.

Figure 36:
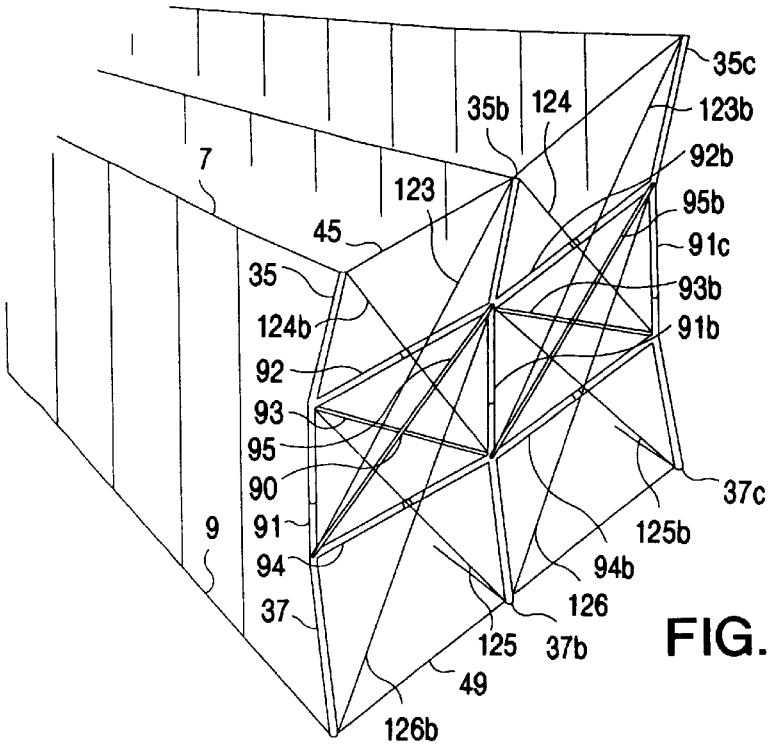
FIG. 36 is a perspective view of a fourth embodiment of the reflector truss.

A fourth alternative embodiment is illustrated in FIG. 36 to which reference is made. This embodiment is referred to as the Truss Band Scissor Deployment. Again for convenience elements common to any of the previous described embodiments are designated by the same numerical designation in this embodiment. The figure illustrates two bays of the truss structure, which is sufficient to define the truss overall, including the catenaries and catenary ties. Each bay includes a rectangular frame formed by two vertical telescoping members, 91 and 91*b* in the left bay and 91*b* and 91*c* in the right hand bay, one telescoping member being common to adjacent bays, and two horizontal longerons, 92 and 94 in the left bay and 92*b* and 94*b* in the right bay. The ends of those members are joined together at the corners of the frame through a fitting or joint. The centers of members 92 and 94 contain folding joints 99 and 100 which latch in the deployed condition to form the rigid truss shape.

The longerons contain a latching hinge joint at the midpoint, allowing those longerons to fold in half, just like the previously described embodiment. A pair of scissors connected diagonals 93 and 95 in the left bay and 93*b* and 95*b* in the right bay, criss-cross extend diagonally between respective corners of the associated rectangular frame providing a synchronizing and deployment action. The upper deployable spars 35, 35*b* and 35*c* are pivotally joined at an end by means of a spring loaded pivot joint to the end of a vertical telescoping member 91, 91*b* and 91*c*, respectively. The lower deployable spars 37, 37*b* and 37*c* are also pivotally joined at an end by means of a spring loaded pivot joint to the bottom end of a vertical telescoping member 11, 11*b* and 11*c*, respectively.

A pair of guy lines is anchored at the end of each of the deployable spars. Guy lines 123 and 124 extend from the end of the central upper deployable spar 35*b* to the outer bottom corners of the frames of the two adjacent bays. Like guy lines 125 and 126 extend from the end of the central lower deployable spar 37*b* to the outer upper corners of the frames of the two adjacent bays.

A guy line 124*b* is anchored to and extends from the distal end of spar 35 and is anchored to the lower right corner of the frame of the left bay; and a guy line 126*b* is anchored to and extends from the end of lower spar 37 and is anchored to the upper right corner of the frame of the left bay. A second guy line connected to the distal ends of each of the latter spars 35 and 37 is not illustrated, since those guy wires extend to corresponding frame locations in the next adjacent bay to the left that is not illustrated, specifically to the lower left corner of the defined frame in that bay and the upper left corner of the defined frame, respectively.

A guy line 123*b* is anchored to and extends from the distal end of spar 35*c* and is anchored to the left lower corner of the frame of the left bay; and a guy line 125*b* is anchored to and extends from the distal end of lower spar 37*c* and is anchored to the upper left corner of of the frame of the left bay. A second guy line connected to the distal ends of each of the latter spars, 35*c* and 37*c*, is not illustrated, since such guy wires extend to locations in the next adjacent bay to the right, that is not illustrated, specifically, to the lower right corner of the formed rectangular frame in that adjacent bay and the upper right corner of that formed rectangular frame, respectively.

A lower hoop line 49 attaches to the outer end of each of the lower deployable spars, 37, extending about the entire truss in a hoop; and an upper hoop line 45 attaches to the outer end of each of the upper deployable spars, 35, also extending about the entire truss in a hoop.

Catenaries 7, partially illustrated, attach to the end of the upper spars and like catenaries 9, partially illustrated, attach to the end of the lower spars. In the completed truss of this embodiment, the catenaries are connected in the same structural assembly as was described herein for the embodiment of FIG. 1, which description need not be repeated.

Figure 37A:
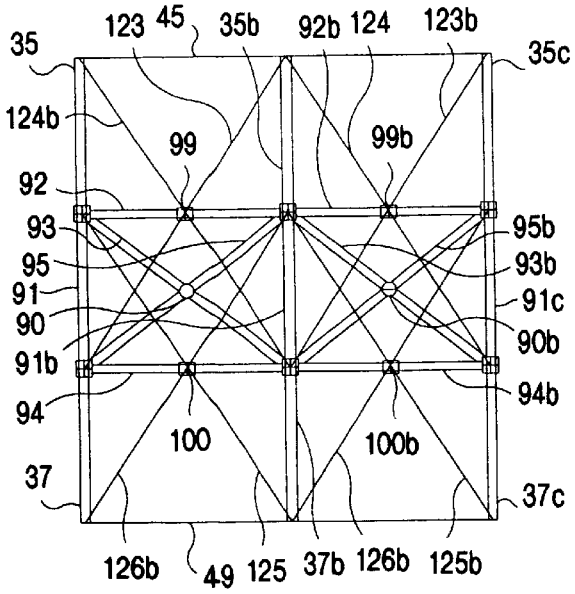
FIGS. 37A, 37B, 37C and 37D are diagrams of the embodiment of FIG. 36 showing the structure in various stages of folding.
Figure 37B:
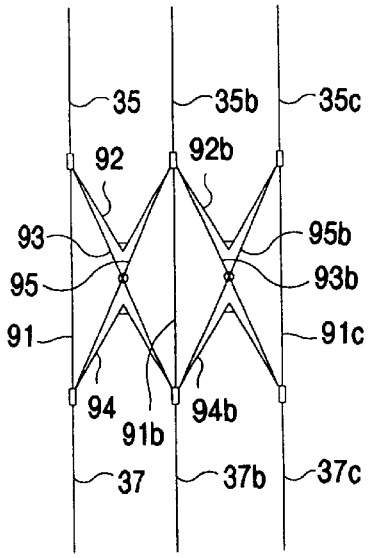
Figure 37C:
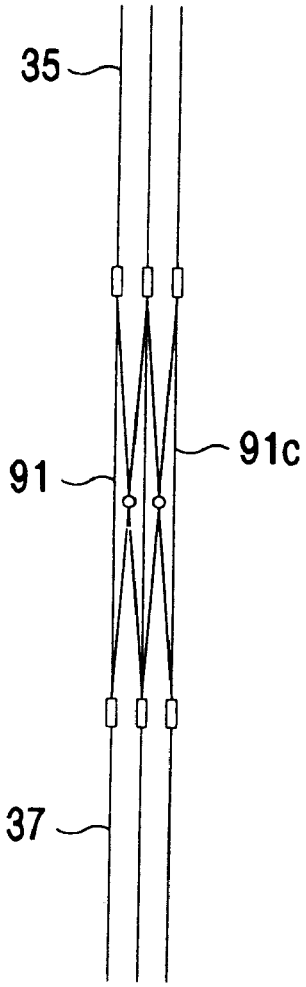
Figure 37D:
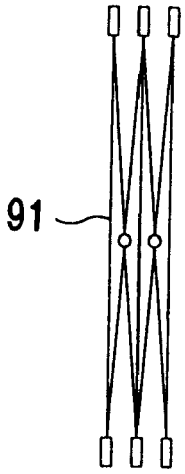

The diagrams of FIGS. 37A, 37B, 37C and 37D assist to define the action of the elements of FIG. 36 in the course of folding up to the non-deployed or stowed condition. FIG. 37A shows a front plan view of the embodiment illustrated in the previous FIG. 36. FIG. 37B shows a preliminary stage of fold up for the elements of FIG. 37A, excluding the guy lines illustrated in FIG. 37A, which slack and drape during fold up, are omitted for clarity of illustration. As in the prior embodiment the vertical members telescope, lengthen, the scissor members fold and the outer horizontal longerons fold toward the center. FIG. 37C shows a further stage of fold up with spars remaining extending and FIG. 37D illustrates the final step in which the spars fold to the outside.

Deployment force is supplied either by springs or an electric motor.

Truss Band Parallel Bar Truss.

Figure 38:
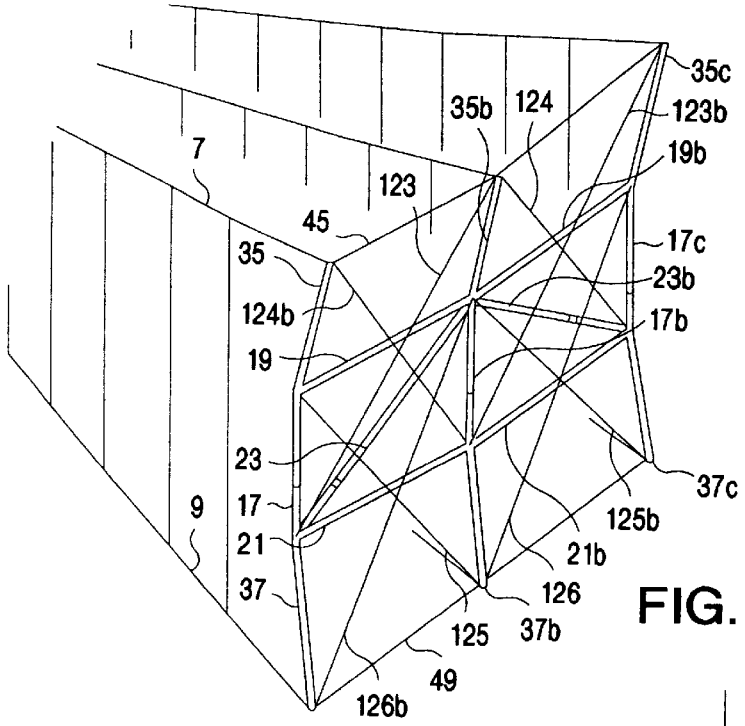
FIG. 38 is a perspective view of a fifth embodiment of the reflector truss.

A fifth embodiment of the truss structure is partially illustrated in FIG. 38, showing a perspective view of two truss bays, to which reference is made. This embodiment is referred to as the Truss Band Parallel Bar Deployment. Again for convenience elements common to any of the previous described embodiments are designated by the same numerical designation in this embodiment. Each bay includes a rectangular frame defined by two vertical struts 17 and 17*b* in the left bay and 17*b* and 17*c* in the right hand bay, and two spaced horizontal longerons, 19 and 21 in the left bay and 19*b* and 21*b* in the right bay. The ends of those members are joined together at the corners of the frame by appropriate fittings of the kind earlier described in connection with the principal embodiment. The fitting connection to the vertical struts is fixed or rigid. The connection to the horizontal longerons is by pivot joints. The horizontal longerons in this embodiment do not contain the latching joint at the mid-section found in the immediately preceding embodiment and are essentially straight poles as in the first embodiment.

A telescoping diagonal 23 connects between the upper right corner of the frame of the left bay and the lower left corner, extending diagonally across the rectangular frame. Another telescoping diagonal 23*b* connects between the upper left corner of the frame of the right bay and the lower right corner, extending diagonally across that frame. It is appreciated that the structure of the left bay is a mirror image of the structure of the right bay.

Upper deployable spars 35, 35*b* and 35*c* extend from the respective ends of vertical struts 17, 17*b* and 17*c* to which they are attached by spring loaded hinge joints; and lower deployable spars 37, 37*b* and 37*c* extend from the respective bottom ends of the vertical struts 17, 17*b*, and 17*c* to which they are also attached by spring loaded hinge joints, not illustrated.

Each deployable spar includes two guy wires attached to the outer end. Guy wires 123 and 124 attached to the end of the central upper deployable spar 35*b* and connect, respectively, to the lower left corner of the formed rectangular frame of the left bay and to the lower right corner of the formed rectangular frame of the right bay. Guy wires 125 and 126 attached to the end of the central lower deployable spar 37*b* and connect, respectively, to the upper left corner of the rectangular frame section of the left bay and to the upper right corner of the rectangular frame section of the right bay illustrated in the figure. Those corner connections are made to the fittings found in the respective corner.

Guy line 124*b* is anchored to and extends from the end of spar 35 and is anchored to the lower right corner of the frame of the left bay; and guy line 126*b* is anchored to and extends from the end of lower spar 37 and is anchored to the upper right corner of the frame of the left bay. The second guy line that is connected to each of the latter spars is not included, since those guy lines extend to corresponding frame locations in the next adjacent bay to the left that is not illustrated, specifically to the lower left corner of the defined rectangular frame in that bay and the upper left corner of the defined rectangular frame, respectively.

Guy line 123*b* is anchored to and extends from the end of spar 35*c* and is anchored to the left lower corner of the frame of the right bay; and guy line 125*b* is anchored to and extends from the end of lower spar 37*c* and is anchored to the upper left corner of of the frame of the left bay. The second guy line connected to each of the latter two spars is not included, since those guy lines extend to locations in the next adjacent bay to the right, that is not illustrated, specifically to the lower right corner of the defined rectangular frame in that bay and the upper right corner of the defined rectangular frame, respectively.

As in the preceding embodiment, lower hoop line 49 attaches to the outer end of each of the lower deployable spars, extending about the entire truss in a hoop; and an upper hoop line 45 attaches to the outer end of each of the upper deployable spars, also extending about the entire truss in a hoop. Catenaries 7 attach to the end of the upper spars and like catenaries 9, partially represented, attach to the end of the lower spars. In the completed truss of this embodiment, the catenaries are connected in the same structural assembly as was described herein for the embodiment of FIG. 1 and that description need not be repeated.

Figure 39A:
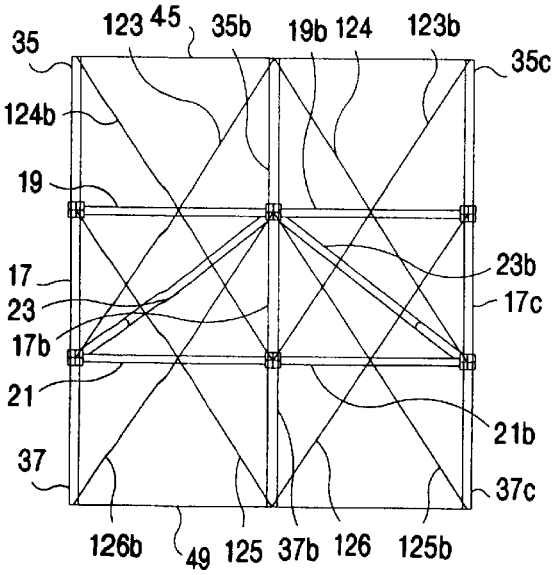
FIGS. 39A, 39B, 39C and 39D are diagrams of the embodiment of FIG. 38 showing the structure in various stages of folding.
Figure 39B:
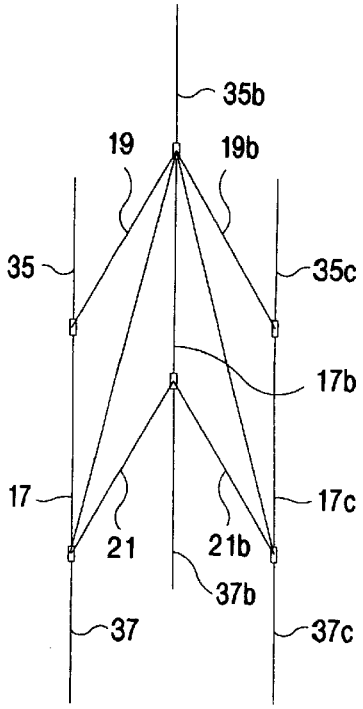
Figure 39C:
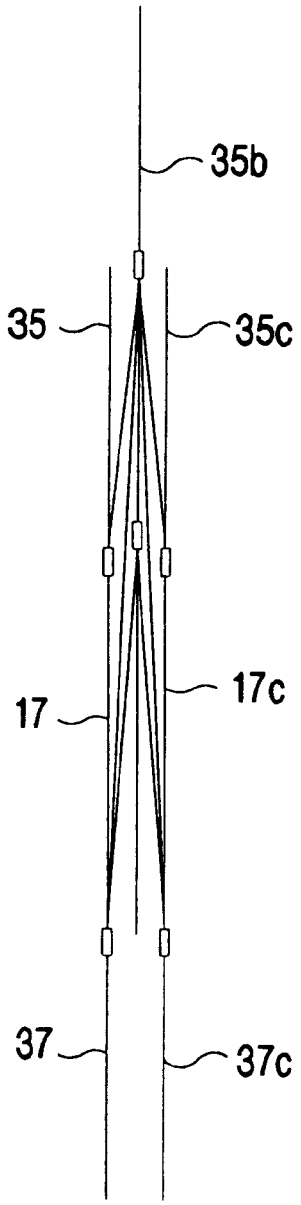
Figure 39D:
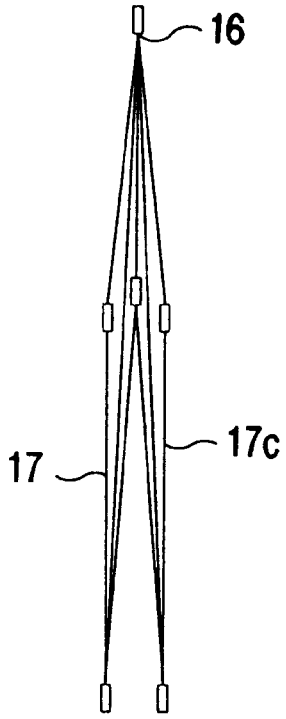

The diagrams of FIGS. 39A, 39B, 39C and 39D assist to define the action of the elements in the course of folding the truss up to the stowed or undeployed condition. FIG. 39A shows a front plan view of the embodiment illustrated in the previous FIG. 38. FIG. 39B shows a preliminary stage of fold up for the elements of FIG. 39A, except for the guy lines, which drape during fold up, are omitted for clarity of illustration. The diagonal members 23 and 23*b* lengthen, telescope in synchronism with one another during fold up and vertical struts 17, 17*b*, and 17*c* parallel bar towards each other. The horizontal longerons pivot downward and fold along side the vertical struts. FIG. 39C shows a further stage of fold up in which the deployable spars 35*b* and 37*b*, remaining extended outwardly and FIG. 39D illustrates the final step in which the deployable spars are folded to the outside. It is appreciated that the length of the undeployed package or barrel for this embodiment is slightly greater in length than in the preceding embodiments.

Deployment of the folded frame is accomplished by first having springs located in the joints developing a torsion force to open the folded members. The partial opened frame is fully deployed by applying tension to the collapsing telescoping member with a spring or cable reeled up to pull each end of the telescoping tube towards the collapsed condition. When the frame is fully deployed the telescoping tube is latched in its collapsed condition, thereby developing a rigid truss structure.

Scissors-Box Truss.

Figure 40:
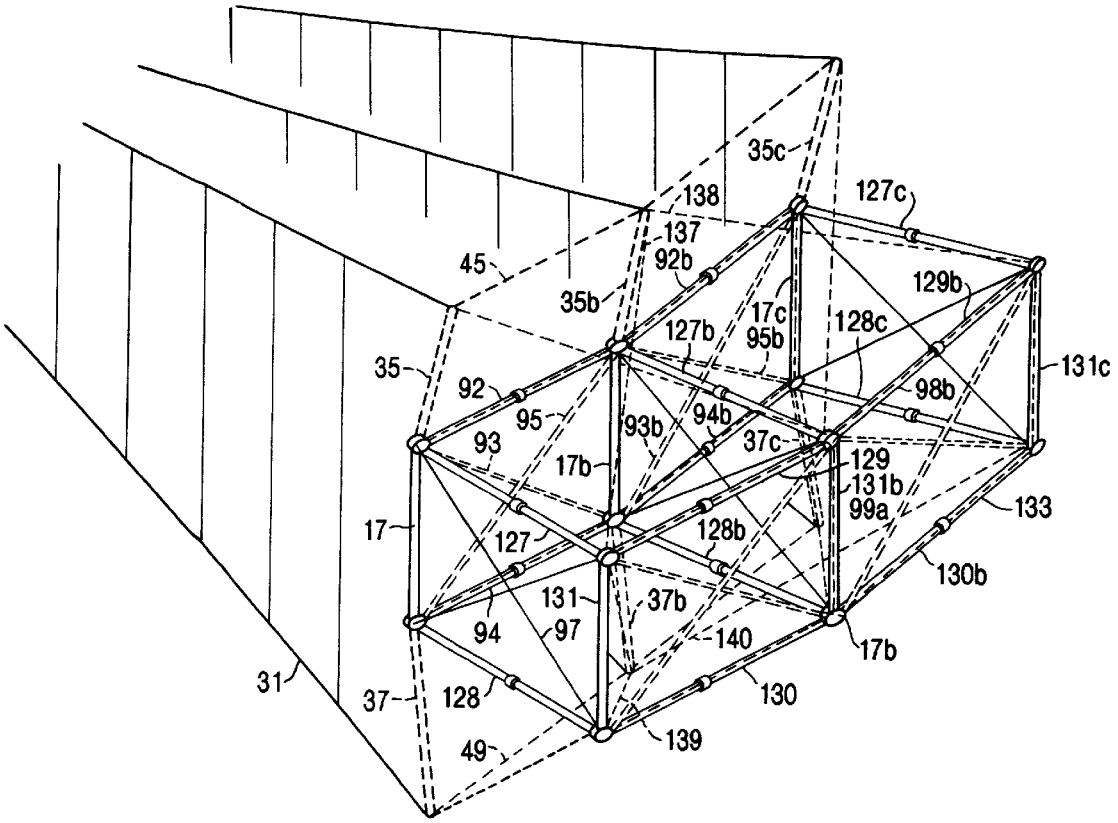
FIG. 40 is a perspective view of a sixth embodiment of the reflector truss.

Reference is made to FIG. 40, which illustrates a sixth embodiment of the invention, referred to as a Scissor deployment box truss. Again for convenience elements common to any of the previous described embodiments are designated by the same numerical designation in this embodiment. Where the prior embodiments may have constructed triangles or pyramids on the face of a frame, the present embodiment unfolds a box-like structure onto the frame and, hence, is of greater strength and robustness, and, of course, is of greater weight than the preceding embodiments. The figure illustrates two bays of the truss structure, which is sufficient to define the truss overall, including the catenaries and ties. The basic framework to the truss is the same structure that served as the foundation to the embodiment of FIG. 36, earlier described. Thus, should any uncertainty be found in the description of this embodiment, it may be resolved by reference to the description of that prior embodiment.

Each bay includes a rectangular frame defined by two vertical members or struts, 17 and 17*b* in the left bay and 17*b* and 17*c* in the right hand bay, and two horizontal longerons, 92 and 94 in the left bay and 92*b* and 94*b* in the right bay. The ends of those members are joined together at the corners of the frame, suitably by an appropriate fitting or joint. The horizontal longerons contain a latching joint at the mid-section allowing those longerons to fold in half, just like the next-to-last described embodiment.

Deployable struts 35, 35*b*, and 35*c* are pivotally connected at one end to a respective upper end of one of the vertical struts 17, 17*b* and 17*c*, suitably through a fitting. The pivot joints for those struts are spring biased to bias the associated deployable strut for pivotal outward movement to the deployed position illustrated. On the lower side, deployable struts 37, 37*b*, and 37*c* are pivotally connected at one end to a respective lower end of one of the vertical struts 17, 17*b* and 17*c*, suitably through a fitting. Again, the pivot joints for the latter struts are spring biased to bias the associated deployable strut for pivotal outward movement to the deployed position illustrated.

In the left bay, a pair of scissor connected diagonals 93 and 95 diagonally extend across the rectangular frame and connect together at pivot joint 90 located at the center of each diagonal member. A like arrangement of scissor connected diagonal members 93*b* and 95*b* is included in the right bay illustrated.

The sections of the outer hoop line 45 connect between the outer ends of adjacent deployable struts 35 and 35*b*, 35*b* and 35*c*, and so on. The sections of the lower hoop line 49 connects between the outer ends of adjacent deployable struts 37 and 37*b*, 37*b* and 37*c*, and so on. And as in all the prior embodiments, the upper catenaries 7 are connected to the distal end of the upper deployable spars 35, and the lower catenaries 31 are connected to the distal ends of the lower deployable spars.

To form the box like arrangement, foldable longerons 127 and 128 extend from the upper and lower ends, respectively, of the strut 17, essentially perpendicular thereto. Foldable longerons 127*b* and 128*b* are connected in like manner to the opposite ends of vertical strut 17*b*, and foldable longerons 127*c* and 128*c* are connected in like manner to the ends of vertical strut 17*c*. Two pairs of foldable horizontal longerons 129 and 130 and 129*b* and 130*b* are included. Longeron 129 connects between the outer ends of longerons 127 and 127*b*; longeron 130 connects between the outer ends of longerons 128 and 128*b*; longeron 129*b* connects between the outer ends of longerons 127*b* and 127*c* and longeron 130*b* connects between the outer ends of longer 128*b* and 128*c*.

To complete the two box shaped frame extensions, a vertical strut 131 connects across the ends of foldable longerons 127 and 128, vertical strut 97*b* connects between the ends of longerons 127*b* and 128*b*, and vertical strut 97*c* connects between the ends of foldable longerons 127*c* and 128*c*. To strengthen the outer wall of each box, a further pair of scissor connected diagonals are included in each. Diagonal members 133 and 134 connect between opposed corners of the left box end and are connected together at their midpoint by a pivot joint 135. Diagonal members 94*b* and 95*b* connect between opposed corners of the right box end and are connected together at their midpoint by a pivot joint 96*b*. The ends of the diagonal members of each pair connect to the associated end fitting by a pivot joint, so as to permit relative movement during fold up.

Guy wires 137 and 138 connect from the end of deployable spar 35*b* to the upper outer corners of the dual box arrangement. On the underside guy wires 139 and 140 connect from the end of lower deployable spar 37*b* to the outer lower corners of the dual box arrangement. Corresponding guy wires on the other deployable spars, which are included in the combination, are not illustrated. But it should be recognized that those additional guy wires are connected in a like arrangement in which the two boxes are one of those illustrated and the like box in the next adjacent bay.

As in the prior embodiments, fittings, not illustrated, are employed in each corner. From the prior description of fittings, the structure of those fittings should be selfevident. The fittings in these alternative embodiments contain the appropriate pivot joints and structures necessary to allow the folding and unfolding operations described and to anchor the respective guy lines. The foregoing options for the truss structure attest to the versatility of the deployable strut arrangement.

Regressive Truss.

It was earlier noted in this specification that the basic frame used in construction of the perimeter truss of FIG. 2 was by itself a novel truss structure and could be used with an accompanying catenary system to support a reflective surface and function as a deployable perimeter truss reflector. Such a perimeter truss is illustrated in FIG. 41, to which reference is made.

Figure 41:
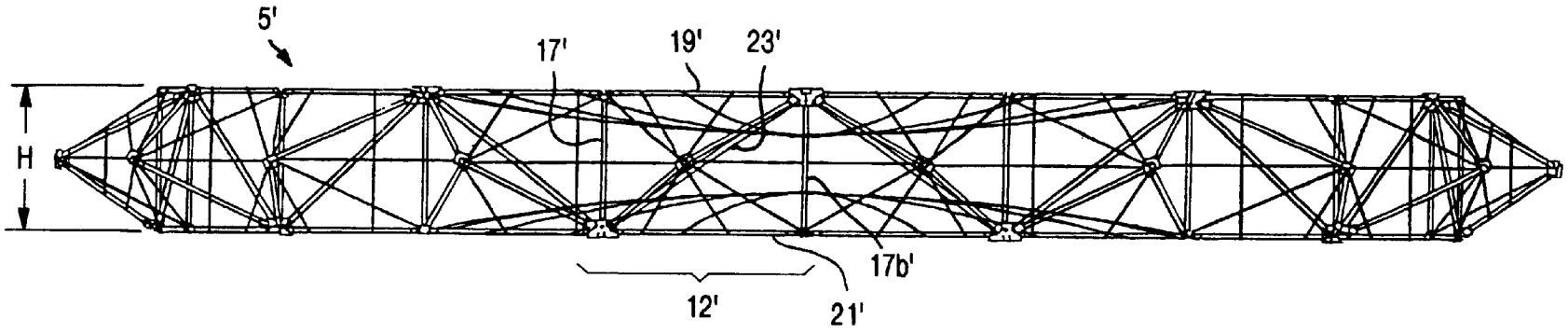
FIG. 41 is an illustration of a novel though less advantageous deployable perimeter truss formed from the elements used to form the basic frame structure in the embodiment of FIGS. 1–4, but lacking many advantages of the principal embodiment.

As shown in a side view, truss 5' does not contain any deployable spars, and comparing to the side view of the first embodiment presented in FIG. 4, it is seen that the basic structure of elements 19, 17, 17*b*, 21 and the telescoping diagonal 23 and associated triangle members corresponds to structural elements 19', 17', 17*b*' 21' and 23' in FIG. 41. The latter truss contains the same triangle members, and their support guy wires, such as 32 and 34, and the other guy lines that support the basic frame, such as those corresponding to guy lines 42 and 44, and middle hoop line 33 which are illustrated best in FIG. 7 in connection with the principal embodiment, but not numbered in the small size view of FIG. 41. The catenary system used may be the same in this regressive truss, with the outer ends of the catenary lines being attached to the four and eight member fittings about the periphery of the truss. The foregoing truss may also employ the tying arrangement and the deployment mechanism described herein.

The disadvantage of this latter truss is evident. In order for the latter truss reflector to perform at the same RF frequency as and substitute for the perimeter truss constructed in accordance with FIGS. 1 and 2 with the deployable spars, the truss's structural members must reach the same height and position as that attained by the ends of the deployable spars. To accomplish that structural members 19' and 21' must be slightly greater in length than the counterpart members in the principal truss and structural members 17' and 17'*b*, the vertical struts must be increased in length significantly. As illustrated in FIG. 41, the length of the vertical struts 17' must be of length H, which is the distance covered by the deployable spars and the vertical strut in the principal invention of FIGS. 1–4.

The disadvantage comes in stowage. When the foregoing truss is placed in the stowed condition, it occupies a substantially greater volume than the truss of FIGS. 1–4 and forms a package of substantially greater height. As brought out in the background, stowage space is very important in space borne application. In those applications where stowage space is at a premium this latter truss is less preferred and for that reason it is referred to as a regressive truss. However, in space borne applications in which adequate stowage space is available, the perimeter truss has the advantage of being less complex in structure and, hence, less expensive to manufacture. From the foregoing description, it is apparent that deployable spars add a degree of complexity to a perimeter truss reflector, which the truss of FIG. 41 avoids.

The foregoing embodiments describe a reflector whose reflective surface reflects RF electromagnetic energy. As those skilled in the art appreciate, a surface that is reflective to light may be substituted for the RF reflecting surface to form a parabolic light reflector. The light reflector concentrates light in the same manner as occurs with concentration of RF energy. Such a deployable light reflector should satisfy any need for any conceivable space borne concentration application. The foregoing antenna or light reflector structure may at least theoretically be used in earth based applications. However the availability of other less complicated techniques for manufacture and deployment of earth based antennas and/or light reflectors and the substantially lesser manufacturing costs would suggest that such use of the invention, geared to the environment and realities of outer space, would at best be extremely limited.

In the foregoing specification and in the claims which follow, the shape of the four-sided polygon defined by a pair of vertical struts and horizontal longerons is referred to as a rectangle, since the cited members are oriented at right angles to one another. Further, in at least some of the embodiments, the sides of that rectangular figure are equal in length and appear as a square. It should be understood, thus, that reference to a rectangle subsumes the special case in which the four sides of the rectangle are equal in length, and define a square.

It is believed that the foregoing description of the preferred embodiments of the invention is sufficient in detail to enable one skilled in the art to make and use the invention without undue experimentation. However, it is expressly understood that the detail of the elements presented for the foregoing purpose is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A deployable perimeter truss for a reflector, said deployable perimeter truss having front and back ends in the deployed condition, comprising:

a deployable structural frame defining a closed loop in the deployed condition, said structural frame having front and back ends and a predetermined height therebetween;

upper and lower deployable spars;

said upper deployable spars being pivotally mounted to said front end of said deployable structural frame and being biased for pivotal movement from an undeployed position to a position outwardly extended from said front end of said structural frame to define said front end to said perimeter truss; and said lower deployable spars being pivotally mounted to said rear end of said deployable structural frame and being biased for pivotal movement from an undeployed position to a position outwardly extended from said from said back end of said structural frame to define said back end to said perimeter truss, wherein said perimeter truss is of a height greater than said predetermined height of said structural frame.

2. The invention as defined in claim 1, further comprising:

spring loaded pivot means for pivotally mounting said upper and lower deployable spars to said structural frame and biasing said spars for movement to a deployed position.

3. The invention as defined in claim 2, further comprising:

a catenary system for supporting a reflective surface; and said catenary system being supported by said upper and lower spars.

4. The invention as defined in claim 2, further comprising:

an outer upper hoop line, said outer upper hoop line further comprising an inextensible tension member;

an outer lower hoop line, said outer lower hoop line further comprising an inextensible tension member;

said outer upper hoop line being coupled to the distal ends of said upper deployable spars;

said outer lower hoop line being coupled to the distal ends of said lower deployable spars.

5. The invention as defined in claim 4, wherein said upper deployable spars and lower deployable spars are positioned about the respective front and back ends of said structural member, each of said upper deployable spars being in alignment with a respective one of said lower deployable spars; and a guy line connected between a distal end of each upper deployable spar and a distal end of said respective one of said lower deployable spars.

6. The invention as defined in claim 5, further comprising:

a catenary system for supporting a reflective surface in a parabolic surface configuration;

said catenary system including a center, and first and second pluralities of lines radially outwardly extending from said center;

each of said lines of said first plurality of lines being connected to said distal end of a respective one of said upper deployable spars; and each of said lines of said second plurality of lines being connected to said distal end of a respective one of said lower deployable spars; whereby said catenary system is supported on said perimeter truss by said upper and lower spars.

7. The invention as defined in claim 6, wherein said catenary system includes means for shaping said lines of said first plurality of lines into a curved configuration defining a parabolic surface; and, further comprising: a sheet of pliant reflective material supported by said lines of said first plurality.

8. A deployable truss for a reflector comprising:

a truss structure comprising a plurality of rectangular shaped bays each comprising a pair of horizontal members and a pair of vertical members defining a rectangular frame, each said vertical member being common to two adjacent frames, said bays being serially connected to define a generally hollow cylindrical figure;

a first plurality of first deployable spars, each said spars having a proximal end and a distal end;

said first plurality being equal in number to the number of said vertical frame members;

each of said first deployable spars being pivotally connected at a proximal end to an upper end of a respective one of said vertical frame members for pivotal movement of said distal end between a stowed position and a deployed position outwardly extended above said vertical frame member;

a first plurality of second deployable spars, each said spars having a proximal end and a distal end;

each of said second deployable spars being pivotally connected at a proximal end to a lower end of a respective one of said vertical frame members for pivotal movement of said distal end between a stowed position and a deployed position outwardly extended below said vertical frame member;

spring means for deploying said first deployable spars to said deployed position of said first deployable spars;

spring means for deploying said second deployable spars to said deployed position of said second deployable spars;

a first tension line extending in a closed loop about the distal ends of said first deployable spars and coupled to a distal end of each of said first deployable spars;

a second tension line extending in a closed loop about the distal ends of said second deployable spars and coupled to a distal end of each of said second deployable spars;

and deployment means for moving said structural frame and said deployable spars from a stowed position to a deployed position.

9. The invention as defined in claim 8 wherein each said rectangular shaped bay further includes: a telescoping diagonal member extending between and pivotally connected to diagonally opposed corners of said rectangular frame; said telescoping diagonal member including a latch.

10. The invention as defined in claim 9, wherein said telescoping diagonal member includes an axially extending passage therethrough; and wherein said deployment means includes a cord; said cord extending serially through each of said telescoping diagonal members.

11. The invention as defined in claim 10, wherein each rectangular shaped bay further includes: first and second triangle struts of equal length pivotally connected together at one end; means pivotally connecting the remaining end of each of said first and second triangle struts to said pivotal connections at opposite ends of said telescoping diagonal member.

12. A foldable perimeter truss reflector, comprising:

a first plurality of horizontal longerons connected together in end to end relationship to form a first closed loop;

a second like plurality of horizontal longerons connected together in end to end relationship to form a second closed loop of like size to said first closed loop;

said first and second closed loops being coaxially and angularly aligned with one another, whereby said longerons of said first plurality of horizontal longerons overlie and are aligned with associated horizontal longerons of said second plurality of horizontal longerons;

a plurality of vertical struts, said plurality being equal in number to said first plurality of horizontal longerons;

each said vertical strut being connected between adjacent ends of two adjacent ones of said horizontal longerons of said first closed loop and an underlying adjacent ends of two adjacent ones of said horizontal longerons of said second closed loop that underlie said two adjacent ones of said horizontal longerons of said first closed loop to define a plurality of four side polygonal frames positioned in side by side relationship arranged in a cylindrical ring with each said frame including upper left, upper right, lower left and lower right corners;

a first plurality of deployable spars, each said spar in said first plurality being pivotally supported at one end by a respective one of said upper left corners;

spring biased pivot means at each said upper left corner for biasing a respective deployable spar to pivot to a deployed position with a distal end of said associated deployable spar positioned outwardly of the adjacent four sided polygonal frame;

a second plurality of deployable spars, each said spar in said second plurality being pivotally supported at one end by a respective one of said lower left corners; and spring biased pivot means at each said lower left corners for biasing a respective deployable spar to pivot to a deployed position with a distal end of said associated deployable spar positioned outwardly of the adjacent four sided polygonal frame;

a plurality of flexible tension lines, each tension line being connected between the outer ends of an adjacent pair of said first plurality of deployable spars and collectively defining a circular hoop as a front edge to the truss;

a second plurality of flexible tension lines, each tension line being connected between the outer ends of an adjacent pair of said second plurality of deployable spars and collectively defining a second circular hoop as a rear edge to the truss;

a first plurality of catenary lines, said first plurality of catenary lines being supported from said distal ends of said first plurality of deployable spars; and a second plurality of catenary lines, said second plurality of catenary lines being equal in number to said first plurality and said second plurality of catenary lines being supported from said distal ends of said second plurality of deployable spars.

13. The invention as defined in claim 12, wherein each said four sided polygonal frame further includes:

a telescoping diagonal member, said telescoping diagonal member extending between and pivotally connected to diagonally opposite corners of said rectangular frame, whereby said diagonal member decreases in length and pivots relative to said vertical struts when moved toward the deployed condition;

said telescoping diagonal member including a latch for latching said diagonal member to a predetermined length when said diagonal member is in the deployed condition;

a pair of arms of equal length, said arms being pivotally connected at one end and the remaining end of each said arm being pivotally connected, respectively, to the same diagonally opposite corners of said four sided polygonal frame to which said telescoping diagonal member is connected and overlying said telescoping diagonal member;

said pair of arms defining with said associated telescoping diagonal member an isosceles triangle when in the deployed condition, and being adapted to fold down against said telescoping diagonal member when moved toward the stowed condition;

first guy wire, said first guy wire being connected to an upper corner of said rectangular frame and to said pivotal connection between said pair of arms for bracing said isosceles triangle in one direction when in the deployed condition;

second guy wire, said second guy wire being connected to a lower corner of said rectangular frame and to said pivotal connection between said pair of arms for bracing said isosceles triangle in an opposite direction when in the deployed condition;

and wherein said invention further includes for each said rectangular frame:

third and fourth guy wires, each of said third and fourth guy wires being connected to a respective distal end of a respective one of an adjacent pair of deployable struts in said first plurality of deployable struts and a pivotal connection between a pivotally connected pair of arms within a rectangular frame that is located between said adjacent pair of upper deployable struts; and fifth and sixth guy wires, each of said fifth and sixth guy wires being connected to a respective distal end of a respective one of an adjacent pair of deployable struts in said second plurality of deployable struts and said same pivotal connection between said pivotally connected pair of arms within a rectangular frame that is located between said adjacent pair of upper deployable struts.

14. The invention as defined in claim 12, wherein each of said horizontal hoop longerons further includes a latching pivot joint at the midsection thereof, whereby said horizontal longerons fold in half inwardly when moving toward the stowed condition; and wherein each of said vertical struts further comprise a telescoping member, whereby said vertical strut telescopes in length when moving to the stowed condition; and wherein each frame further includes:

a first pair of pivotally connected arms of equal length; said arms of said first pair being pivotally connected at one end and the remaining end of each said arm being pivotally connected to opposite ends of a vertical strut bordering a left side of said frame;

said first pair of pivotally connected arms defining with said associated vertical strut an isosceles triangle when in the deployed condition and being adapted to flatten down alongside said associated vertical strut when said associated vertical strut is telescoped in length in the stowed condition;

a second pair of pivotally connected arms of equal length; said arms of said second pair being pivotally connected at one end and the remaining end of each said arm being pivotally connected to opposite ends of a second vertical strut bordering a right side of said frame;

said pivotally connected arms of said second pair defining with said associated second vertical strut an isosceles triangle when in the deployed condition and being adapted to flatten down alongside said second vertical strut when said second vertical strut is telescoped in length in the stowed condition;

first and second diagonal members pivotally connected together at the respective midpoints thereof to permit scissor like relative movement toward one another when moving toward the stowed condition;

said first diagonal member being pivotally connected to and extending from an upper left corner of said rectangular frame to a lower right corner of said rectangular frame and pivotally connected to said lower right corner to permit pivoting movement relative to said vertical struts when moving toward the stowed condition;

said second diagonal member being pivotally connected to and extending from an upper right corner of said rectangular frame to a lower left corner of said rectangular frame and pivotally connected to said lower left corner to permit pivoting movement relative to said vertical struts when moving toward the stowed condition, whereby said second diagonal member crosses said first diagonal member within said rectangular frame;

a tension line connected between said connected ends of said first pair of pivotally connected arms and said connected ends of said second pair of pivotally connected arms;

a first guy line, said first guy line being connected between said connected ends of said first pair of pivotally connected arms and a distal end of said upper deployable spar associated with a vertical strut bordering the right side of said rectangular frame;

a second guy line, said second guy line being connected between said connected ends of said first pair of pivotally connected arms and a distal end of said lower deployable spar associated with a vertical strut bordering the right side of said rectangular frame;

a third guy line, said third guy line being connected between said connected ends of said second pair of pivotally connected arms and a distal end of said upper deployable spar associated with a vertical strut bordering the left side of said rectangular frame; and a fourth guy line, said fourth guy line being connected between said connected ends of said second pair of pivotally connected arms and a distal end of said lower deployable spar associated with a vertical strut bordering the left side of said rectangular frame.

15. The invention as defined in claim 14, wherein said rectangular frame further includes:

a fifth guy line connected between said connected ends of said second pair of pivotally connected arms and said upper left corner of said rectangular frame.

16. The invention as defined in claim 14 wherein said rectangular frame includes:

a fifth guy line connected between said connected ends of said first pair of pivotally connected arms and said lower right corner of said rectangular frame.

17. The invention as defined in claim 12, wherein said rectangular frame further includes:

first and second diagonal members pivotally connected together at the respective midpoints thereof to permit scissor like relative movement;

said first diagonal member being pivotally connected to and extending from an upper left corner of said defined frame to a lower right corner of said defined frame and pivotally connected to said lower right corner;

said second diagonal member being pivotally connected to and extending from an upper right corner of said defined frame to a lower left corner of said defined frame and pivotally connected to said lower left corner, whereby said second diagonal member crosses said first diagonal member within said defined frame;

four arms of equal length; said arms being pivotally connected together at one end and a remaining end of each of said four arms being pivotally connected to a respective one of said four corners of said defined frame, wherein said four arms define a radially outwardly extending pyramid on said frame when in the deployed condition that collapses down when in the stowed condition;

a plurality of guy wires, each said guy wire being attached to said pivotal connection between said four arms and an outer end of a respective one of four adjacent deployable spars to support said pyramid at the apex thereof against lateral movement; and, wherein said invention further includes:

a plurality of tension lines, each tension line being connected between said pivotal connection between said four arms of a respective one of said rectangular frames and a corresponding pivotal connection of four arms in the next adjacent frame, whereby said tension lines collectively define a circular hoop line.

18. The invention as defined in claim 12, wherein said vertical struts further comprise telescoping struts for enabling said respective vertical struts to extend in length when moved toward the stowed condition; and wherein said horizontal longerons each include a latching hinge joint at a central position for enabling said longeron to fold in half inwardly when moved toward the stowed condition; and wherein said frame further comprises:

a pair of scissors connected diagonal members, said diagonal members extending between diagonally opposed corners of said rectangular frame and criss crossing one another; said diagonal members each having their ends pivotally connected to a respective one of said four corners of said frame for enabling said scissors connected diagonal members to pivot relative to one another and pivot relative to said vertical struts when moved toward the stowed condition;

a first guy wire connected between an outer end of the one of said first plurality of deployable spars connected to said vertical strut bordering the left side of said rectangular frame and a lower right corner of said rectangular frame;

a second guy wire connected between an outer end of the one of said second plurality of deployable spars connected to said vertical strut bordering the left side of said rectangular frame and an upper right corner of said rectangular frame;

a third guy wire connected between an outer end of the one of said first plurality of deployable spars connected to said vertical strut bordering the right side of said rectangular frame and a lower left corner of said rectangular frame; and a fourth guy wire connected between an outer end of the one of said first plurality of deployable spars connected to said vertical strut bordering the right side of said rectangular frame and an upper right corner of said rectangular frame.

19. The invention as defined in claim 12, further comprising:

a telescoping diagonal member, said diagonal member being pivotally connected at each end to respective diagonally opposed corners of said rectangular frame for enabling said diagonal member to stretch in length and pivot relative to said vertical struts when moved toward the stowed condition;

a first guy wire connected between an outer end of the one of said first plurality of deployable spars connected to said vertical strut bordering the left side of said rectangular frame and a lower right corner of said rectangular frame;

a second guy wire connected between an outer end of the one of said second plurality of deployable spars connected to said vertical strut bordering the left side of said rectangular frame and an upper right corner of said rectangular frame;

a third guy wire connected between an outer end of the one of said first plurality of deployable spars connected to said vertical strut bordering the right side of said rectangular frame and a lower left corner of said rectangular frame; and a fourth guy wire connected between an outer end of the one of said first plurality of deployable spars connected to said vertical strut bordering the right side of said rectangular frame and an upper right corner of said rectangular frame.

20. A foldable perimeter truss reflector, comprising:

a first plurality of horizontal longerons connected together in end to end relationship to form a first closed loop;

a second like plurality of horizontal longerons connected together in end to end relationship to form a second closed loop of like size to said first closed loop;

said first and second closed loops being coaxially and angularly aligned with one another, whereby said longerons of said first plurality of horizontal longerons overlie and are aligned with associated horizontal longerons of said second plurality of horizontal longerons;

a plurality of vertical struts, said plurality being equal in number to said first plurality of horizontal longerons;

each said vertical strut being connected between adjacent ends of two adjacent ones of said horizontal longerons of said first closed loop and an underlying adjacent ends of two adjacent ones of said horizontal longerons of said second closed loop that underlie said two adjacent ones of said horizontal longerons of said first closed loop to define a plurality of rectangular frames positioned in side by side relationship arranged in a cylindrical ring with each said frame including upper left, upper right, lower left and lower right corners;

a first plurality of deployable spars, each said spar in said first plurality being pivotally supported at one end by a respective one of said upper left corners;

spring biased pivot means at each said upper left corner for biasing a respective deployable spar to pivot to a deployed position with a distal end of said associated deployable spar positioned outwardly of the adjacent rectangular frame;

a second plurality of deployable spars, each said spar in said second plurality being pivotally supported at one end by a respective one of said lower left corners; and spring biased pivot means at each said lower left corner for biasing a respective deployable spar to pivot to a deployed position with a distal end of said associated deployable spar positioned outwardly of the adjacent rectangular frame;

a plurality of flexible tension lines, each tension line being connected between the outer ends of an adjacent pair of said first plurality of deployable spars and collectively defining a circular hoop for a front edge to the truss;

a second plurality of flexible tension lines, each tension line being connected between the outer ends of an adjacent pair of said second plurality of deployable spars and collectively defining a second circular hoop for a rear edge to the truss;

a first plurality of catenary lines, said first plurality of catenary lines being supported from said distal ends of said first plurality of deployable spars;

a second plurality of catenary lines, said second plurality of catenary lines being equal in number to said first plurality and said second plurality of catenary lines being supported from said distal ends of said second plurality of deployable spars;

a plurality of first fitting means, said first fitting means for connecting one end of one of said vertical struts and an end of each of said two adjacent horizontal longerons of said first closed loop, and a spring biased pivot means associated with one of said first plurality of deployable spars; and a second plurality of first fitting means, said first fitting means in said second plurality for connecting a second end of said one of said vertical struts and an end of each of said two adjacent horizontal longerons of said second closed loop, and a spring biased pivot means associated with one of said second plurality of deployable spars.

21. The invention as defined in claim 20, wherein each said rectangular frame further includes:

a telescoping diagonal member, said telescoping diagonal member extending between and pivotally connected to diagonally opposite corners of said rectangular frame, whereby said diagonal member stretches in length and pivots relative to said vertical struts when moved toward the stowed condition;

a pair of arms of equal length, said arms being pivotally connected at one end and the remaining end of each said arm being pivotally connected to the same diagonally opposite corners of said rectangular frame to which said telescoping diagonal member is connected and overlying said telescoping diagonal member; said pair of arms defining with said associated telescoping diagonal member an isosceles triangle when in the deployed condition, and being adapted to fold down against said telescoping diagonal member when moved toward the stowed condition;

first guy wire, said first guy wire being connected to an upper corner of said rectangular frame and to said pivotal connection between said pair of arms for bracing said isosceles triangle in one direction when in the deployed condition;

second guy wire, said second guy wire being connected to a lower corner of said rectangular frame and to said pivotal connection between said pair of arms for bracing said isosceles triangle in an opposite direction when in the deployed condition;

and wherein said invention further includes for each said rectangular frame:

third and fourth guy wires, each of said third and fourth guy wires being connected to a respective distal end of a respective one of an adjacent pair of deployable struts in said first plurality of deployable struts and a pivotal connection between a pivotally connected pair of arms within a rectangular frame that is located between said adjacent pair of upper deployable struts; and fifth and sixth guy wires, each of said fifth and sixth guy wires being connected to a respective distal end of a respective one of an adjacent pair of deployable struts in said second plurality of deployable struts and said same pivotal connection between said pivotally connected pair of arms within a rectangular frame that is located between said adjacent pair of upper deployable struts;

and wherein each of said first fitting means of said first plurality further includes pivot means for pivotally mounting one end of said telescoping diagonal member, and another pivot means for pivotally mounting an end of one of said pair of arms;

and wherein each of said first fitting means of said second plurality further includes pivot means for pivotally mounting a second end of said telescoping diagonal member, and another pivot means for pivotally mounting an end of a second one of said pair of arms.

22. The invention as defined in claim 21, wherein each of said horizontal hoop longerons further includes a latching pivot joint at the midsection thereof, whereby said horizontal longerons fold in half inwardly when moving toward the stowed condition; and wherein each of said vertical struts further comprise a telescoping member, whereby said vertical strut telescopes in length when moving to the stowed condition; and wherein each frame further includes:

a first pair of pivotally connected arms of equal length; said arms of said first pair being pivotally connected at one end and the remaining end of each said arm being pivotally connected to opposite ends of a vertical strut bordering a left side of said frame;

said first pair of pivotally connected arms defining with said associated vertical strut an isosceles triangle when in the deployed condition and being adapted to flatten down alongside said associated vertical strut when said associated vertical strut is telescoped in length in the stowed condition;

a second pair of pivotally connected arms of equal length; said arms of said second pair being pivotally connected at one end and the remaining end of each said arm being pivotally connected to opposite ends of a second vertical strut bordering a right side of said frame;

said pivotally connected arms of said second pair defining with said associated second vertical strut an isosceles triangle when in the deployed condition and being adapted to flatten down alongside said second vertical strut when said second vertical strut is telescoped in length in the stowed condition;

first and second diagonal members pivotally connected together at the respective midpoints thereof to permit scissor like relative movement toward one another when moving toward the stowed condition;

said first diagonal member being pivotally connected to and extending from an upper left corner of said rectangular frame to a lower right corner of said rectangular frame and pivotally connected to said lower right corner to permit pivoting movement relative to said vertical struts when moving toward the stowed condition;

said second diagonal member being pivotally connected to and extending from an upper right corner of said rectangular frame to a lower left corner of said rectangular frame and pivotally connected to said lower left corner to permit pivoting movement relative to said vertical struts when moving toward the stowed condition, whereby said second diagonal member crosses said first diagonal member within said rectangular frame;

a tension line connected between said connected ends of said first pair of pivotally connected arms and said connected ends of said second pair of pivotally connected arms;

a first guy line, said first guy line being connected between said connected ends of said first pair of pivotally connected arms and a distal end of said upper deployable spar associated with a vertical strut bordering the right side of said rectangular frame;

a second guy line, said second guy line being connected between said connected ends of said first pair of pivotally connected arms and a distal end of said lower deployable spar associated with a vertical strut bordering the right side of said rectangular frame;

a third guy line, said third guy line being connected between said connected ends of said second pair of pivotally connected arms and a distal end of said upper deployable spar associated with a vertical strut bordering the left side of said rectangular frame; and a fourth guy line, said fourth guy line being connected between said connected ends of said second pair of pivotally connected arms and a distal end of said lower deployable spar associated with a vertical strut bordering the left side of said rectangular frame;

and wherein each of said first plurality of first fitting means further includes a pivot joint for connecting one end of one arm of a pair of pivotally connected arms associated with said vertical strut and further pivot joint for pivotally connecting an end of one of said first and second diagonal members and a still further pivot joint for pivotally connecting the other end of said one of said first and second diagonal members of the frame of an adjacent bay;

and wherein each of said second plurality of first fitting means further includes a pivot joint for connecting one end of the other arm of said pair of pivotally connected arms associated with said vertical strut and a further pivot joint for pivotally connecting an end of the other one of said first and second diagonal members and a still further pivot joint for pivotally connecting the second end of said one of said first and second diagonal members of said frame of said adjacent bay.

23. The invention as defined in claim 22, wherein said rectangular frame further includes:

a fifth guy line connected between said connected ends of said second pair of pivotally connected arms and said upper left corner of said rectangular frame; and wherein said first fitting means of said first plurality further includes anchor means for anchoring an end of said fifth guy line.

24. The invention as defined in claim 22 wherein said rectangular frame includes:

a fifth guy line connected between said connected ends of said first pair of pivotally connected arms and said lower right corner of said rectangular frame; and wherein said first fitting means of said second plurality further includes anchor means for anchoring an end of said fifth guy line.

25. A catenary system for a perimeter truss antenna, said perimeter truss antenna including a perimeter truss having front and rear ends, each said ends defining a predetermined area and periphery, and a sheet of pliant reflective material for substantially covering said front end, comprising:

a plurality of inextensible tension members for supporting said sheet of pliant reflective material in a curved geometry at said front end of said truss, each of said tension members including first and second ends; said first end of each tension member in said plurality being coupled together in common at a central location with the corresponding first ends of the other tension members in said plurality and each said tension member extending radially outwardly from said central location for connection of said second end to a mutually exclusive position at said periphery of an end of said perimeter truss.

26. The invention as defined in claim 25, wherein said central location comprises a hub; said hub being secured to said first end of each of said tension members for coupling said tension members together, and said tension members collectively maintaining said hub in a suspended position.

27. The invention as defined in claim 26, wherein said hub comprises at least one ring.

28. The invention as defined in claim 25, wherein said plurality of tension members comprise first and second groups of tension members, said first and second groups being equal in number;

each of said tension members in said second group being aligned with a respective one of said tension members in said first group; and wherein said end of said truss to which said tension members in said first group are connected comprises said front end of said truss; and wherein said end of said truss to which said tension members in said second group are connected comprises said rear end of said truss.

29. The invention as defined in claim 28, wherein said central location is located inside said perimeter truss in a suspended position.

30. The invention as defined in claim 26, wherein said hub comprises: first and second rings, said rings being spaced apart and coaxially oriented.

31. A cable management system for a deployable perimeter truss reflector, said perimeter truss reflector including a catenary system, a plurality of structural members and at least one inextensible tension member connected between two of said plurality of structural members for supporting said catenary system, and said structural members having a stowed position and a deployed position, comprising:

at least one hollow cylinder;

said cylinder being attached to one of said structural members;

said inextensible tension member having first and second end portions for connection to respective ones of said structural members, and, when in the stowed condition, a helical shaped intermediate portion;

said helical shaped intermediate portion being stored within said hollow cylinder for withdrawal by pulling on said end portions; and said structural members pulling on said first and second end portions of said inextensible tension member when changing from said stowed position to said deployed position to unfurl said helical shaped intermediate portion from said cylinder and transform said helical shape to a straight shape.

32. The invention as defined in claim 31, wherein said cylinder comprises a flexible material and includes a longitudinal slit opening along a cylindrical side; wherein at least one of said first and second end portions of said tension member passes through said slit opening; and wherein the edges of said slit opening loosely grip a portion of said tension member.

33. In a deployable perimeter truss reflector, said perimeter truss reflector being unfoldable from a stowed condition and a deployed condition, said deployable perimeter truss reflector including a catenary system, a plurality of structural members movable between a stowed position and a deployed position and a plurality of tension members connected between respective ones of said structural members for supporting said catenary system, said tension members being taut when said structural members are in said deployed position and being slack when said structural members are in said stowed position, a cable management system to prevent entanglement of said tension members in said structural members when said structural members are moved to said deployed position comprising:

means for taking up and stowing said slack in said tension members when said structural members are in said stowed position to prevent said tension members from draping and permitting withdrawal of said stowed slack as said structural members move to said deployed position.

34. The invention as defined in claim 33 wherein said means comprises: a plurality of hollow cylinders.

35. The invention as defined in claim 33, wherein at least one of said hollow cylinders includes an axially extending slit there through extending the height of said at least one cylinder.

36. The invention as defined in claim 34, wherein said slack is positioned within the hollow of said hollow cylinders in the form of a helical coil.

37. The invention as defined in claim 35, wherein said hollow cylinders of said plurality are distributed amongst and attached to respective ones of said plurality of structural members.

38. In a deployable perimeter truss reflector, said perimeter truss reflector comprising a plurality of like structural members, each of said structural comprising a hollow tube; said structural members lying in parallel when in the stowed condition and oriented at an angle relative to one another and defining a zig-zag configuration when in the deployed condition; and including a plurality of fittings for pivotally connecting together an end of a respective pair of said plurality of structural members, whereby said structural members may pivot in opposite directions a limited extent about said fitting;

one-half said plurality of fittings being connected to a first end of said structural members and the other half of said fittings being connected to the opposed end of said structural members, a deployment system wherein:

all of said plurality of fittings includes a passage therethrough leading into said hollow of said tubes; and all of said plurality of fittings, except one fitting further comprises: a pulley, a shaft, and said pulley mounted for rotation about said shaft; and a cord containing first and second ends;

said cord extending in a serial path through each of said plurality of structural members and said fitting and around said pulley in each said fitting;

said first and second ends of said cord entering said serial path and exiting from said serial path through said one fitting, whereby a pulling force on said cord exerted relative to said one fitting translates into individual forces on the axle of said pulleys to force said structural members to pivot relative to said fitting in opposite directions, whereby said structural members attain said zig-zag configuration.

39. A deployable perimeter truss, deployable between a stowed position to a deployed position, comprising:

a pair of vertical struts and a pair of horizontal longerons located at right angles to said vertical struts to define a four-sided polygonal frame when in deployed position; each said strut being pivotally connected to adjacent horizontal longerons wherein one of said struts is positioned in a line with one of said longerons and the other of said vertical struts is positioned in another line with the other of said longerons and both said lines lie adjacent one another when in the stowed position;

a telescoping diagonal member, said telescoping diagonal member being of a first predetermined length when in the stowed condition and being of a second predetermined length, less than than said first predetermined length, when in the deployed condition;

said telescoping diagonal member including a latch for latching said telescoping diagonal member to a predetermined length;

said telescoping diagonal member being pivotally connected at one end to the juncture of one of said vertical struts with one of said longerons and being pivotally connected at an opposed end to the juncture of said other one of said vertical struts with said other one of said longerons;

first and second struts, said struts being of equal length;

first pivot means connecting a first end of each of said first and second struts;

said first pivot means permitting said struts to pivot relative to one another between a first position in which said first and second struts are oriented colinearly and a second position in which said first and second struts are oriented at a ninety degree angle to one another;

second pivot means for pivotally connecting said second end of one of said struts to said pivotal connection at one end of said telescoping diagonal member; and third pivot means for connecting said second end of the other of said first and second struts to said pivotal connection at the other end of said telescoping diagonal member; wherein said first and second struts and said telescoping diagonal member pivot together relative to said vertical struts and longerons and define with said telescoping member a triangle figure when in the deployed position.

40. The invention as defined in claim 39, further comprising:

first and second guy lines;

said first guy line connected between said first pivot means and another juncture between one of said vertical struts and one of said horizontal longerons;

said second guy line connected between said first pivot means and still another juncture between one of said vertical struts and one of said horizontal longerons.

* * * * *